US008178266B2

(12) United States Patent
Tada et al.

(10) Patent No.: US 8,178,266 B2
(45) Date of Patent: May 15, 2012

(54) ELECTROPHOTOGRAPHIC PHOTORECEPTOR, IMAGE FORMING APPARATUS USING THE ELECTROPHOTOGRAPHIC PHOTORECEPTOR, AND METHOD OF PRODUCING ELECTROPHOTOGRAPHIC PHOTORECEPTOR

(75) Inventors: Hiromi Tada, Numazu (JP); Nozomu Tamoto, Numazu (JP); Tomoyuki Shimada, Shizuoka-ken (JP); Takafumi Iwamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 427 days.

(21) Appl. No.: 12/489,833

(22) Filed: Jun. 23, 2009

(65) Prior Publication Data

US 2009/0324281 A1 Dec. 31, 2009

(30) Foreign Application Priority Data

Jun. 27, 2008 (JP) ..... 2008-168717

(51) Int. Cl.
*G03G 5/047* (2006.01)

(52) U.S. Cl. ..... 430/58.85; 430/58.8; 430/59.5; 430/58.35; 430/970; 430/133; 399/159

(58) Field of Classification Search ..... 430/58.85, 430/59.5, 58.35, 970, 133; 399/159
See application file for complete search history.

(56) References Cited

U.S. PATENT DOCUMENTS

| | | | | |
|---|---|---|---|---|
| 3,357,989 | A | 12/1967 | Byrne et al. | |
| 3,873,311 | A | 3/1975 | Contois et al. | |
| 3,873,312 | A | 3/1975 | Contois et al. | |
| 3,954,568 | A | 5/1976 | DuPree | |
| 4,507,374 | A | 3/1985 | Kakuta et al. | |
| 4,579,801 | A | 4/1986 | Yashiki | |
| 4,725,519 | A | 2/1988 | Suzuki et al. | |
| 4,883,852 | A | 11/1989 | Masuoka et al. | |
| 4,886,846 | A | 12/1989 | Shimada et al. | |
| 4,898,799 | A | 2/1990 | Fujimaki et al. | |
| 4,906,545 | A | 3/1990 | Fukagai et al. | |
| 5,302,479 | A | 4/1994 | Daimon et al. | |
| 5,440,029 | A | 8/1995 | Nukada et al. | |
| 5,459,004 | A | 10/1995 | Daimon et al. | |
| 5,589,314 | A * | 12/1996 | Etoh et al. | 430/970 |
| 5,736,282 | A | 4/1998 | Tamura et al. | |
| 5,874,570 | A | 2/1999 | Tamura et al. | |
| 6,291,120 | B1 | 9/2001 | Nishigaki et al. | |
| 7,670,743 | B2 * | 3/2010 | Ohta et al. | 430/65 |
| 7,846,635 | B2 * | 12/2010 | Niimi | 399/159 |
| 7,955,768 | B2 * | 6/2011 | Tada et al. | 430/58.05 |
| 2002/0051918 | A1 * | 5/2002 | Miyamoto et al. | 430/58.85 |
| 2004/0033428 | A1 | 2/2004 | Niimi | |
| 2005/0008957 | A1 * | 1/2005 | Ikegami et al. | 430/58.85 |
| 2005/0069797 | A1 * | 3/2005 | Niimi et al. | 430/64 |
| 2006/0057479 | A1 * | 3/2006 | Niimi et al. | 430/59.4 |
| 2006/0177749 | A1 * | 8/2006 | Tamoto et al. | 430/65 |
| 2006/0240346 | A1 * | 10/2006 | Toda et al. | 430/64 |
| 2007/0059619 | A1 * | 3/2007 | Shimoyama et al. | 430/65 |
| 2007/0154825 | A1 | 7/2007 | Tamoto et al. | |
| 2007/0190439 | A1 * | 8/2007 | Yokota et al. | 430/58.85 |
| 2007/0281227 | A1 * | 12/2007 | Maruo et al. | 399/159 |
| 2008/0286008 | A1 * | 11/2008 | Niimi | 399/159 |

FOREIGN PATENT DOCUMENTS

| | | |
|---|---|---|
| EP | 1698943 A1 | 9/2006 |
| JP | 47-6341 | 4/1972 |
| JP | 52-10138 | 1/1977 |
| JP | 52-36016 | 9/1977 |
| JP | 54-36859 | 11/1979 |
| JP | 58-58556 | 4/1983 |
| JP | 58-24782 | 5/1983 |
| JP | 58-105155 | 6/1983 |
| JP | 58-57744 | 12/1983 |
| JP | 59-1659 | 1/1984 |
| JP | 59-17557 | 1/1984 |
| JP | 60-66258 | 4/1985 |
| JP | 61-239248 | 10/1986 |
| JP | 3-364 | 1/1988 |
| JP | 63-366 | 1/1988 |
| JP | 63-198067 | 8/1988 |
| JP | 64-17066 | 1/1989 |
| JP | 64-68762 | 3/1989 |
| JP | 64-68763 | 3/1989 |
| JP | 64-73352 | 3/1989 |
| JP | 64-73353 | 3/1989 |
| JP | 1-118848 | 5/1989 |
| JP | 1-118849 | 5/1989 |
| JP | 1-123868 | 5/1989 |
| JP | 61-109056 | 5/1989 |

(Continued)

OTHER PUBLICATIONS

U.S. Appl. No. 12/319,628 of Nozomu Tamoto et al., filed Jan. 9, 2009. U.S. Appl. No. 12/319,806 of Takafumi Iwamoto et al., filed Jan. 12, 2009.

Moser, Frank H., et al., *Phthalocyanine Compounds*, pp. 1-13, Reinhold Publishing Corporation, New York, NY, 1963.

Moser, Frank H., et al., *The Phthalocyanines*, pp. 29-52, Reinhold Publishing Corporation, New York, NY, 1983.

(Continued)

*Primary Examiner* — Christopher Rodee
(74) *Attorney, Agent, or Firm* — Cooper & Dunham LLP

(57) ABSTRACT

An electrophotographic photoreceptor is provided that contains a conductive substrate, an undercoat layer, a charge generation layer, and a charge transport layer, wherein the under coat layer contains a binder resin and multiple inorganic pigments each having different average primary particle diameters in a total amount of from 75 to 86% by weight, the charge generation layer contains a binder resin and a titanyl phthalocyanine pigment having a specific X-ray diffraction spectrum in an amount of from 70 to 85% by weight, the charge transport layer comprises a specific distyryl compound, and the following formulae (2-1) to (2-3) are satisfied:

$$0.2 \leqq (D(F2)/D(G)) \leqq 0.5 \quad (2\text{-}1)$$

$$0.2 \leqq D(F1) \quad (2\text{-}2)$$

$$D(F2) \leqq D(F1) \quad (2\text{-}3)$$

wherein D(F1) (μm) and D(F2) (μm) represent average primary particle diameters of the largest and smallest inorganic pigments, respectively, and D(G) (μm) represents an average primary particle diameter of the titanyl phthalocyanine pigment.

19 Claims, 5 Drawing Sheets

FOREIGN PATENT DOCUMENTS

| | | |
|---|---|---|
| JP | 1-51183 | 11/1989 |
| JP | 1-51185 | 11/1989 |
| JP | 3-4904 | 1/1991 |
| JP | 3-56470 | 8/1991 |
| JP | 4-198367 | 7/1992 |
| JP | 5-31137 | 5/1993 |
| JP | 5-55860 | 8/1993 |
| JP | 5-60503 | 9/1993 |
| JP | 6-1386 | 1/1994 |
| JP | 6-29975 | 4/1994 |
| JP | 6-45770 | 6/1994 |
| JP | 6-293769 | 10/1994 |
| JP | 7-30265 | 4/1995 |
| JP | 7-30267 | 4/1995 |
| JP | 7-244389 | 9/1995 |
| JP | 7-97221 | 10/1995 |
| JP | 8-209023 | 8/1996 |
| JP | 2552695 | 8/1996 |
| JP | 10-39529 | 2/1998 |
| JP | 11-143098 | 5/1999 |
| JP | 11-352710 | 12/1999 |
| JP | 3166283 | 3/2001 |
| JP | 3166293 | 3/2001 |
| JP | 3287126 | 3/2002 |
| JP | 2004-2874 | 1/2004 |
| JP | 2004-83859 | 3/2004 |
| JP | 2005-15682 | 1/2005 |
| JP | 2005-148725 | 6/2005 |
| JP | 2006-251099 | 9/2006 |
| JP | 2007-72139 | 3/2007 |
| JP | 2007-212670 | 8/2007 |

OTHER PUBLICATIONS

Oct. 2, 2009 European search report in connection with a counterpart European patent application No. 09 16 3933.

* cited by examiner

ELECTROPHOTOGRAPHIC PHOTORECEPTOR, IMAGE FORMING APPARATUS USING THE ELECTROPHOTOGRAPHIC PHOTORECEPTOR, AND METHOD OF PRODUCING ELECTROPHOTOGRAPHIC PHOTORECEPTOR

BACKGROUND OF THE INVENTION

1. Field of the Invention

The present invention relates to an electrophotographic photoreceptor. In addition, the present invention also relates to an image forming apparatus using the electrophotographic photoreceptor and a method of producing electrophotographic photoreceptor.

2. Discussion of the Related Art

Image processing systems using electrophotography are remarkably developing recently. For example, laser printers and digital copiers which convert information into digital signals and record them optically are remarkably improving their print quality and reliability. There are demands for downsizing such laser printers and digital copiers and increasing the printing speed thereof as well as improving image quality. Besides, full-color laser printers and full-color digital copiers are growing in demand. Because of forming at least four-color toner images, full-color image forming apparatuses are more significantly favorable to provide higher printing speed and more compact body.

To speedup and downsize image forming apparatuses, electrophotographic photoreceptors preferably improve their durability and sensitivity much more. With regard to tandem image forming apparatuses that include four photoreceptors, it is effective to reduce the diameters of the photoreceptors for downsizing. However, a photoreceptor with a smaller diameter may be used under more sever conditions (e.g., higher speed), causing frequent replacement. Accordingly, photoreceptors to be used for high-speed and compact image forming apparatuses preferably have high sensitivity and high durability.

In general, organic photosensitive materials are widely used for electrophotographic photoreceptors because of their low cost, high manufacturability, and high environmental stability. Electrophotographic photoreceptors are broadly classified into multilayer photoreceptors in which a charge generation layer and a charge transport layer are separately provided and monolayer photoreceptors in which a single layer having functions of both generating and transporting charge is provided. Since multilayer photoreceptors are more flexible in choosing usable materials and are more improving their sensitivity, stability, and mechanical strength, they are in mainstream recently.

Various charge generation materials, such as azo pigments and phthalocyanine pigments, have been developed for use in charge generation layers of multilayer photoreceptors. Because of having high sensitivity to lights with long wavelengths of from 600 to 800 nm, phthalocyanine pigments are suitable for charge generation materials for electrophotographic printers and digital copiers containing LED or LD as a light source.

Phthalocyanine pigments include titanyl phthalocyanine pigments, metal-free phthalocyanine pigments, and hydroxygallium phthalocyanine pigments. Specific examples of titanyl phthalocyanine pigments include α-type described in Unexamined Japanese Patent Application Publication No. (hereinafter JP-A) 61-239248, Y-type described in JP-A 01-17066, I-type described in JP-A 61-109056, A-type described in JP-A 62-67094, C-type described in JP-A 63-364 and JP-A 63-366, B-type described in JP-A 2005-15682, m-type described in JP-A 63-198067, and quasi-amorphous-type described in JP-A 01-123868. Specific examples of metal-free phthalocyanine pigments include X-type described in U.S. Pat. No. 3,357,989 and 1-type described in JP-A 58-182639. Specific examples of hydroxygallium phthalocyanine pigments are described in JP-A 05-263007 and JP-A 05-279591.

Different phthalocyanine pigments have different sensitivities and stabilities. It is needless to say that a particle diameter, kinds of binder resins to be combined, a weight ratio to binder resins, kinds of charge transport materials to be combined, etc. may influence properties of phthalocyanine pigments. Further, the primary diameter of a phthalocyanine pigment may vary depending on a method of synthesizing it. Therefore, methods of synthesizing phthalocyanine pigments may influence dispersibility of the phthalocyanine pigments in charge generation layer coating liquids and electric properties of resultant photoreceptors.

JP-A 04-198367 describes a method of synthesizing a titanyl phthalocyanine pigment having an extremely small particle diameter. A charge generation material with a smaller particle diameter may improve sensitivity because the contact area with a charge transport layer increases. However, such small particles are difficult to finely disperse in a charge generation layer coating liquid, and therefore methods of dispersing them, kinds of binder resins to be combined, a ratio to binder resins may be limited. As a consequence, the charge generation material may not exert its sensitivity sufficiently.

In a charge generation layer, binder resins may significantly influence dispersion stability and crystal stability of pigments. In a case in which a ratio of pigments to binder resins is too large, the pigments may aggregate or generate crystal transition. Therefore, the ratio of pigments to binder resins is preferably varied without degrading dispersion stability of pigments.

JP-A 2007-212670 describes a technique to determine optimum binder resins for dispersing titanyl phthalocyanine pigments and an optimum ratio therebetween. More specifically, this publication describes a charge generation layer including a titanyl phthalocyanine pigment in an amount of from 50 to 350 parts by weight based on 100 parts by weight of a polyvinyl acetal resin. It is described therein that when the amount of the titanyl phthalocyanine pigment is 50 parts by weight or less, the titanyl phthalocyanine pigment does not generate sufficient amounts of charge and provides low sensitivity, and when the amount is 350 parts by weight or more, the titanyl phthalocyanine pigment is not reliably dispersed. Since there is a possibility that binder resins in a charge generation layer act as charge-trapping sites, it is generally considered that the amount of binder resins is preferably as small as possible. However, as described above, a proper amount of binder resin is used often.

It is needless to say that combinations of charge generation materials and charge transport materials influence photosensitive properties. Because of having high quantum efficiency, phthalocyanine pigments have an advantage in sensitivity and widely used as charge generation materials. On the other hand, phthalocyanine pigments generally have low ionization potential. To reduce charge injection barrier between a charge generation layer and a charge transport layer so that increase of residual potential is suppressed, a charge transport material to be used in combination with the phthalocyanine pigment preferably has an ionization potential equal to or less than that of the phthalocyanine pigment.

JP-A 2007-72139 describes such a technique in which a charge generation material having a low ionization potential reduces residual potential and improves sensitivity. However, it is generally known that charge generation materials having low ionization potentials degrade their chargeability with time.

In view of such a situation, JP 3287126 and JP-A 07-244389 each describe a charge transport layer including an antioxidant so as to make full use of charge transport materials having low ionization potentials, thereby suppressing decrease of sensitivity.

Even in a case in which phthalocyanine pigments having high sensitivity are used as charge generation materials, a photoreceptor does not provide high sensitivity if charge transportability of a charge transport layer is insufficient. JP-A 2004-002874, JP-A 11-352710, JP-A 11-143098, JP-A 10-039529, and JP-A 08-209023 each describe techniques to combine a distyryl compound which has good charge transportability as a charge transport material and a titanyl phthalocyanine pigment which has high quantum efficiency as a charge generation material. These techniques provide highly sensitive photoreceptors and reduce residual potentials thereof, however, charge stabilities thereof are poor.

To reliably provide high-grade images and high durability, provision of an undercoat layer is effective. When a photosensitive layer is provided directly on a substrate, defects present on the substrates such as scratches, impurities, and corrosions may be reflected in the resultant images, producing black dots and white spots therein. In particular, multilayer photoreceptors typically have a thin charge generation layer with a thickness of several microns or less, and therefore defects present on a substrate may cause defects on the charge generation layer as well. Besides, such a substrate has poor adhesiveness to photosensitive layers. In a case in which an undercoat layer is not provided in a photoreceptor, at the time the photoreceptor is charged, charges having an opposite polarity to those induced to a conductive substrate may locally leak and be injected to a photosensitive layer and a surface of the photoreceptor, resulting in charge reduction. As a consequence, an indefinitely large number of fine spots are developed in non-image portions of the resultant image in reversal developing methods in which non-irradiated portions on a photoreceptor correspond to non-image portions in the resultant image. This phenomenon is hereinafter referred to as background fouling. To prevent the occurrence of background fouling, provision of an undercoat layer is effective.

Undercoat layers formed with a single resin have been disclosed. For example, JP-A 47-6341 describes an undercoat layer including a cellulose nitrate, JP-A 60-66258 describes an undercoat layer including a nylon resin, JP-A 52-10138 describes an undercoat layer including a maleic acid based resin, and JP-A 58-105155 describes an undercoat layer including a polyvinyl alcohol resin.

Since such undercoat layers including a single resin have high electric resistance, residual potential may increase and image density and gradation of the resultant images may deteriorate in reversal developing methods. Moreover, because of having ion conductivity resulted from impurities, these undercoat layers may have much higher electric resistance in low-temperature and low-humidity conditions and residual potential may have large dependency on environmental conditions. In high-temperature and high-humidity conditions, these undercoat layers may have a much lower electric resistance, possibly degrading charge level. To prevent such a phenomenon, undercoat layers may be thinned as possible, however, it is difficult to optimize the thickness of the undercoat layers so that the electric resistance is stable and the occurrence of background fouling is prevented.

To solve the above-described problem, one proposed approach for controlling electric resistance of undercoat layers includes dispersing a conductive additive in an undercoat layer.

For example, JP-A 51-65942 describes an undercoat layer in which a carbon or a chalcogen substance is dispersed in a hardened resin, JP-A 52-82238 describes an undercoat layer including a thermal polymerization product formed using an isocyanate hardener in the presence of a quaternary ammonium salt, JP-A 55-130451 describes an undercoat layer including a resin in which a resistance control agent is added, and JP-A 58-93062 describes an undercoat layer including a resin in which an organic metal compound is added.

As described above, undercoat layers including a single resin have a problem of causing background fouling, and further another problem of causing interference fringes in the resultant images (this phenomenon is hereinafter referred to as moiré) when being used in an image forming apparatus using coherent light such as laser light which is generally used in reversal developing methods.

To simultaneously prevent the occurrence of moiré and control electric resistance of undercoat layers, techniques of including a pigment in an undercoat layer have been proposed.

For example, JP-A 58-58556 describes an undercoat layer in which an oxide of aluminum or tin is dispersed in a resin; JP-A 60-111255 describes an undercoat layer in which conductive particles are dispersed in a resin; JP-A 59-17557 describes an undercoat layer in which a magnetite is dispersed; JP-A 60-32054 describes an undercoat layer in which a titanium oxide and a tin oxide are dispersed in a resin; and JP-A 64-68762, JP-A 64-68763, JP-A 64-73352, JP-A 64-73353, JP-A 01-118848, and JP-A 01-118849 each describe undercoat layers in which powders of borides, nitrides, fluorides, and oxides of calcium, magnesium, and aluminum are dispersed in resins.

To sufficiently prevent the occurrence of moiré, pigments in undercoat layers preferably have a large particle diameter to some extent. However, such pigments having a large particle diameter may reduce volume ratio of the pigments in an undercoat layer, thereby increasing charge trapping sites in the undercoat layer in number.

SUMMARY OF THE INVENTION

Accordingly, example embodiments of the present invention provide an electrophotographic photoreceptor having high sensitivity, charge stability, and a small diameter; an image forming apparatus which reliably provides high-quality images; and a method of producing electrophotographic photoreceptor having high sensitivity, charge stability, and a small diameter. More specifically, example embodiments of the present invention provide an electrophotographic photoreceptor in which holes and electrons which are generated in a charge generation layer smoothly flow into a conductive substrate and the surface of the photoreceptor without clogging, so that sensitivity, charge stability, and image stability improve.

These and other features and advantages of the present invention, either individually or in combinations thereof, as hereinafter will become more readily apparent, can be attained by example embodiments described below.

One example embodiment provides an electrophotographic photoreceptor including a conductive substrate, an undercoat layer located overlying the conductive substrate, a charge generation layer located overlying the undercoat layer, and a charge transport layer located overlying the charge generation layer. The under coat layer includes a binder resin and multiple inorganic pigments each having different average primary particle diameters in a total amount of from 75 to 86% by weight. The charge generation layer includes a binder resin and a titanyl phthalocyanine pigment having a maximum diffraction peak at a Bragg angle 2θ (±0.2°) of 27.2° with respect to a characteristic X-ray specific to CuKα having a wavelength of 1.542 Å in an amount of from 70 to 85% by weight. The charge transport layer includes a distyryl compound having the following formula (1):

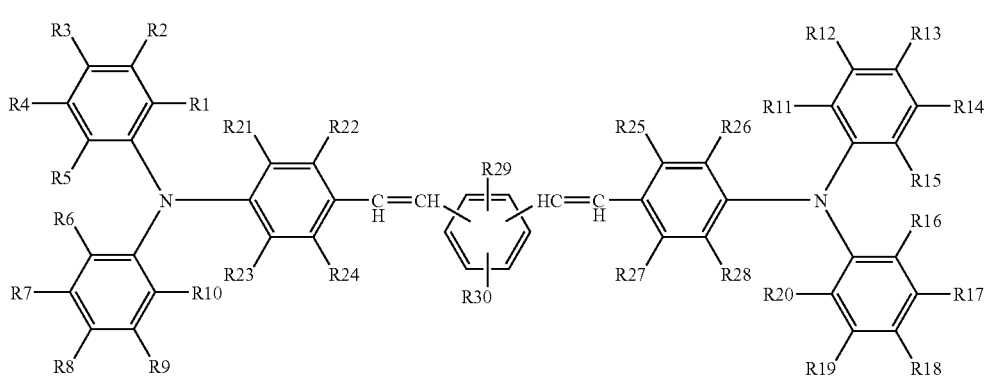

(1)

wherein each of R1 to R30 independently represents a hydrogen atom, an alkyl group having 1 to 3 carbon atoms, an alkoxyl group having 1 to 3 carbon atoms, an aryl group substituted with an alkyl group having 1 to 3 carbon atoms or an alkoxyl group having 1 to 3 carbon atoms, or an unsubstituted aryl group; and each of R1 and R30 may share bond connectivity with an adjacent group to form a ring. In addition, the following formulae (2-1) to (2-3) are satisfied:

$$0.2 \leqq (D(F2)/D(G)) \leqq 0.5 \quad (2\text{-}1)$$

$$0.2 \leqq D(F1) \quad (2\text{-}2)$$

$$D(F2) \leqq D(F1) \quad (2\text{-}3)$$

wherein D(F1) (μm) and D(F2) (μm) represent average primary particle diameters of the largest and smallest inorganic pigments, respectively, and D(G) (μm) represents an average primary particle diameter of the titanyl phthalocyanine pigment.

Another example embodiment of the present invention provides an image forming apparatus including the above-described electrophotographic photoreceptor, a charger configured to charge a surface of the electrophotographic photoreceptor, an irradiator configured to irradiate the charged surface of the electrophotographic photoreceptor to form an electrostatic latent image, a developing device configured to develop the electrostatic latent image with a toner to form a toner image, and a transfer device configured to transfer the toner image from electrophotographic photoreceptor onto a transfer member.

Yet another example embodiment of the present invention provides a method of producing electrophotographic photoreceptor including the steps of forming an undercoat layer on a conductive substrate, forming a charge generation layer on the undercoat layer, and forming a charge transport layer on the charge generation layer, which can provide the above-described electrophotographic photoreceptor.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

The photoreceptor of the present invention will be described in detail referring to drawings.

Within the context of the present invention, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

Figure 1:
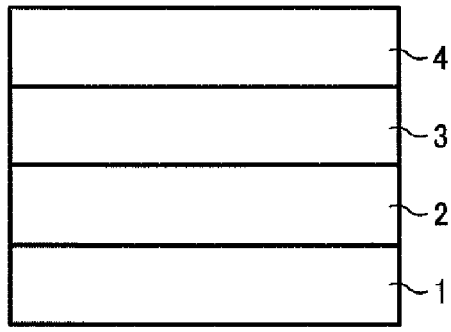
FIGS. 1 to 3 are schematic views illustrating embodiments of the photoreceptor of the present invention.
Figure 2:
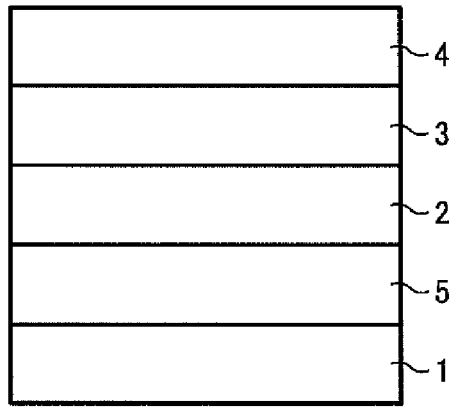
Figure 3:
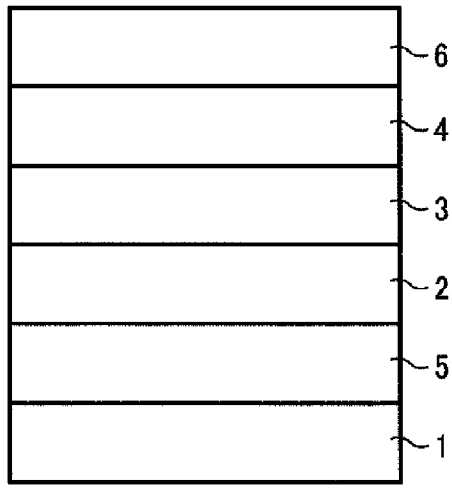

FIGS. 1 to 3 are schematic views illustrating embodiments of the photoreceptor of the present invention. A photoreceptor illustrated in FIG. 1 includes, in order from the bottom thereof, a conductive substrate 1, an undercoat layer 2 including multiple inorganic pigments each having different particle diameters and a resin, a charge generation layer 3 including a titanyl phthalocyanine pigment having a specific crystal form, and a charge transport layer 4 including a distyryl compound as a charge transport material. As illustrated in FIG. 2, an intermediate layer 5 may be provided between the conductive substrate 1 and the undercoat layer 2. Alternatively, as illustrated in FIG. 3, a protective layer 6 may be further provided on the charge transport layer 4.

(Charge Generation Layer)

The charge generation layer includes a titanyl phthalocyanine pigment having a specific crystal form. The inventors of the present invention optimize the amount of the titanyl phthalocyanine pigment in the charge generation layer, the average particle diameter of the titanyl phthalocyanine pigment, a method of synthesizing such a titanyl phthalocyanine pigment, and a method of dispersing such a titanyl phthalocyanine pigment, so that high sensitivity and stable charge properties and optical attenuation properties are provided.

To maintain dispersion stability and crystal stability of pigments in the charge generation layer, the amount of the pigments in the charge generation layer is preferably as small as possible. On the other hand, binder resins may disadvantageously provide charge trapping sites or prevent charge injection from the charge generation layer into the charge transport layer, the conductive substrate, and the undercoat layer. As a result, generated charges may be rebounded, possibly decreasing quantum efficiency. For this reason, the charge generation layer preferably includes pigments in an amount as large as possible and binder resins in an amount as small as possible from the viewpoint of electric properties. In the present invention, the charge generation includes a titanyl phthalocyanine pigment in an amount of from 70 to 85% by weight, and preferably from 80 to 85% by weight.

When the titanyl phthalocyanine pigment is used in combination with a distyryl compound as a charge transport material which has a similar energy level to the titanyl phthalocyanine pigment, there has been a problem in which the photoreceptor is not charged sufficiently at the first rotation. This is because free carriers generated due to local electric field produced by charges accumulated with time are released at the time an electric field is applied to the photoreceptor at the first rotation, thereby neutralizing charges on the surface of the photoreceptor. In the above case in which the titanyl phthalocyanine pigment is used in combination with a distyryl compound having a similar energy level, charge injection is smoothly performed between the charge generation layer and the charge transport layer. Therefore, the free carries are easily released.

To solve the above-described problem, the charge generation layer according to the present invention includes a specific amount of a titanyl phthalocyanine pigment so that accumulation of charges in the charge generation layer and charge decrease in the first rotation are suppressed. In addition, not only adjusting the amount of the titanyl phthalocyanine pigment but also adjusting the amount of inorganic pigments in the undercoat layer and the diameters of the titanyl phthalocyanine pigment and the inorganic pigments, charge transport ability from the charge generation layer to the conductive substrate is drastically improved. Accordingly, the photoreceptor of the present invention is prevented from insufficiently charging at the first rotation.

To include a specific amount of a titanyl phthalocyanine pigment in the charge generation layer, the average particle diameter of the titanyl phthalocyanine pigment, kinds of binder resin to be used in the charge generation layer, and methods of dispersing the titanyl phthalocyanine pigment may be controlled. It is generally difficult to mechanically dispersing primary particles of pigments into much smaller particles, which needs excessive energy as well. Accordingly, primary particles are the smallest form in general. In a case in which secondary particles become relatively large even if primary particles are relatively small, high sensitivity cannot be achieved. The smaller the primary particle diameter, the higher the sensitivity. However, it is difficult to disperse pigments into primary particles, and even if that is achieved, a certain amount of binder resins is needed to keep stable dispersion of the primary particles. In a case in which primary particles are originally too large, sensitivity may deteriorate even if they are finely dispersed. According to the present invention, because of having high sensitivity, titanyl phthalocyanine pigments need not to have a smaller particle diameter when are used in combination with charge transport materials having high charge transportability. Even in a case in which the amount of such phthalocyanine pigments in the charge generation layer is large, high sensitivity can be provided if the average particle diameter of the phthalocyanine pigments is controlled appropriately.

Exemplary methods of synthesizing titanyl phthalocyanine pigments having a specific crystal form for use in the present invention are described below.

First, methods of synthesizing crude products of phthalocyanine pigments are described below. Methods of synthesizing phthalocyanines are known since a long time ago and described in "Phthalocyanine Compounds; Frank H. Moser A L, CRC PRESS, 1963, p. 1-13" and "The Phthalocyanines; Frank H. Moser A L, REINHOLD PUBLISHING CORPORATION, 1983, p. 29-52" and JP-A 06-293769, the contents of each of which are incorporated herein by reference, for example. A first method includes heating a mixture of a phthalic anhydride, a metal or a metal halide, and urea in the presence or absence of a solvent having a high boiling point, optionally together with a catalyst such as ammonium molybdate. A second method includes heating a phthalonitrile and a metal halide in the presence or absence of a solvent having a high boiling point. The second method can produce phthalocyanines which cannot be produced by the first method such as aluminum phthalocyanines, indium phthalocyanines, oxovanadium phthalocyanines, oxotitanium phthalocyanines, and zirconium phthalocyanines. A third method includes reacting phthalic anhydride or a phthalonitrile with an ammonia to produce an intermediate such as 1,3-diiminoisoindoline, and reacting it with a metal halide in a solvent having a high boiling point. A forth method includes reacting a phthalonitrile with a metal alkoxide. Among these methods, the forth method is preferable because benzene rings are not halogenated.

Next, methods of synthesizing amorphous titanyl phthalocyanine pigments (low-crystallinity phthalocyanine pigments) are described below. An exemplary method includes dissolving a phthalocyanine in sulfuric acid, diluting the solution with water, and redepositing the phthalocyanine. Such a method is so-called an acid paste method or an acid slurry method. More specifically, for example, a crude product of a titanyl phthalocyanine, as synthesized above, is dissolved in 10 to 50 times that of concentrated sulfuric acid. After removing insoluble components by filtration if needed, the solution is gradually poured into 10 to 50 times that of cold water or ice water so that titanyl phthalocyanine is redeposited. After filtering the mixture, the redeposited titanyl phthalocyanine is repeatedly washed and filtered with ion-exchange water until the filtrate becomes neutral. Finally, the redeposited titanyl phthalocyanine is washed with pure ion-exchange water and subsequently filtered, so that a water paste including solid components in an amount of from 5 to 15% by weight is prepared. It should be noted that the redeposited titanyl phthalocyanine would be sufficiently washed with ion-exchange water so that concentrated sulfuric acid remains as slightly as possible. The amount of remaining sulfuric acid can be quantitatively indicated by pH or specific conductance of the ion-exchange water used for washing. The ion-exchange water used for washing preferably has a pH of from 6 to 8, within which the remaining sulfuric acid does not affect photosensitive properties. The pH can be easily measured using a commercially available pH meter. Alternatively, the ion-exchange water used for washing preferably has a specific conductance of 8 μS/cm or less, more preferably 5 μS/cm or less, and much more preferably 3 μS/cm or less, within which the remaining sulfuric acid does not affect photosensitive properties. The specific conductance can be easily measured using a commercially available electric conductometer. The lower limit of the specific conductance is equal to the specific conductance of ion-exchange water to be used for washing.

Beyond the above-described range, the amount of remaining sulfuric acid is so large that chargeability and photosensitivity of the resultant photoreceptor may deteriorate. Amorphous titanyl phthalocyanine pigments (low-crystalline titanyl phthalocyanine pigments) described above are preferably used for the present invention. Such amorphous titanyl phthalocyanine pigments (low-crystalline titanyl phthalocyanine pigments) preferably have a maximum diffraction peak at a Bragg angle 2θ (±0.2°) of from 7.0° to 7.5° with respect to a characteristic X-ray specific to CuKα having a wavelength of 1.542 Å. The half bandwidth of the diffraction peak is preferably 10 or more.

Further, the average particle diameter of primary particles thereof is preferably 0.1 μm or less.

Next, crystal conversion is described below. The crystal conversion here refers to a process in which the above-prepared amorphous titanyl phthalocyanine pigment (low-crystalline titanyl phthalocyanine pigment) is converted into a titanyl phthalocyanine crystal having a maximum diffraction peak at a Bragg angle 2θ (±0.2°) of 27.2° with respect to a characteristic X-ray specific to CuKα having a wavelength of 1.542 Å. Specifically, an amorphous titanyl phthalocyanine pigment (low-crystalline titanyl phthalocyanine pigment) prepared above is mixed and agitated with an organic solvent in the presence of water without being dried so that the crystal form described above is obtained. Specific examples of suitable organic solvents for the crystal conversion include, but are not limited to, tetrahydrofuran, toluene, methylene chloride, carbon disulfide, o-dichlorobenzene, and 1,1,2-trichloroethane. These organic solvents are preferably used alone, but can be used in combination with 1 or more of them or other solvents. The suitable amount of the organic solvents used for the crystal conversion is preferably 10 times or more, and more preferably 30 times or more the weight of an amorphous titanyl phthalocyanine pigment (low-crystalline titanyl phthalocyanine pigment). In this case, the crystal conversion promptly occurs and impurities included in the amorphous titanyl phthalocyanine pigment (low-crystalline titanyl phthalocyanine pigment) are sufficiently removed. As described above, the amorphous titanyl phthalocyanine pigment (low-crystalline titanyl phthalocyanine pigment) may be prepared by an acid paste method. Accordingly, sulfuric acid would be sufficiently removed therefrom. If the crystal conversion is performed in the presence of remaining sulfuric acid, sulfate ions may remain in the resultant crystal. The remaining sulfate ions cannot be completely removed even if the crystal is washed with water, and degrades sensitivity and chargeability of the resultant photoreceptor. Such a crystal containing remaining sulfuric acid may have an X-ray diffraction spectrum similar to that of the titanyl phthalocyanine pigment according to the present invention, however, sulfate ions in a high concentration may deteriorate photosensitivity thereof.

In the charge generation layer according to the present invention, the titanyl phthalocyanine pigment preferably has a particle diameter of from 0.15 to 0.3 μm. When the particle diameter is too large, sensitivity may be insufficient and background fouling may occur. When the particle diameter is too small, specific surface area of the pigment is large, and therefore the ratio of binder resins in the charge generation layer may be increased. As a result, dispersion stability and crystal stability may deteriorate.

One possible method for controlling the primary particle diameter of titanyl phthalocyanine pigments includes controlling the time of crystal conversion. The above-described amorphous titanyl phthalocyanine pigment (low-crystalline titanyl phthalocyanine pigment) has a primary particle diameter of 0.1 μm or less. It is known that crystal conversion and crystal growth occur simultaneously, as described in JP-A 2005-148725, the contents of which are incorporated herein by reference. Typically, the time of crystal conversion is set as long as possible so that raw materials do not remain and crystal conversion is completely performed. As a consequence, the resultant crystal has a large particle diameter (e.g., greater than 0.5 μm) even if raw materials have an extremely small primary particle diameter. It may be possible to pulverize such a large crystal into fine particles smaller than primary particles thereof by application of a large shear. However, the crystal form may also be changed, thereby degrading sensitivity of the resultant photoreceptor. Accordingly, it is preferable that the primary particle diameter of titanyl phthalocyanine pigments is controlled during the process of synthesis thereof. Specifically, termination of crystal conversion would be determined within a range in which crystal growth hardly occurs, in other words, within a range in which an amorphous titanyl phthalocyanine pigment has a particle diameter of from 0.15 to 0.3 μm even after the crystal conversion. The particle diameter of the crystal-converted pigment increases in proportion to the time of crystal conversion. Accordingly, it is preferable that the time of crystal conversion is set as short as possible and the particle diameter is controlled in a subsequent crystal growth process.

To shorten the time of crystal conversion, organic solvents used for the crystal conversion may be selected appropriately so that the efficiency of crystal conversion is improved. Alternatively, organic solvents and water pastes of titanyl phthalocyanines (amorphous titanyl phthalocyanines prepared as above) may be strongly agitated so that they are brought into intimate contact with each other. The agitation is preferably performed using a strong stirrer equipped with a propeller or a strong agitator (disperser) such as homogenizers and homomixers so that crystal conversion is terminated in a short time. In addition, the amount of organic solvents may be optimized appropriately. In particular, a suitable amount of organic solvents is 10 times or more, preferably 30 times or more of solid components of amorphous titanyl phthalocyanines. In this case, crystal conversion is reliably performed and impurities in amorphous titanyl phthalocyanines are completely removed therefrom. Further, one possible method for preparing a titanyl phthalocyanine pigment having a desired primary particle diameter includes immediately terminating crystal growth by adding a large amount of a solvent which hardly causes crystal conversion. Specific examples of such solvents which hardly cause crystal conversion include alcohols and esters. The crystal conversion may terminate when such a solvent in an amount of 10 times of the crystal conversion solvent is added. Thus, a desired primary particle diameter is obtained. The primary particle diameter of titanyl phthalocyanine pigments can be measured by observing dispersions thereof using an electron microscope.

The titanyl phthalocyanine pigment thus crystal-converted is then immediately separated from the crystal conversion solvent by filtration. The filtration is performed using a filter having an appropriate pore size, optionally under reduced pressures. The separated titanyl phthalocyanine pigment may be heated to dry, if needed. The drying is performed using any known drier, preferably a blower drier. Drying under reduced pressures is also preferable for speedup, which is suitable for materials which may decompose or convert their crystal form at high temperatures. Specifically, drying under a degree of vacuum of 10 mmHg or more is preferable.

Specific examples of suitable binder resins for the charge generation layer include, but are not limited to, polyamide, polyurethane, epoxy resins, polyketone, polycarbonate, silicone resins, acrylic resins, polyvinyl acetal, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamide, polyvinyl pyridine, cellulose resins, casein, polyvinyl alcohols, and polyvinyl pyrrolidone. Specifically, polyvinyl acetal resins having the following formula (3) are preferable:

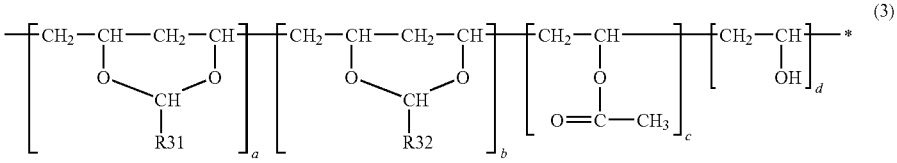

(3)

wherein each of R31 and R32 independently represents an alkyl group having 1 to 5 carbon atoms; and a, b, c, and d are numeric values satisfying the following equations: $0.06 \leqq a+b \leqq 0.80$, $0 \leqq c \leqq 0.06$, and $0.20 \leqq d \leqq 0.40$.

The number of hydroxyl groups in the resin has an effect on dispersibility, and d in the formula (3) is preferably 0.30 or more. There is a limitation in increasing the number of hydroxyl group in the process of its synthesis, and d is typically 0.40 or less. The molecular weight of the resin also has an effect on dispersibility. When the molecular weight is too small, viscosity may decreases and dispersion stability may deteriorate. Accordingly, the polyvinyl acetal resins preferably have a molecular weight of from 40,000 to 130,000, and more preferably from 60,000 to 130,000.

The charge generation layer is formed by using a charge generation layer coating liquid. Titanyl phthalocyanine pigments as prepared above are typically in form of aggregations. Such aggregations are preferably dispersed using a ball mill, a bead mill, an attritor, a sand mill, and an ultrasonic disperser. From the viewpoint of dispersibility and crystal stability, beads mills are preferable for the dispersion. When too much load is applied to pigments when being dispersed, there is a concern that the crystal form will be converted. To obtain a titanyl phthalocyanine pigment having a particle diameter suitable for the present invention, the diameter of dispersing media is preferably as small as possible. From this viewpoint as well, beads mills are preferable for the dispersion. The diameter of dispersing media is preferably from 0.3 to 1.0 mm. When the diameter is too small, dispersion efficiency may deteriorate. Suitable dispersing media preferably made of zirconia, alumina, etc. Because of having abrasion resistance, zirconia is preferable because if dispersion media are easy to be abraded, impurities (i.e., fragments of dispersion media) may be immixed into a charge generation layer coating liquid, possibly degrading sensitivity of the resultant photoreceptor. Binder resins may be added either before or after a titanyl phthalocyanine pigment is dispersed. From the viewpoint of crystal stability, preferably, binder resins may be added before a titanyl phthalocyanine pigment is dispersed.

Specific examples of suitable solvents for the charge generation layer coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferable. These solvents can be used alone or in combination.

The dispersion state can be determined by checking the particle diameter of pigments. The particle diameter of pigments may be measured using an electron microscope or a laser microscope. Alternatively, dispersions of pigments may be subjected to a measurement of particle diameter distribution using a particle diameter analyzer using gravitational and centrifugal acceleration CAPA-700 from Horiba, Ltd., for example. The average particle diameter measured by such an instrument is a volume average particle diameter which is calculated as a median diameter corresponding to 50% of a cumulative distribution. There may be a case in which such an instrument cannot detect coarse particles having a diameter of about 1.0 μm or more, however, preferable particle diameters of from 0.15 to 0.30 μm of the present invention can be detected. When a dispersion is directly observed using a microscope, diameters of particles, of course including coarse particles, may be correctly measured. It is confirmed that the average particle diameter measured using a particle diameter analyzer using gravitational and centrifugal acceleration nearly correlates to a real particle diameter of pigments in dispersions or charge generation layers. Accordingly, a particle diameter analyzer using gravitational and centrifugal acceleration is preferably used for determining dispersion stability of dispersions.

In view of stable image formation, charge generation layer coating liquids preferably do not include coarse particles of pigments. If coarse particles are included, background fouling may occur. It is difficult to prepare a dispersion containing no coarse particle by the above-described method because an extremely large amount of energy is required. Further, manufacture efficiency also decreases because a limited amount of a dispersion can be treated in one cycle. In such a case, coarse particles may be removed from a dispersion by filtration. Coarse particles in the charge generation layer cause image defects, as described above, but the effective size thereof depends on image forming process and layer composition of photoreceptor. Accordingly, the pore size of filters may be appropriately selected. However, if the pore size is too small, filtration efficiency may deteriorate. The charge generation layer coating liquid according to the present invention is preferably filtered using a filter having a pore size of from 0.5 to 3.0 μm, and the filtration is preferably performed under reduced pressures to improve efficiency.

(Charge Transport Layer)

In the present invention, the charge transport layer includes a distyryl compound having the formula (1) as a charge transport material:

(1)

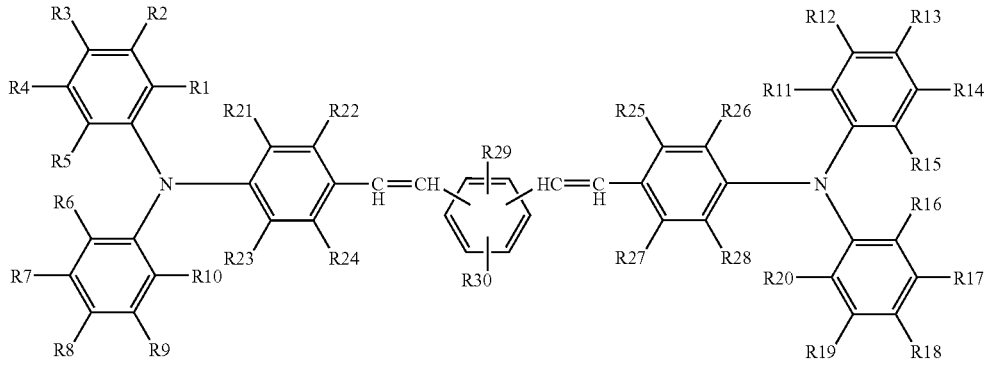

wherein each of R1 to R30 independently represents a hydrogen atom, an alkyl group having 1 to 3 carbon atoms, an alkoxyl group having 1 to 3 carbon atoms, an aryl group substituted with an alkyl group having 1 to 3 carbon atoms or an alkoxyl group having 1 to 3 carbon atoms, or an unsubstituted aryl group; and each of R1 and R30 may share bond connectivity with an adjacent group to form a ring.

Specific preferred examples of usable distyryl compounds are shown in the following Tables 1-1 to 1-9, but are not limited thereto.

TABLE 1-1

No. 1

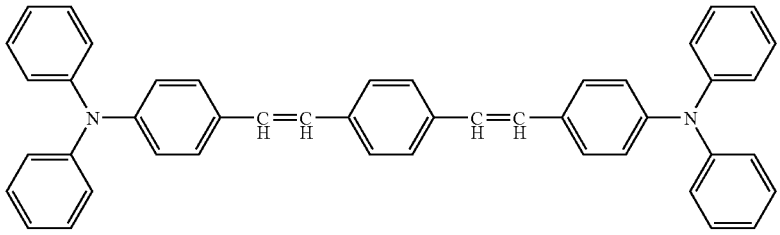

No. 2

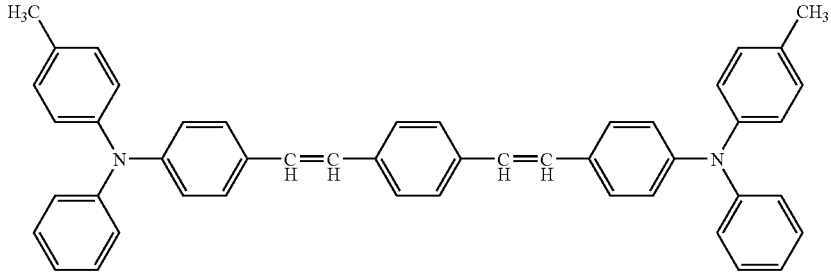

No. 3

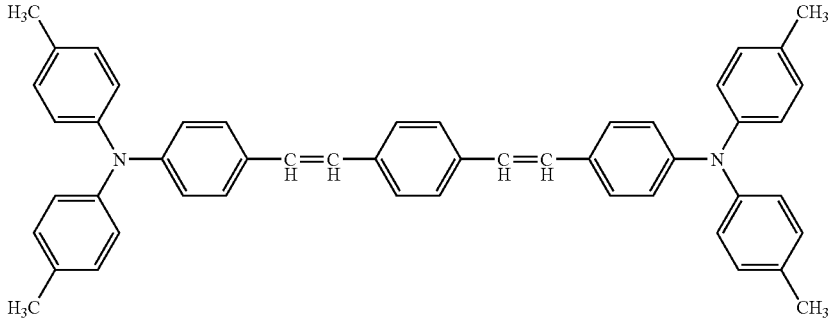

TABLE 1-1-continued
No. 4
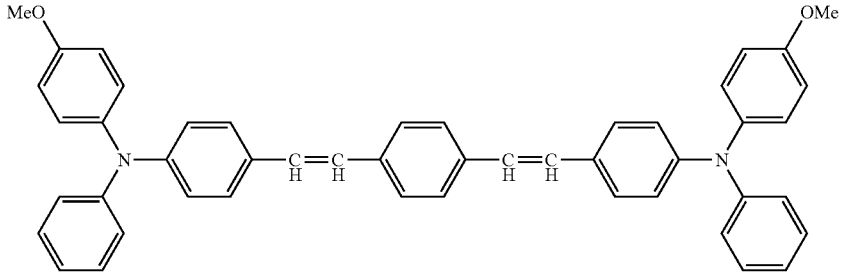
No. 5
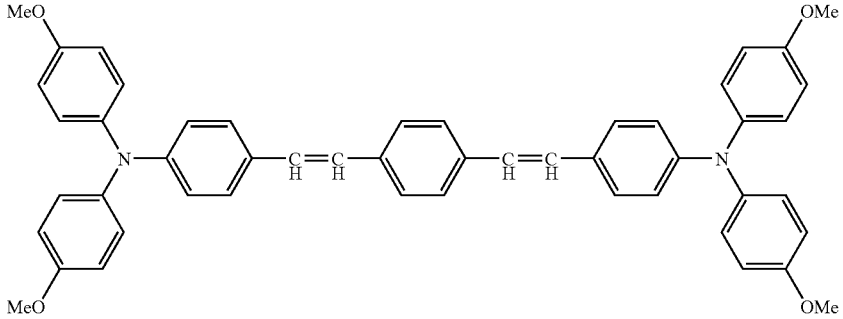
No. 6
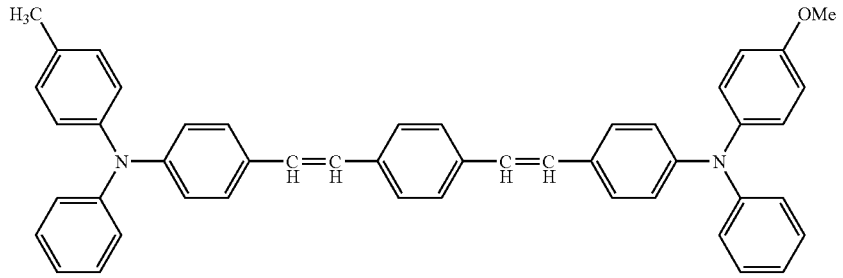
TABLE 1-2
No. 7
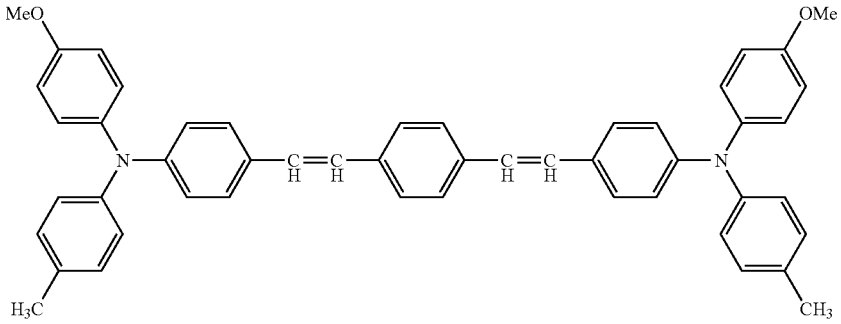
No. 8
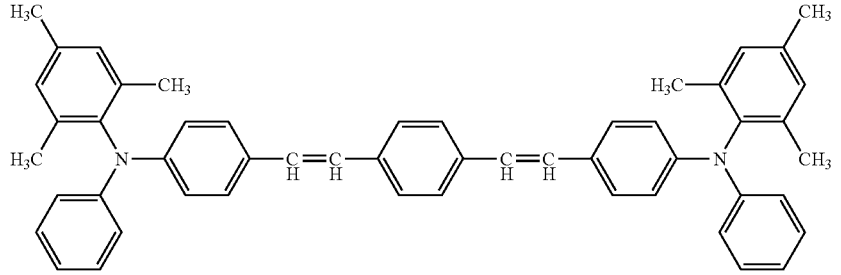

TABLE 1-2-continued
No. 9
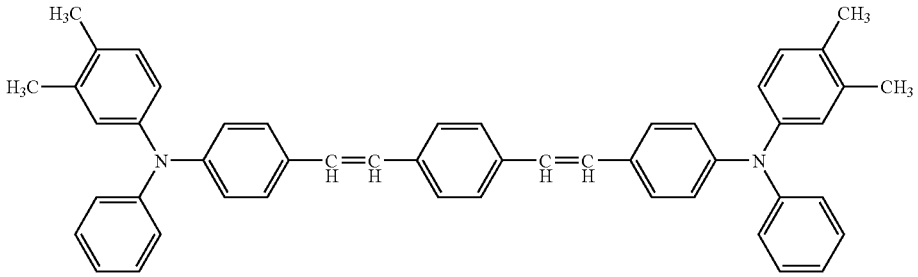
No. 10
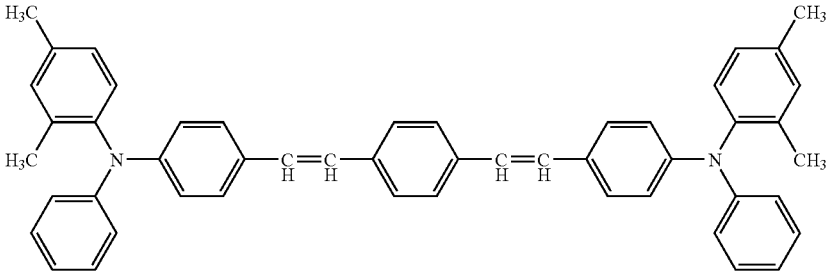
No. 11
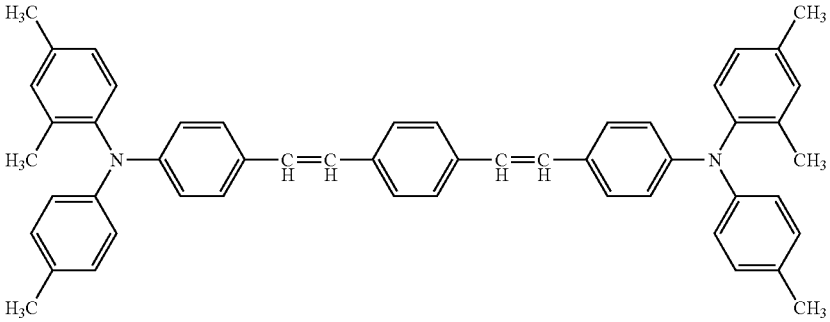
No. 12
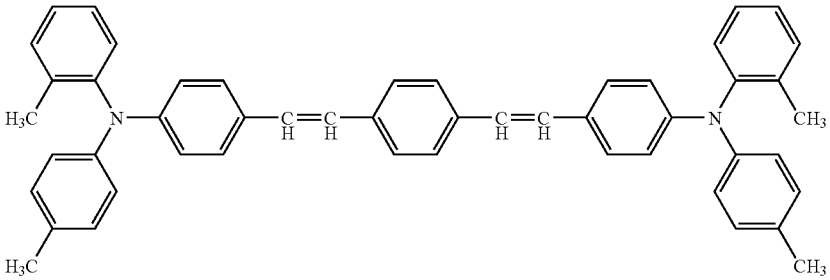
TABLE 1-3
No. 13
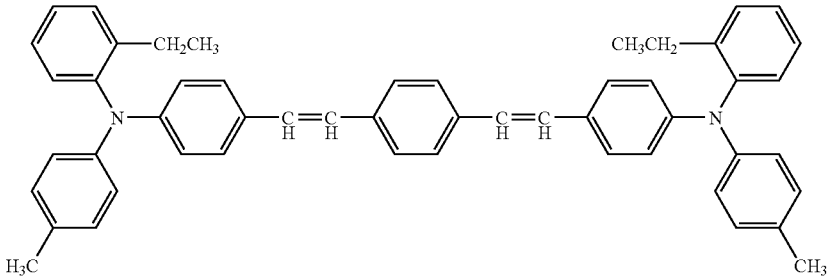

TABLE 1-3-continued
No. 14
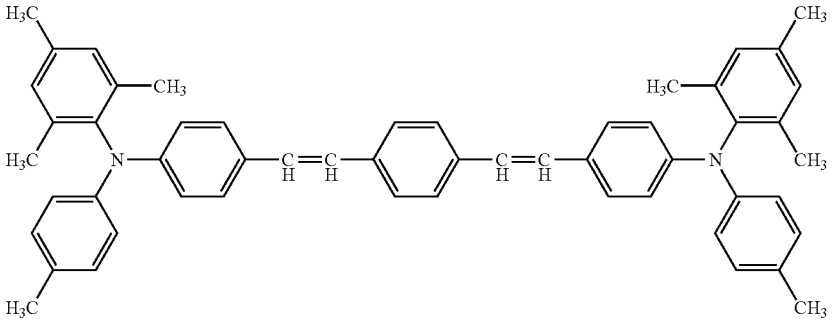
No. 15
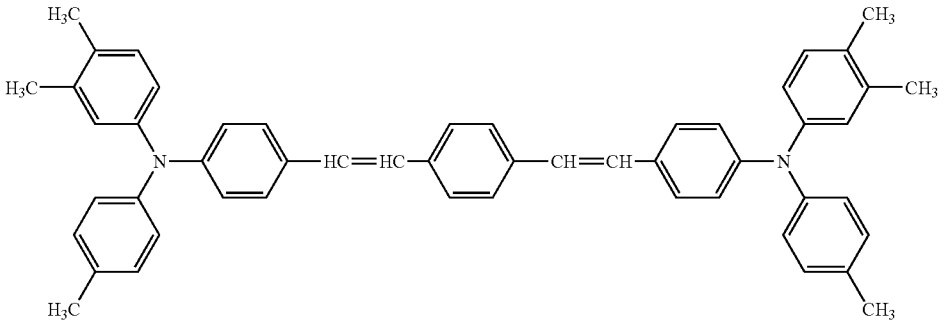
No. 16
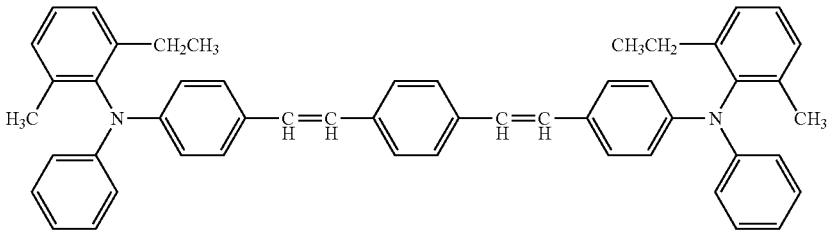
No. 17
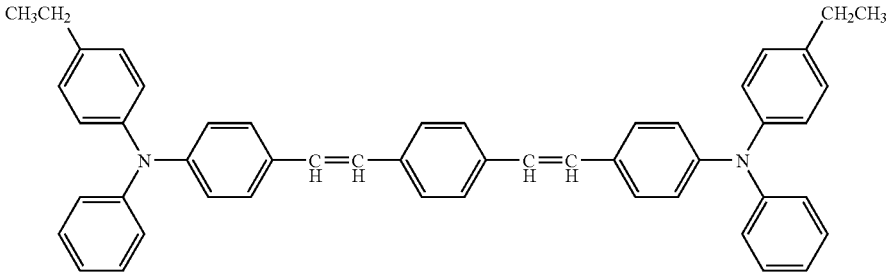
No. 18
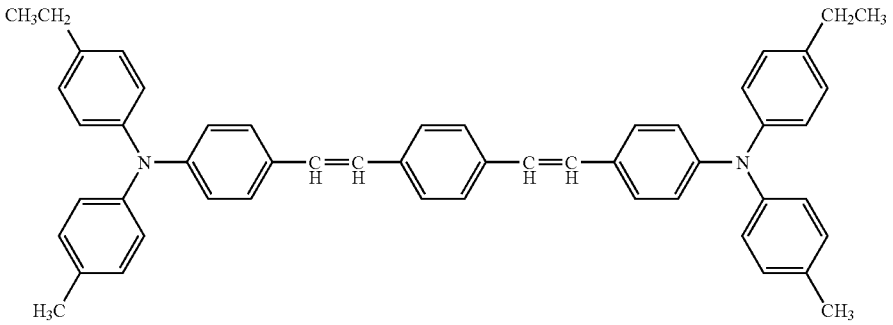

TABLE 1-4
No. 19
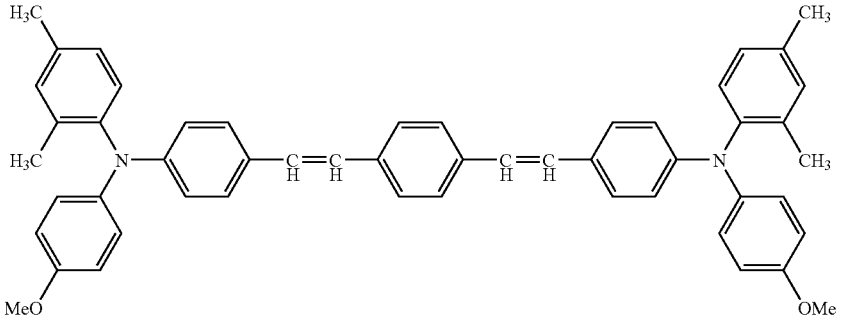
No. 20
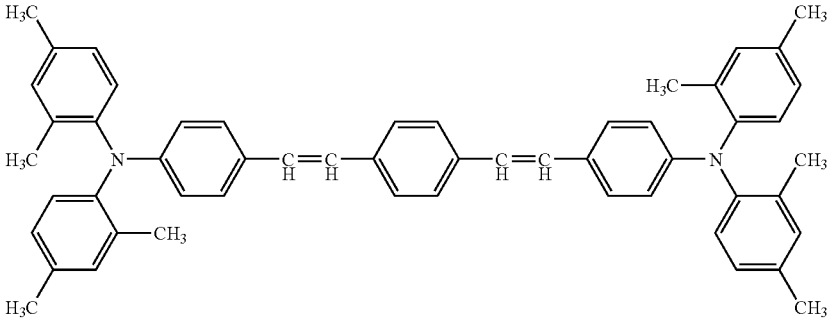
No. 21
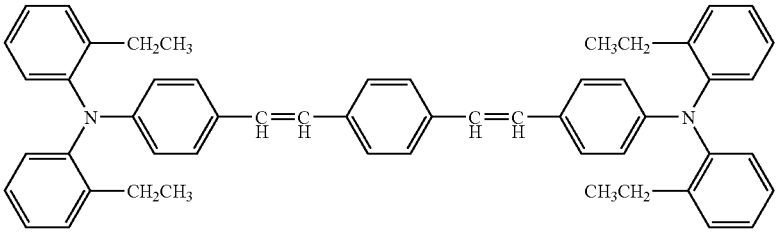
No. 22
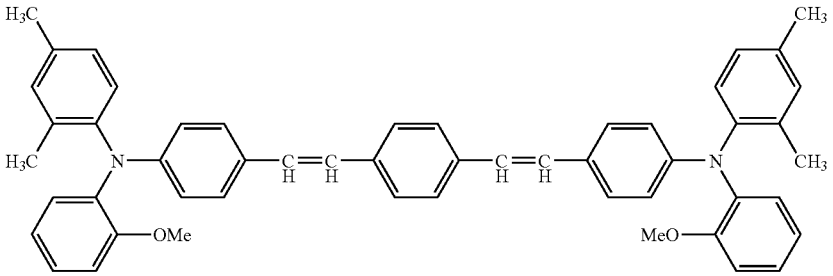
No. 23
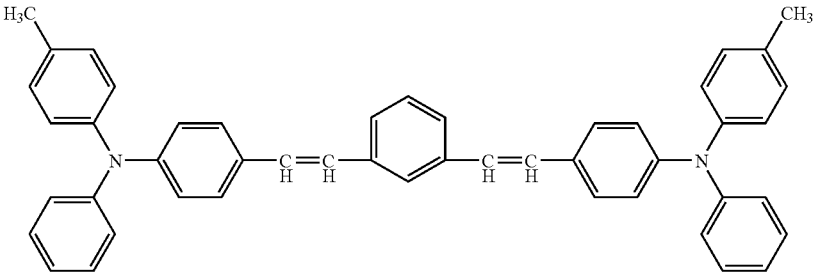

TABLE 1-4-continued
No. 24
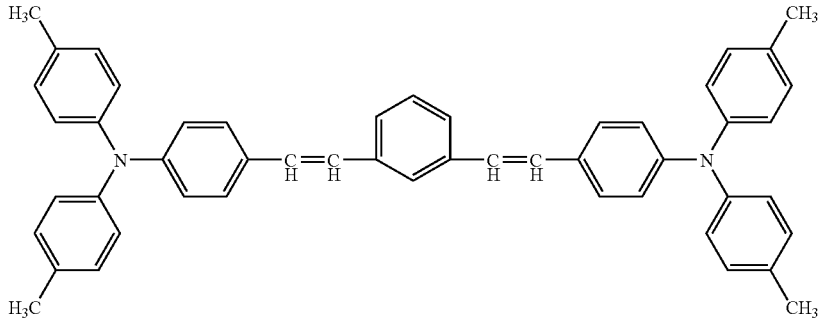
TABLE 1-5
No. 25
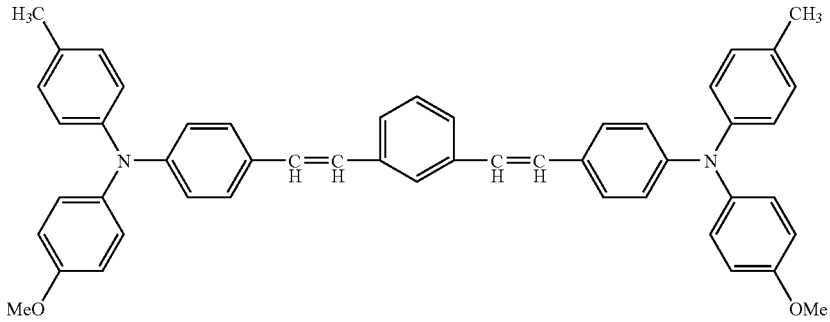
No. 26
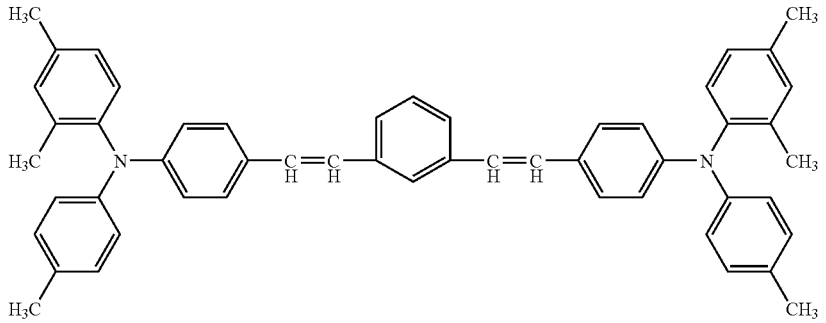
No. 27
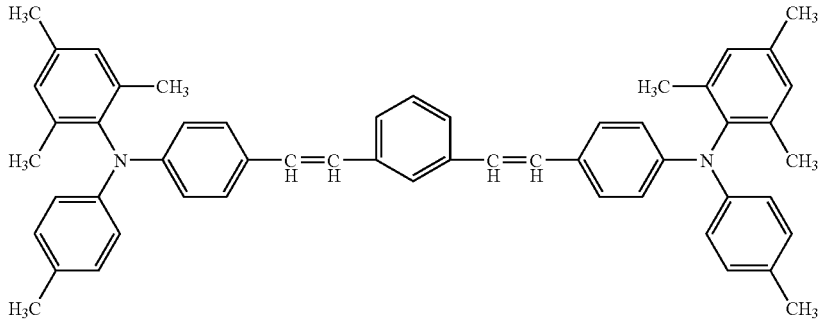

TABLE 1-5-continued
No. 28
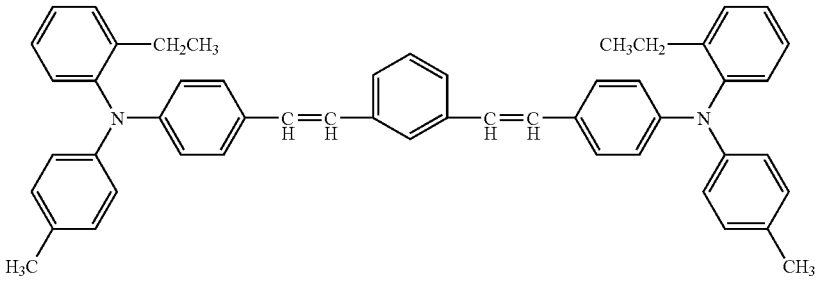
No. 29
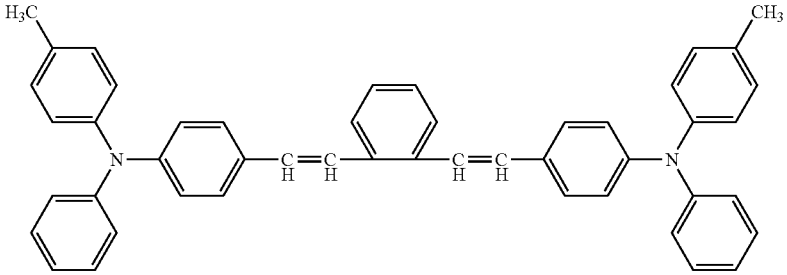
No. 30
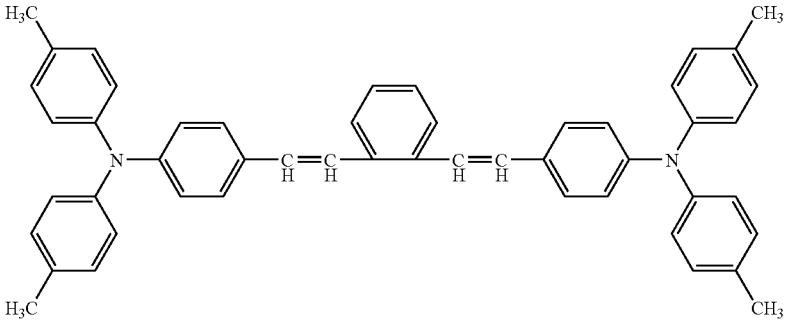
TABLE 1-6
No. 31
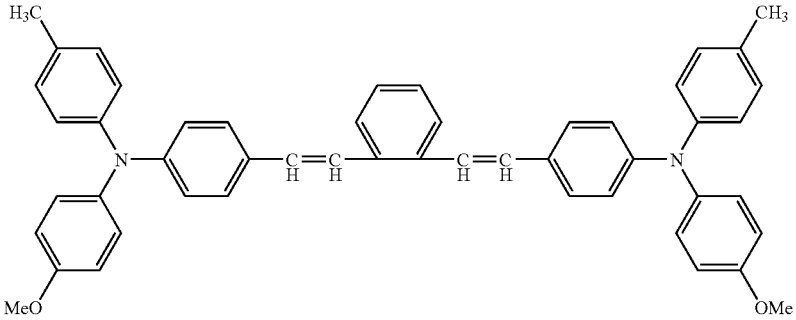
No. 32
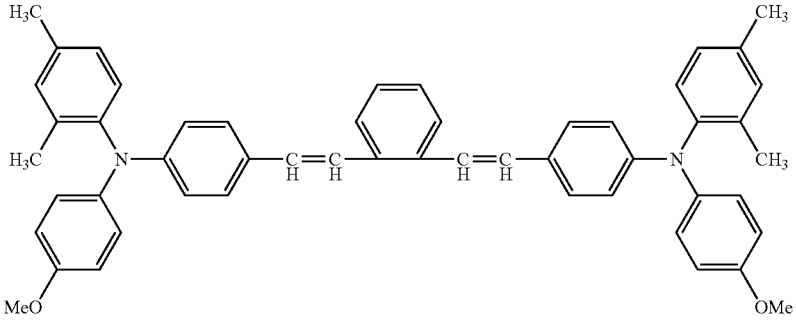

TABLE 1-6-continued
No. 33
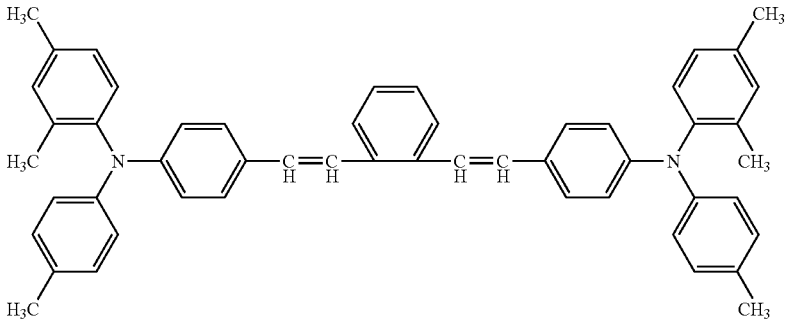
No. 34
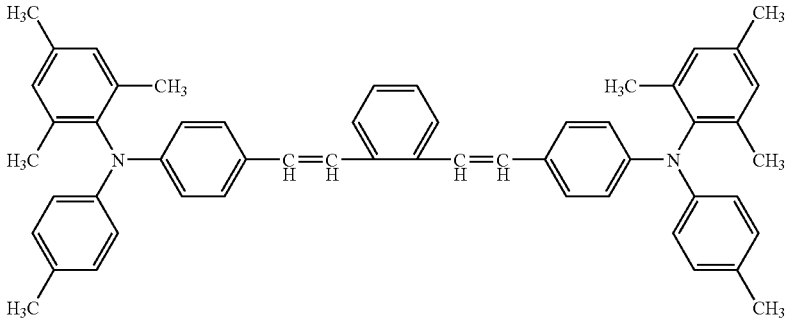
No. 35
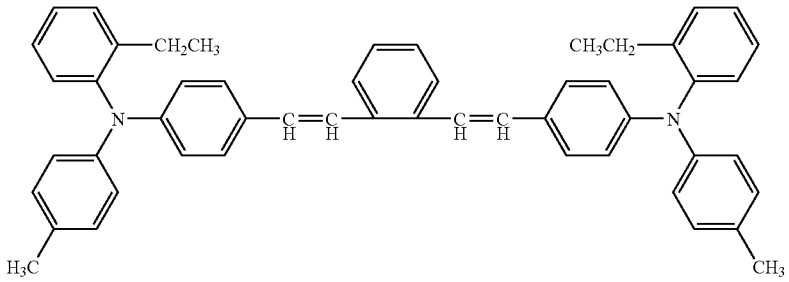
No. 36
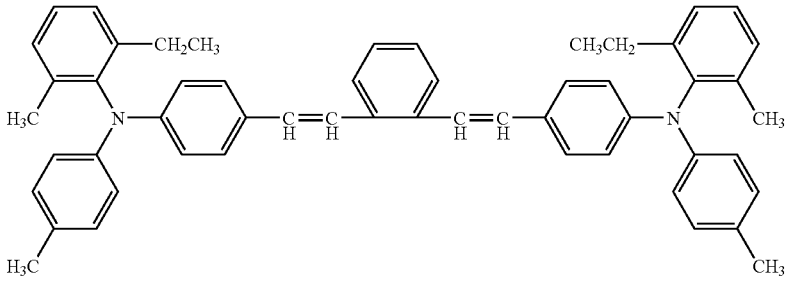

TABLE 1-7
No. 37
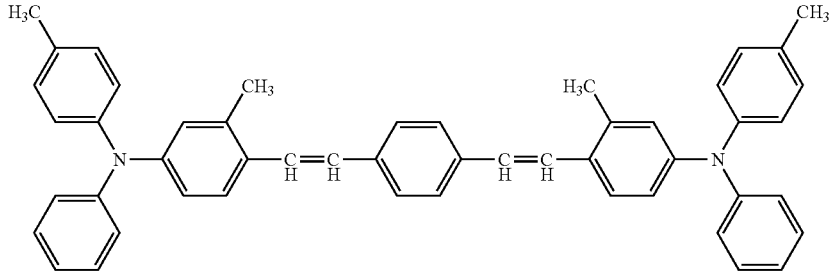
No. 38
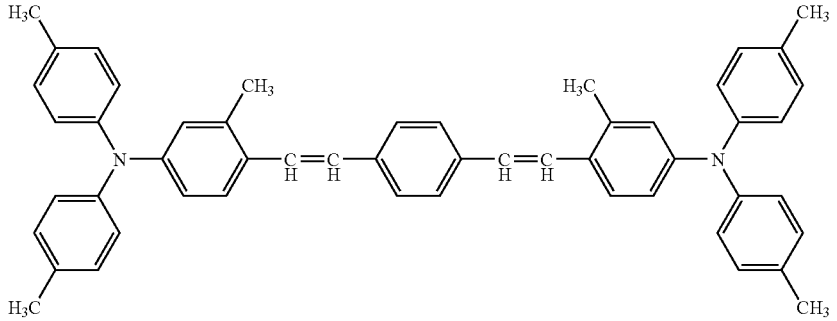
No. 39
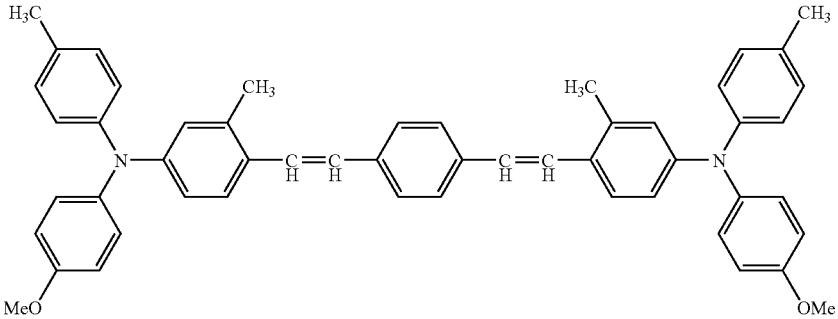
No. 40
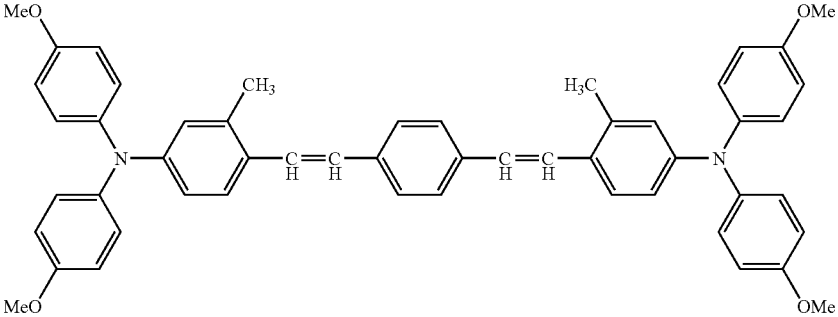
No. 41
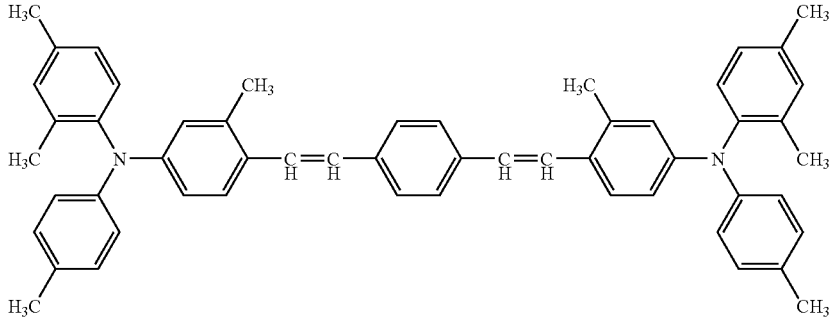

TABLE 1-7-continued
No. 42
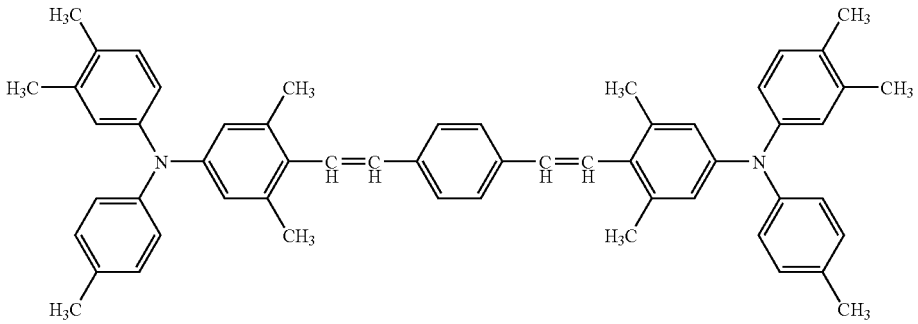
TABLE 1-8
No. 43
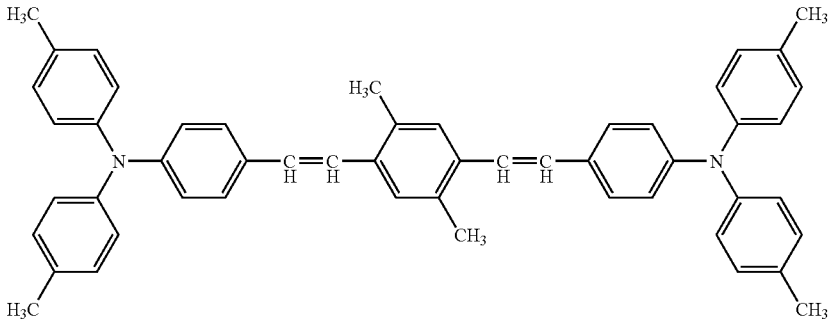
No. 44
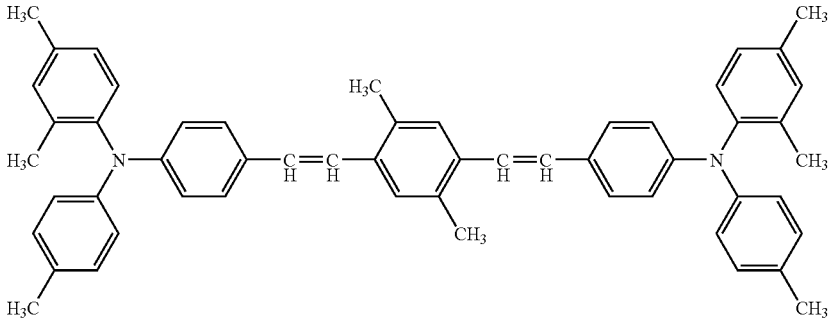
No. 45
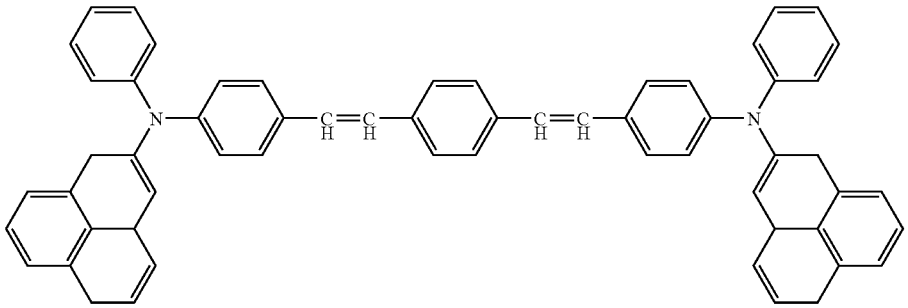

TABLE 1-8-continued
| | |
|---|---|
| No. 46 | 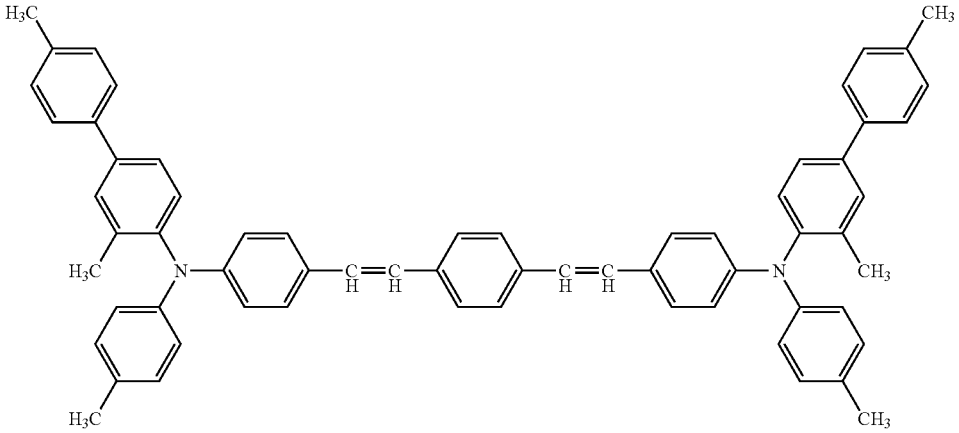 |
TABLE 1-9
| | |
|---|---|
| No. 47 | 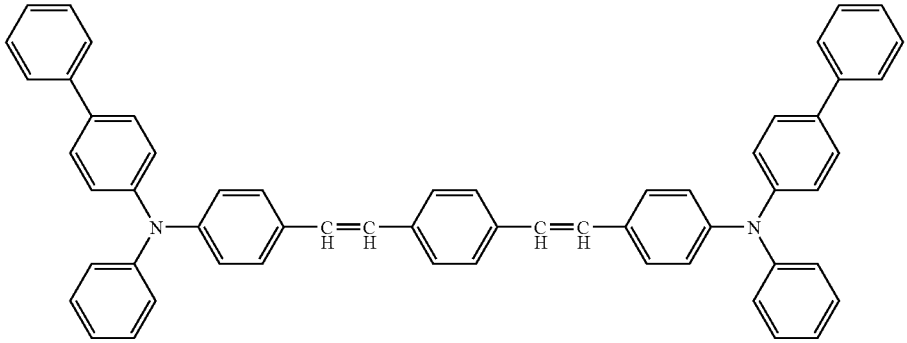 |
| No. 48 | 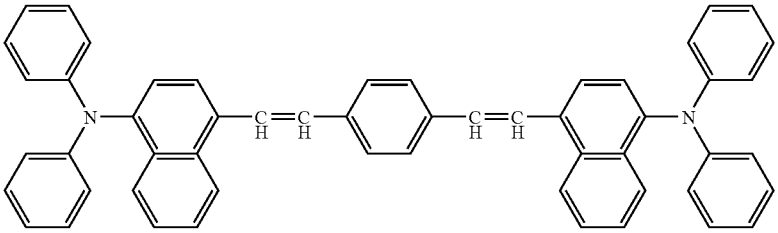 |
Suitable distyryl benzene compounds are also described in JP-A 50-16538 and JP 2552695, the contents of each of which are incorporated herein by reference.
Among various distyryl compounds, distyryl compounds having the following formula (4) are preferable:
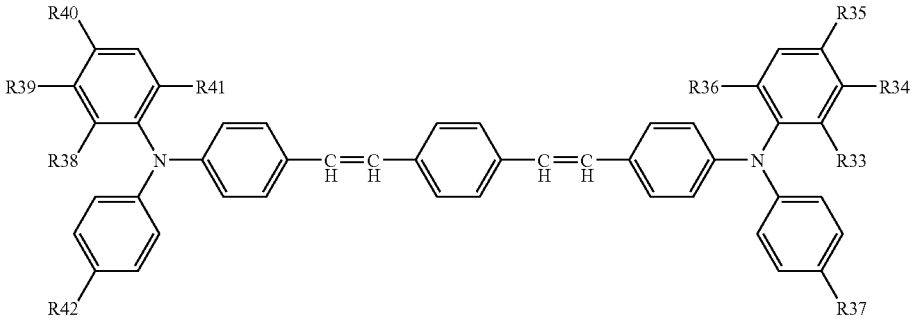
(4)

wherein each of R33 to R42 independently represents a hydrogen atom, an alkyl group having 1 to 3 carbon atoms, an alkoxyl group having 1 to 3 carbon atoms, or an aryl group which may be substituted with an alkyl group having 1 to 3 carbon atoms or an alkoxyl group having 1 to 3 carbon atoms.

The compounds having the formula (4) correspond to the compounds No. 1 to 19 shown in Tables 1-1 to 1-4.

Because of having a large π-conjugated system, distyryl compounds have high mobility and charge transportability. In addition, because of having two triphenylamine structures, which function as charge receiving and giving sites, distyryl compounds unlikely to cause charge trapping in the charge generation layer.

When distyryl compounds (i.e., charge transport materials) and titanyl phthalocyanine pigments (i.e., charge generation materials) are optimized in energy level, much better electrophotographic properties are provided. Specifically, the following equation is preferably satisfied:

$$-0.16 \leqq Ip(T)-Ip(G) \leqq 0.07$$

wherein Ip(T) and Ip(G) represent ionization potentials of a distyryl compound and a titanyl phthalocyanine pigment, respectively.

Ionization potential here refers to an energy amount needed for extracting one electron from a ground state.

In the present invention, the ionization potential can be measured as follows. A sample is irradiated with an ultraviolet ray that is spectroscopically dispersed by a monochromator while changing energy thereof, using an instrument PHOTOELECTRON SPECTROMETER SURFACE ANALYZER MODEL AC-1, AC-2, or AC-3 from Riken Keiki Co., Ltd., configured to emit ultraviolet ray in atmospheric pressure to measure photoelectron spectrum. A minimum energy needed for emitting photoelectron, that is, photoelectric effect, is measured and regarded as the ionization potential.

A sample is formed on a smooth surface of an aluminum plate so that a charge transport layer containing a charge transport material which is a measurement target and no other charge transport material becomes the outermost layer. Exemplary measurement conditions are as follows.

(1) Quantity of light: 100 nw
(2) Energy range of incident light: 4.0 to 6.2 eV
(3) Light quantum per unit: $1\times10^{11}$ (cps)
(4) Measurement time: 10 sec Suitable measurement instruments and conditions are not limited to the above-described instrument and conditions.

There may be a possibility that distyryl compounds with the above-described energy level are easily affected by oxidizing gases generated from chargers, resulting in deterioration of chargeability. To prevent the occurrence of such a phenomenon, additives such as antioxidants are preferably added to the charge transport layer.

Suitable additives preferably do not produce any side effect such as deterioration of sensitivity. However, side effects produced by additives, if any, are acceptable by the photoreceptor of the present invention because it has high sensitivity due to the provision of the undercoat layer and the charge generation layer. Although distyryl compounds having low ionization potential have a disadvantage in charge stability, high charge stability and high sensitivity can be provided by addition of additives.

As suitable additives, amine-based antioxidants are preferably used. A suitable amount of an amine-based antioxidant is preferably from 3 to 10 parts by weight based on 100 parts by weight of distyryl compounds. Specific examples of usable amine-based antioxidants include, but are not limited to, the following compounds:

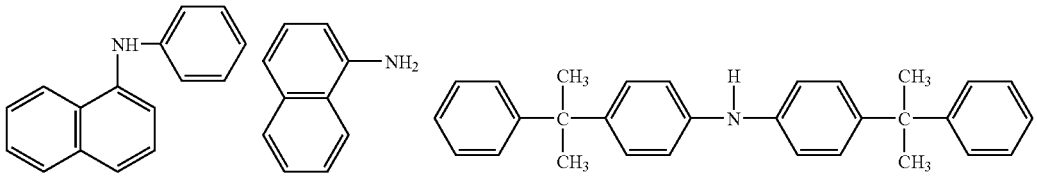

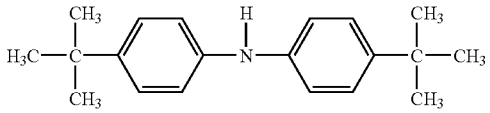

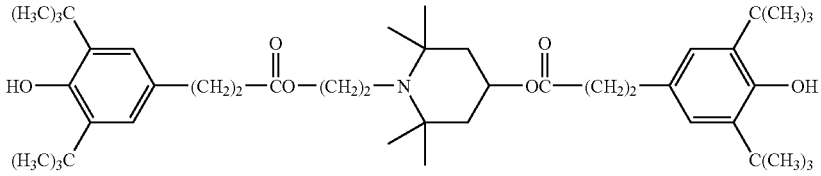

Among these compounds, the following compound (5) is most preferable.

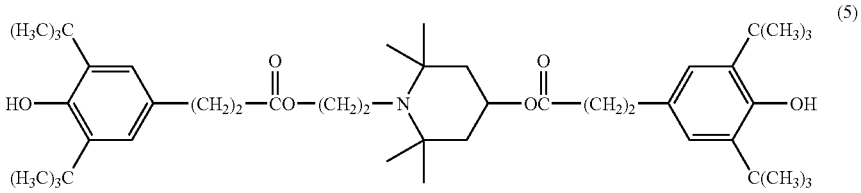

(5)

The charge transport layer may further include another charge transport material having at least one substituted or unsubstituted alkylamino group in combination with the distyryl compound. A suitable amount of such a charge transport material having at least one substituted or unsubstituted alkylamino group is preferably from 3 to 20 parts by weight based on 100 parts by weight of distyryl compounds.

Specific examples of usable compounds having at least one substituted or unsubstituted alkylamino group include, but are not limited to, the following compounds:

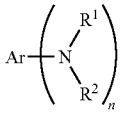

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; n represents an integer of from 1 to 4; and Ar represents a substituted or unsubstituted aromatic group;

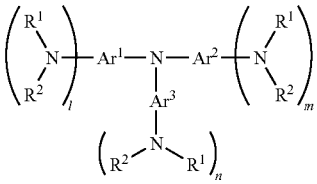

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of l, m, and n independently represents an integer of from 0 to 3 but does not simultaneously represent 0; and each of $Ar^1$, $Ar^2$, and $Ar^3$ independently represents a substituted or unsubstituted aromatic group, wherein any two of $Ar^1$, $Ar^2$, and $Ar^3$ may share bond connectivity to form a heterocyclic ring containing a nitrogen atom;

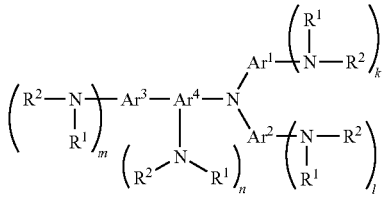

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of k, l, m, and n independently represents an integer of from 0 to 3 but does not simultaneously represent 0; and each of $Ar^1$, $Ar^2$, $Ar^3$ and $Ar^4$ independently represents a substituted or unsubstituted aromatic group, wherein $Ar^1$ may share bond connectivity with $A^2$ or $Ar^4$ to from a ring;

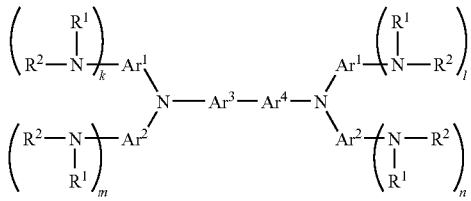

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of k, l, m, and n independently represents an integer of from 0 to 3 but does not simultaneously represent 0; and each of $Ar^1$, $Ar^2$, $Ar^3$ and $Ar^4$ independently represents a substituted or unsubstituted aromatic group, wherein $Ar^1$ may share bond connectivity with $Ar^2$ or $Ar^3$ to from a ring;

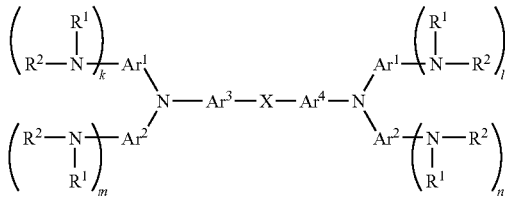

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of k, l, m, and n independently represents an integer of from 0 to 3 but does not simultaneously represent 0; each of $Ar^1$, $Ar^2$, $Ar^3$, and $Ar^4$ independently represents a substituted or unsubstituted aromatic group, wherein $A^1$ may share bond connectivity with $Ar^2$, $Ar^3$, or $Ar^4$ to from a ring; and X represents a methylene group, a cyclohexylidene group, a oxygen atom, or a sulfur atom;

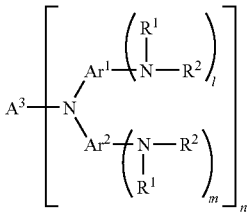

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of l and m independently represents an integer of from 0 to 3 but does not simultaneously represent 0; each of $Ar^1$, $Ar^2$, and $Ar^3$ independently represents a substituted or unsubstituted aromatic group, wherein $Ar^1$ may share bond connectivity with $Ar^2$ or $Ar^3$ to from a ring; and n represents an integer of from 1 to 4;

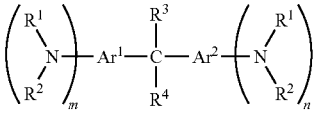

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of m and n independently represents an integer of from 0 to 3 but does not simultaneously represent 0; each of $R^3$ and $R^4$ independently represents a hydrogen atom, a substituted or unsubstituted alkyl group having 1 to 11 carbon atoms, or a substituted or unsubstituted aromatic group; each of $Ar^1$ and $Ar^2$ independently represents a substituted or unsubstituted aromatic group; and at least one of $Ar^1$, $Ar^2$, $R^3$, and $R^4$ represents an aromatic heterocyclic group;

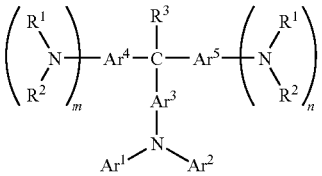

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of m and n independently represents an integer of from 0 to 3 but does not simultaneously represent 0; $R^3$ represents a hydrogen atom, a substituted or unsubstituted alkyl group having 1 to 11 carbon atoms, or a substituted or unsubstituted aromatic group; and each of $Ar^1$, $Ar^2$, $Ar^3$, $Ar^4$, and $Ar^5$ independently represents a substituted or unsubstituted aromatic group, wherein $A^1$ may share bond connectivity with $Ar^2$ or $Ar^3$ to from a heterocyclic ring containing a nitrogen atom;

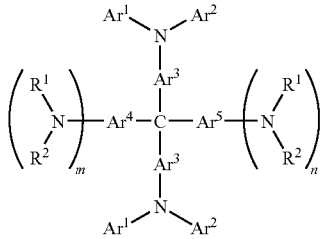

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of m and n independently represents an integer of from 0 to 3 but does not simultaneously represent 0; and each of $Ar^1$, $Ar^2$, $Ar^3$, $Ar^4$, and $Ar^5$ independently represents a substituted or unsubstituted aromatic group, wherein $A^1$ may share bond connectivity with $Ar^2$ or $Ar^3$ to from a heterocyclic ring containing a nitrogen atom;

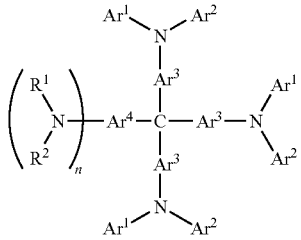

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; n represents an integer of from 1 to 3; and each of $Ar^1$, $Ar^2$, $Ar^3$ and $Ar^4$ independently represents a substituted or unsubstituted aromatic group, wherein $A^1$ may share bond connectivity with $Ar^2$ or $Ar^3$ to from a heterocyclic ring containing a nitrogen atom;

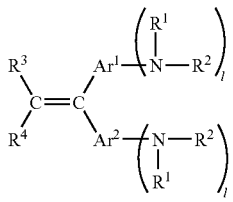

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; l represents an integer of from 1 to 3; each of $Ar^1$ and $Ar^2$ independently represents a substituted or unsubstituted aromatic group; and each of $R^3$ and $R^4$ independently represents a hydrogen atom, a substituted or unsubstituted alkyl group having 1 to 4 carbon atoms, a substituted or unsubstituted aromatic group, or the following group:

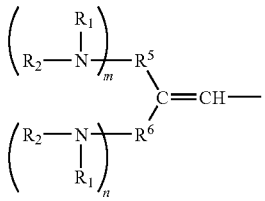

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of m and n independently represents an integer of from 0 to 3; and each of $R^5$ and $R^6$ independently represents a hydrogen atom, a substituted or unsubstituted alkyl group having 1 to 4 carbon atoms, or a substituted or unsubstituted aromatic group; wherein $R^3$ and $R^4$ may share bond connectivity to form a ring, $R^5$ and $R^6$ may share bond connectivity to form a ring, and $Ar^1$ and $Ar^2$ may share bond connectivity to form a ring;

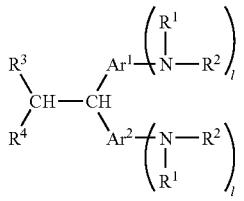

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; l represents an integer of from 1 to 3; each of $Ar^1$ and $Ar^2$ independently represents a substituted or unsubstituted aromatic group; and each of $R^3$ and $R^4$ independently represents a hydrogen atom, a substituted or unsubstituted alkyl group having 1 to 4 carbon atoms, a substituted or unsubstituted aromatic group, or the following group:

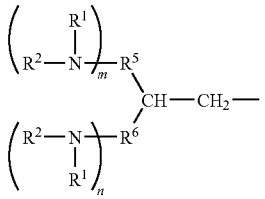

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of m and n independently represents an integer of from 0 to 3; and each of $R^5$ and $R^6$ independently represents a hydrogen atom, a substituted or unsubstituted alkyl group having 1 to 4 carbon atoms, or a substituted or unsubstituted aromatic group; wherein each of $R^3$ and $R^4$ does not simultaneously represent a hydrogen atom, $R^3$ and $R^4$ may share bond connectivity to form a ring, $R^5$ and $R^6$ may share bond connectivity to form a ring, and $Ar^1$ and $Ar^2$ may share bond connectivity to form a ring;

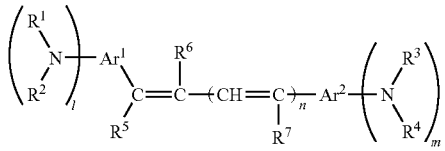

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $R^3$ and $R^4$ independently represents a substituted or unsubstituted alkyl group having 1 to 4 carbon atoms or a substituted or unsubstituted aromatic group; each of $R^5$, $R^6$ and $R^7$ independently represents a hydrogen atom, a substituted or unsubstituted alkyl group having 1 to 4 carbon atoms, or a substituted or unsubstituted aromatic group; each of $Ar^1$ and $Ar^2$ independently represents a substituted or unsubstituted aromatic group; $R^4$ may share bond connectivity with $R^3$ or $Ar^2$ to form a heterocyclic ring containing a nitrogen atom; $Ar^1$ and $R^5$ may share bond connectivity to form a ring; l represents an integer of from 1 to 3; m represents an integer of from 0 to 3; and n represents an integer of 0 or 1;

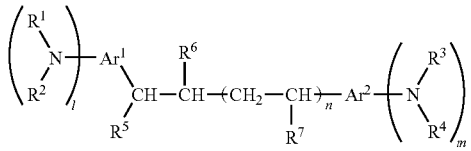

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $R^3$ and $R^4$ independently represents a substituted or unsubstituted alkyl group having 1 to 4 carbon atoms or a substituted or unsubstituted aromatic group; each of $R^5$, $R^6$ and $R^7$ independently represents a hydrogen atom, a substituted or unsubstituted alkyl group having 1 to 4 carbon atoms, or a substituted or unsubstituted aromatic group; each of $Ar^1$ and $Ar^2$ independently represents a substituted or unsubstituted aromatic group; $R^4$ may share bond connectivity with $R^3$ or $Ar^2$ to form a heterocyclic ring containing a nitrogen atom; $Ar^1$ and $R^5$ may share bond connectivity to form a ring; l represents an integer of from 1 to 3; m represents an integer of from 0 to 3; and n represents an integer of 0 or 1;

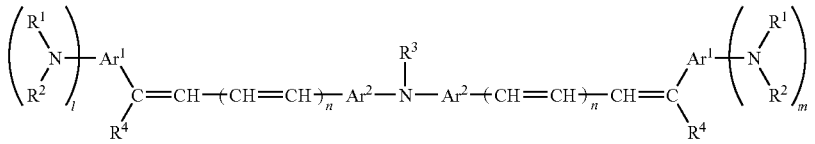

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of l and m independently represents an integer of from 0 to 3 but does not simultaneously represent 0; $R^3$ represents a substituted or unsubstituted alkyl group having 1 to 4 carbon atoms or a substituted or unsubstituted aromatic group; $R^4$ represents a hydrogen atom, a substituted or unsubstituted alkyl group having 1 to 4 carbon atoms, or a substituted or unsubstituted aromatic group; each of $Ar^1$ and $Ar^2$ independently represents a substituted or unsubstituted aromatic group; $Ar^1$ and $R^4$ may share bond connectivity to form a ring; $Ar^2$ and $R^3$ may share bond connectivity to form a ring; $Ar^2$ and $Ar^2$ may share bond connectivity to form a ring; and n represents an integer of 0 or 1;

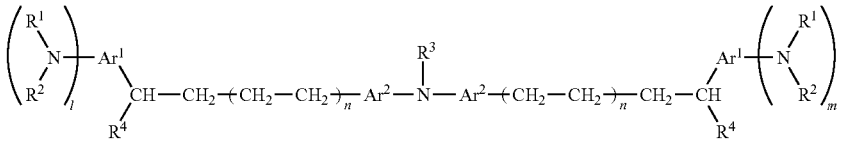

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of l and m independently represents an integer of from 0 to 3 but does not simultaneously represent 0; $R^3$ represents a substituted or unsubstituted alkyl group having 1 to 4 carbon atoms or a substituted or unsubstituted aromatic group; $R^4$ represents a hydrogen atom, a substituted or unsubstituted alkyl group having 1 to 4 carbon atoms, or a substituted or unsubstituted aromatic group; each of $Ar^1$ and $Ar^2$ independently represents a substituted or unsubstituted aromatic group; $Ar^1$ and $R^4$ may share bond connectivity to form a ring; $Ar^2$ and $R^3$ may share bond connectivity to form a ring; $Ar^2$ and $Ar^2$ may share bond connectivity to form a ring; and n represents an integer of 0 or 1;

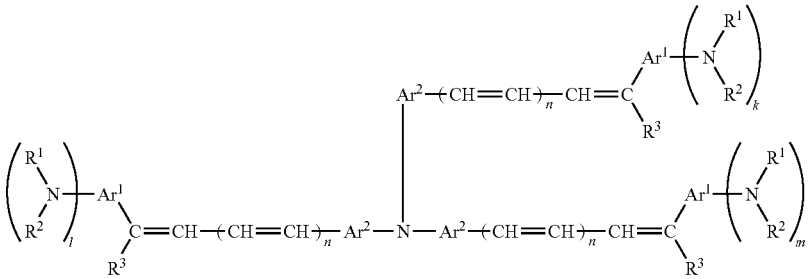

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of k, l, and m independently represents an integer of from 0 to 3 but does not simultaneously represent 0; $R^3$ represents a substituted or unsubstituted alkyl group having 1 to 4 carbon atoms or a substituted or unsubstituted aromatic group; each of $Ar^1$ and $Ar^2$ independently represents a substituted or unsubstituted aromatic group; $Ar^1$ and $R^3$ may share bond connectivity to form a ring; $Ar^2$ and $Ar^2$ may share bond connectivity to form a ring; and n represents an integer of 0 or 1;

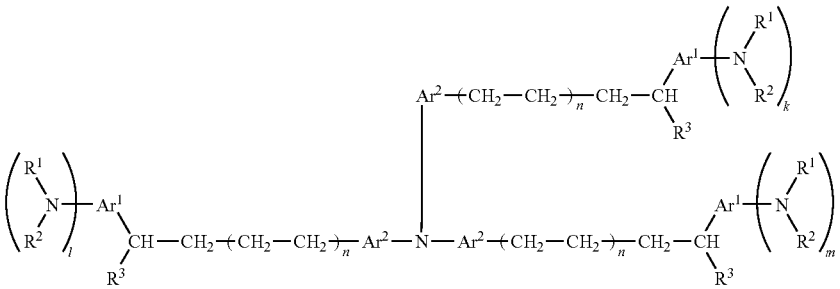

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of k, l, and m independently represents an integer of from 0 to 3 but does not simultaneously represent 0; $R^3$ represents a substituted or unsubstituted alkyl group having 1 to 4 carbon atoms or a substituted or unsubstituted aromatic group; each of $Ar^1$ and $Ar^2$ independently represents a substituted or unsubstituted aromatic group; $Ar^1$ and $R^3$ may share bond connectivity to form a ring; $Ar^2$ and $Ar^2$ may share bond connectivity to form a ring; and n represents an integer of 0 or 1;

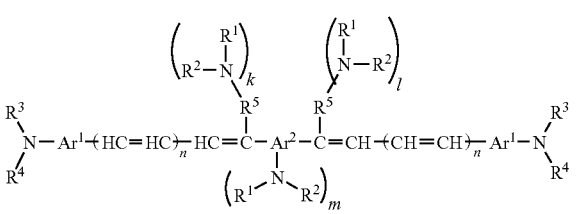

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $R^3$ and $R^4$ independently represents a substituted or unsubstituted alkyl group having 1 to 4 carbon atoms or a substituted or unsubstituted aromatic group; $R^5$ represents a hydrogen atom, a substituted or unsubstituted alkyl group having 1 to 4 carbon atoms, or a substituted or unsubstituted aromatic group; each of $Ar^1$ and $Ar^2$ independently represents a substituted or unsubstituted aromatic group; $R^4$ may share bond connectivity with $R^3$ or $Ar^1$ to form a heterocyclic ring containing a nitrogen atom; each of k, l, and m independently represents an integer of from 0 to 3; n represents an integer of 1 or 2; and when each of k, l, and m simultaneously represents 0, each of $R^3$ and $R^4$ independently represents a substituted or unsubstituted alkyl group having 1 to 4 carbon atoms, wherein $R^3$ and $R^4$ may share bond connectivity to form a heterocyclic ring containing a nitrogen atom;

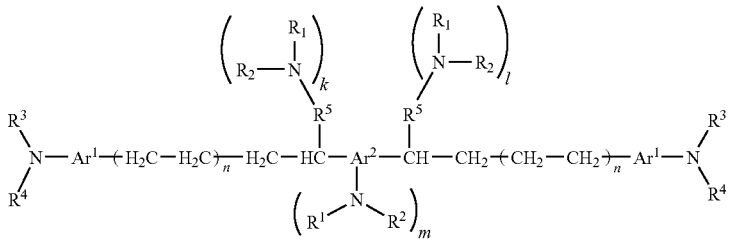

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $R^3$ and $R^4$ independently represents a substituted or unsubstituted alkyl group having 1 to 4 carbon atoms or a substituted or unsubstituted aromatic group; $R^5$ represents a hydrogen atom, a substituted or unsubstituted alkyl group having 1 to 4 carbon atoms, or a substituted or unsubstituted aromatic group; each of $Ar^1$ and $Ar^2$ independently represents a substituted or unsubstituted aromatic group; $R^4$ may share bond connectivity with $R^3$ or $Ar^1$ to form a heterocyclic ring containing a nitrogen atom; each of k, l, and m independently represents an integer of from 0 to 3; n represents an integer of 1 or 2; and when each of k, l, and m simultaneously represents 0, each of $R^3$ and $R^4$ independently represents a substituted or unsubstituted alkyl group having 1 to 4 carbon atoms, wherein $R^3$ and $R^4$ may share bond connectivity to form a heterocyclic ring containing a nitrogen atom;

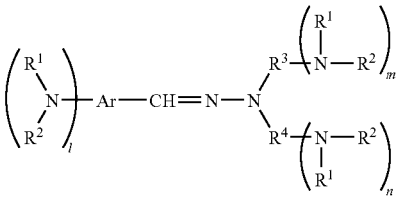

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; Ar represents a substituted or unsubstituted aromatic group; each of $R^3$ and $R^4$ independently represents a hydrogen atom, a substituted or unsubstituted alkyl group having 1 to 4 carbon atoms, or a substituted or unsubstituted aromatic group; and each of l, m, and n independently represents an integer of from 0 to 3 but does not simultaneously represent 0;

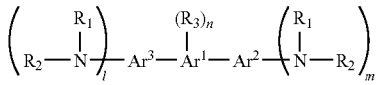

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $Ar^1$, $Ar^2$, and $Ar^3$ independently represents a substituted or unsubstituted aromatic group; $R^3$ represents a hydrogen atom, a substituted or unsubstituted alkyl group having 1 to 4 carbon atoms, or a substituted or unsubstituted aromatic group; each of l and m independently represents an integer of from 0 to 3 but does not simultaneously represent 0; and n represents an integer of from 1 to 3;

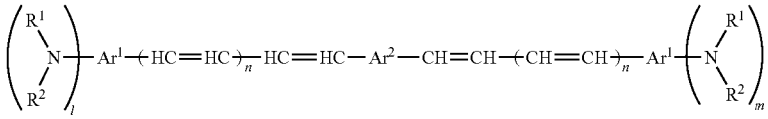

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $Ar^1$ and $Ar^2$ independently represents a substituted or unsubstituted aromatic group; each of l and m independently represents an integer of from 0 to 3 but does not simultaneously represent 0; and n represents an integer of 1 or 2;

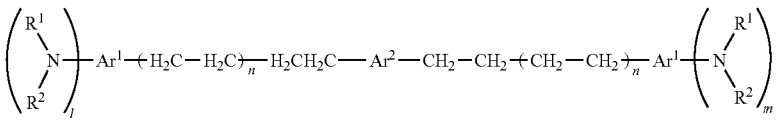

wherein each of $R^1$ and $R^2$ independently represents an alkyl group having 1 to 4 carbon atoms which may be substituted with an aromatic group, wherein $R^1$ and $R^2$ may share bond connectivity to form a heterocyclic ring containing a nitrogen atom; each of $Ar^1$ and $Ar^2$ independently represents a substituted or unsubstituted aromatic group; each of l and m independently represents an integer of from 0 to 3 but does not simultaneously represent 0; and n represents an integer of 1 or 2; and

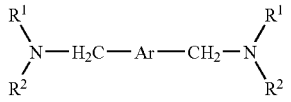

wherein each of $R^1$ and $R^2$ independently represents a substituted or unsubstituted alkyl or aromatic hydrocarbon group, wherein at least one of $R^1$ and $R^2$ represents a substituted or unsubstituted aromatic hydrocarbon group, and $R^1$ and $R^2$ may share bond connectivity to form a heterocyclic ring containing a nitrogen atom; and Ar represents a substituted or unsubstituted aromatic hydrocarbon group.

Specific examples of alkyl groups in the above formulae include, but are not limited to, methyl group, ethyl group, propyl group, butyl group, hexyl group, and undecanyl group. Specific examples of aromatic hydrocarbon groups in the above formulae include, but are not limited to, groups derived from aromatic rings such as benzene, biphenyl, naphthalene, anthracene, and fluorene; and aromatic heterocyclic rings such as pyridine, quinoline, thiophene, furan, oxazole, oxadiazole, and carbazole. Specific examples of substituent groups in the above formulae include, but are not limited to, alkyl groups such as methyl group, ethyl group, propyl group, butyl group, hexyl group, and undecanyl group; alkoxy groups such as methoxy group, ethoxy group, propoxy group, and butoxy group; halogen atoms such as fluorine, chlorine, bromine, and iodine; the above-described aromatic hydrocarbon groups; and groups derived from heterocyclic rings such as pyrrolidone, piperidine, and piperazine. Specific examples of heterocyclic rings containing a nitrogen atom formed by connecting $R^1$ and $R^2$ include, but are not limited to, condensed heterocyclic rings which are heterocyclic rings such as pyrrolidino group, piperidine group, and piperizino group to which aromatic hydrocarbon groups are bound.

Specific examples of the compounds having at least one substituted or unsubstituted alkylamino group include, but are not limited to, compounds shown in the following Tables 2-1 to 2-4.

TABLE 2-1

| Compound No. | Chemical Formula |
|---|---|
| 1 | 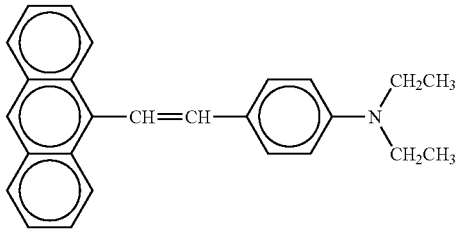 |
| 2 | 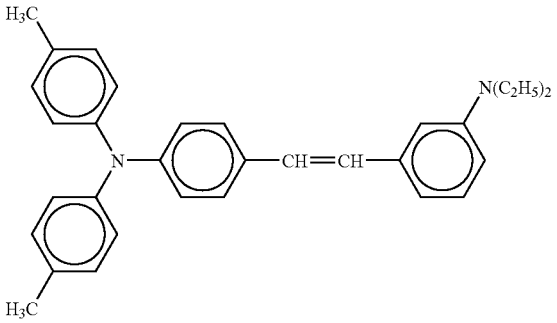 |
| 3 | 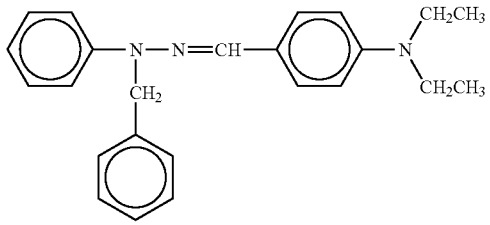 |

TABLE 2-1-continued
| Compound No. | Chemical Formula |
|---|---|
| 4 | 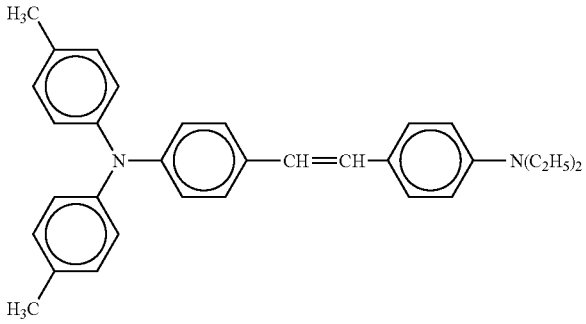 |
| 5 | 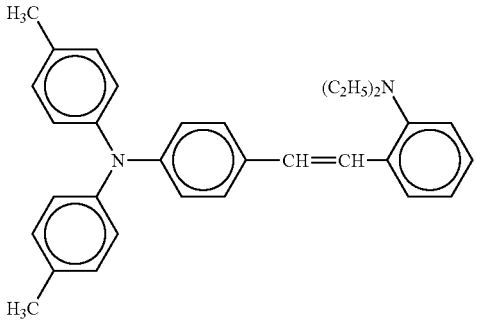 |
| 6 | 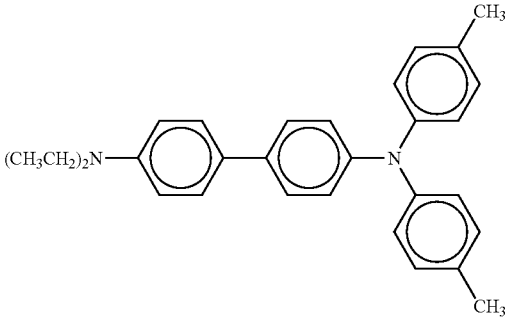 |
| 7 | 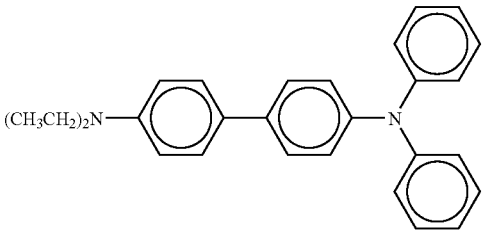 |

TABLE 2-2
| Compound No. | Chemical Formula |
|---|---|
| 8 | 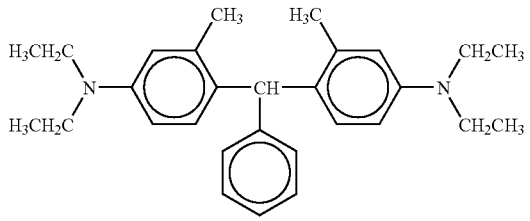 |
| 9 | 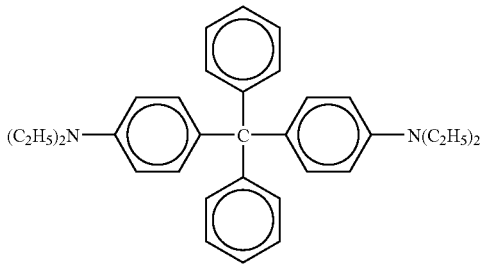 |
| 10 | 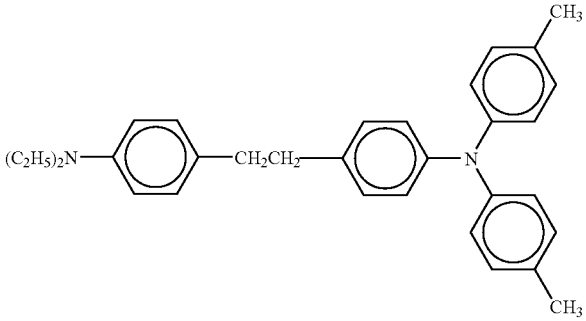 |
| 11 | 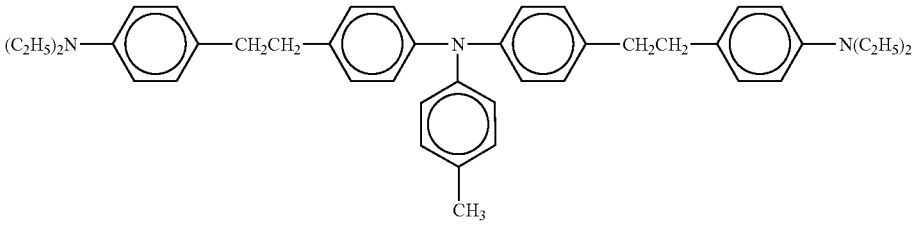 |
| 12 | 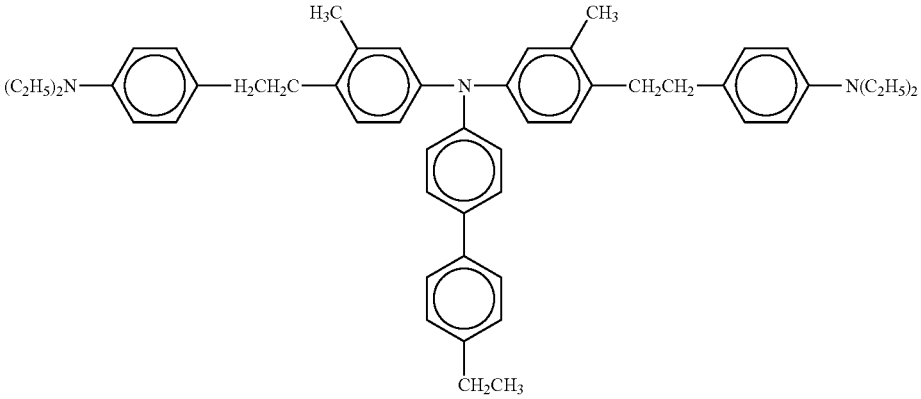 |

TABLE 2-2-continued
| Compound No. | Chemical Formula |
|---|---|
| 13 | 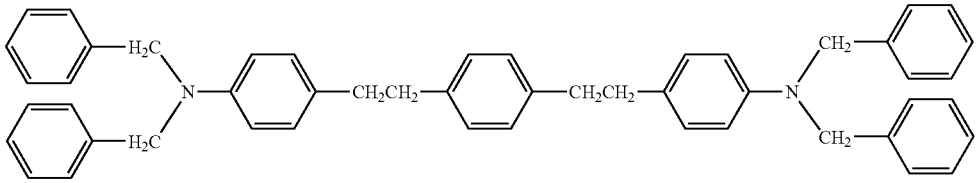 |
| 14 | 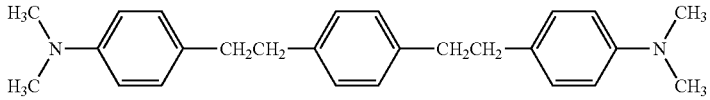 |
| 15 | 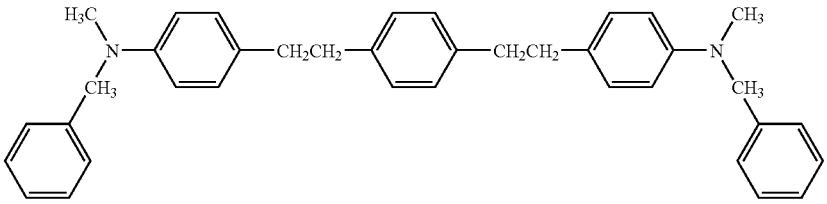 |
TABLE 2-3
| Compound No. | Chemical Formula |
|---|---|
| 16 | 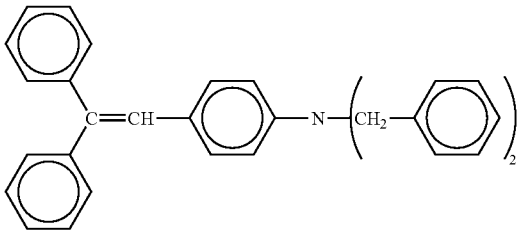 |
| 17 | 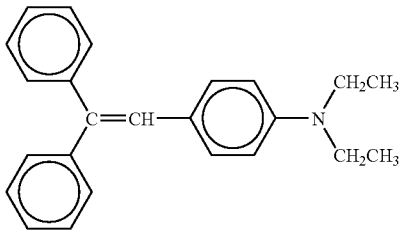 |
| 18 | 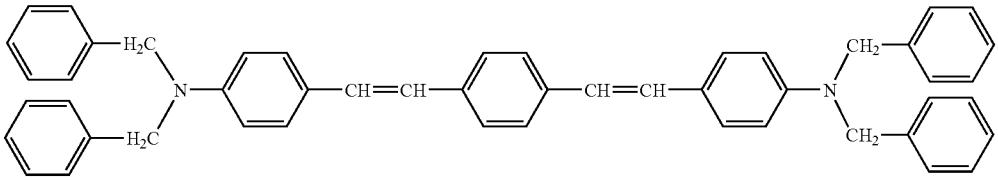 |
| 19 | 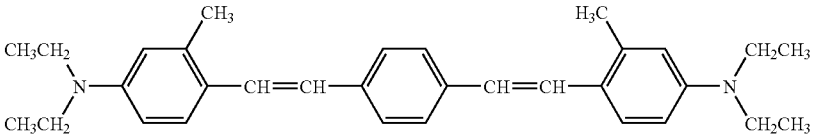 |
| 20 | 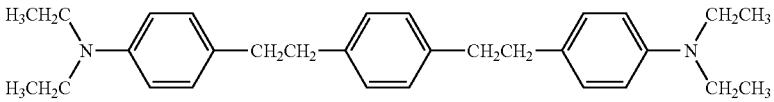 |

TABLE 2-3-continued
| Compound No. | Chemical Formula |
|---|---|
| 21 | 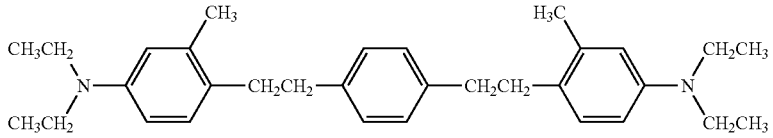 |
| 22 | 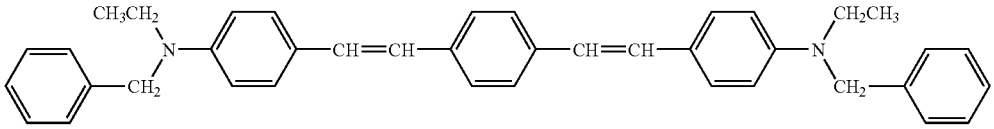 |
| 23 | 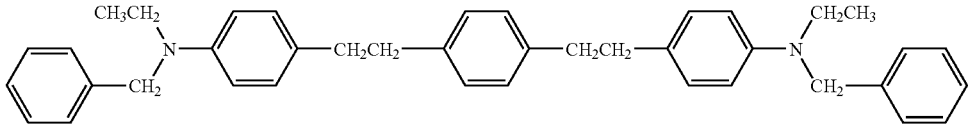 |
| 24 | 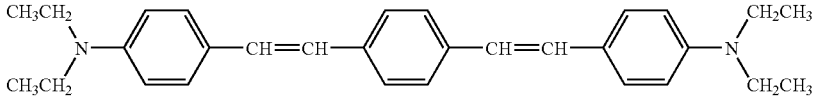 |
| 25 | 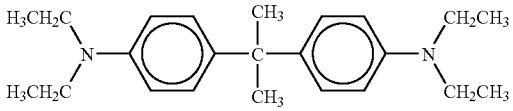 |
| 26 | 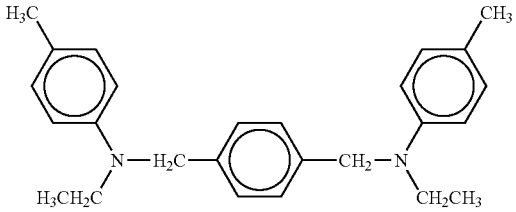 |
| 27 | 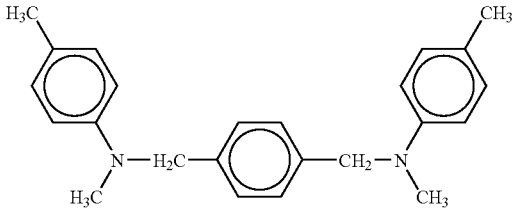 |
TABLE 2-4
| Compound No. | Chemical Formula |
|---|---|
| 28 | 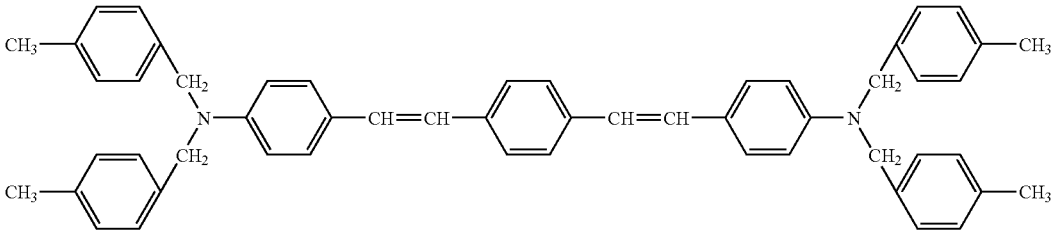 |

TABLE 2-4-continued

| Compound No. | Chemical Formula |
|---|---|
| 29 | 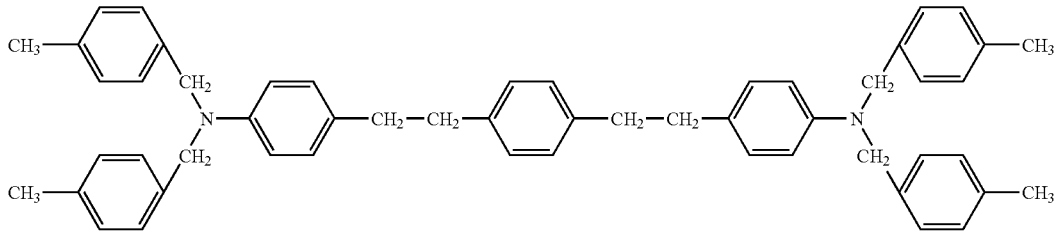 |
| 30 | 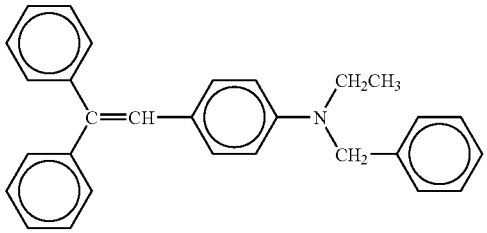 |
| 31 | 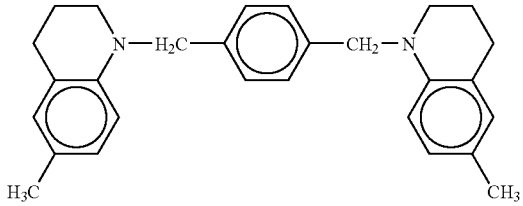 |
| 32 | 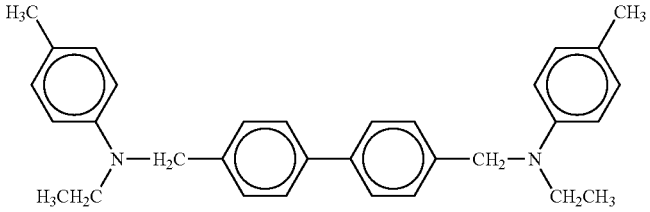 |
| 33 | 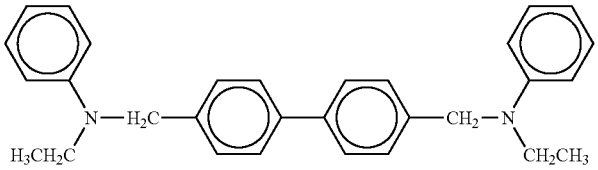 |
| 34 | 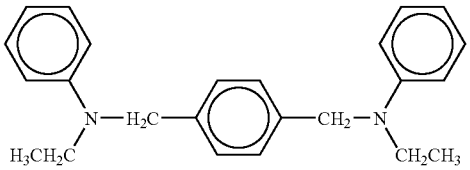 |

Among these compounds, the compound No. 33 is preferable.

Specific preferred examples of suitable binder resins for the charge transport layer include, but are not limited to, thermoplastic resins and thermosetting resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethyl cellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins.

Specific examples of usable solvents for preparing a charge transport layer coating liquid include, but are not limited to, tetrahydrofuran, dioxane, toluene, cyclohexane, methyl ethyl ketone, xylene, acetone, diethyl ether, and methyl ethyl ketone. These solvents can be used alone or in combination.

The charge transport layer preferably has a thickness of from 15 to 50 μm, and more preferably from 20 to 30 μm.

(Undercoat Layer)

The undercoat layer contains a binder resin and multiple inorganic pigments each having different average primary particle diameters.

The undercoat layer has functions of preventing the occurrence of moiré and suppressing charge injection from the conductive substrate. Moiré here refers to a phenomenon in which interference fringe is formed in the resultant image due to the occurrence of optical interference of coherent light such as laser light in photosensitive layers. The undercoat layer prevents the occurrence of moiré by scattering incident laser light. Therefore, the undercoat layer preferably includes materials having a large refractive index. Accordingly, specific preferred examples of suitable inorganic pigments include white pigments such as metal oxides such as titanium oxide, calcium fluoride, calcium oxide, silicon oxide, magnesium oxide, aluminum oxide, and tin oxide.

From the viewpoint of reduction of residual potential, the undercoat layer preferably has a function of transferring charges which have the same polarity as the charged surface of the photoreceptor from photosensitive layers to the conductive substrate. Inorganic pigments described above have such a function. For example, in a negatively-chargeable photoreceptor, the undercoat layer may have electron conductivity so that residual potential is drastically reduced. To more effectively reduce residual potential, one possible method involves using metal oxides having much lower resistances as inorganic pigments, and another possible method involves increasing the ratio of metal oxides to binder resins. However, these methods are likely to case background fouling disadvantageously. Therefore, the composition and thickness of the undercoat layer and the amount of additives are preferably controlled as appropriate so that the occurrence of background fouling is prevented and residual potential is reduced simultaneously.

As described above, metal oxides are preferably used as the inorganic pigments. It is to be noted that metal oxides having conductivity may contribute to reduce residual potential, but are likely to cause background fouling. In contrast, metal oxides having high resistance may contribute to prevent the occurrence of background fouling, but are likely to increase residual potential. The photoreceptor of the present invention may include the intermediate layer to diminish such affects from inorganic pigments. However, even if the intermediate layer is provided, the resistance of inorganic pigments in the undercoat layer may affect not a little the occurrence of background fouling and residual potential. Accordingly, in order to prevent the occurrence of background fouling, metal oxides having high resistance are preferable rather than metal oxides having conductivity. Among the above-described metal oxides, titanium oxides are preferable from the viewpoint of image stability. To suppress increase of residual potential, titanium oxides are preferably as pure as possible. Suitable titanium oxides preferably have a purity of 99.0% or more, and more preferably 99.5% or more.

The photoreceptor of the present invention preferably satisfies the following formulae (2-1) to (2-3), in order to effectively prevent the occurrence of moiré and charge decrease in the first rotation and to improve sensitivity:

$$0.2 \leqq (D(F2)/D(G)) \leqq 0.5 \quad (2\text{-}1)$$

$$0.2 \leqq D(F1) \quad (2\text{-}2)$$

$$D(F2) \leqq D(F1) \quad (2\text{-}3)$$

wherein D(F1) (μm) and D(F2) (μm) represent average primary particle diameters of the largest and smallest inorganic pigments, respectively, and D(G) (μm) represents an average primary particle diameter of the titanyl phthalocyanine pigment.

The average primary particle diameter of inorganic pigments may be measured by observation using an electron microscope. One exemplary method of the observation includes adhering a sample (i.e., inorganic pigments) on a carbon tape, adhering the tape having the sample thereon on a sample stage, observing and photographing the sample with a field emission scanning electron microscope FE-SEM S-4200 from Hitachi, Ltd. at a magnification of several thousands to several tens of thousands. The photograph of the sample may be subjected to image analysis using an image analysis software program IMAGE PRO PLUS from Media Cybernetics so that a biaxial average particle diameter is calculated.

The average primary particle diameter D(G) of the titanyl phthalocyanine pigment is preferably from 0.15 to 0.3 μm. The undercoat layer preferably includes an inorganic pigment having an average particle diameter of from ½ to ⅕ of D(G), which is represented by the formula (2-1). In this case, sensitivity drastically improves. It is considered that contact condition between the titanyl phthalocyanine pigment in the charge generation layer and the inorganic pigment in the undercoat layer has an influence on sensitivity. As described above, the inorganic pigment in the undercoat layer preferably has a particle diameter of 0.2 μm or more. Such a large inorganic pigment may make a surface of the undercoat layer rough at an interface between the undercoat layer and the charge generation layer. Since the titanyl phthalocyanine pigment has a similar size to the inorganic pigment, the titanyl phthalocyanine pigment and the inorganic pigment may be in poor contact condition. As a consequence, charges generated from the titanyl phthalocyanine pigment are unlikely to be injected to the undercoat layer and are rebound or accumulated, causing deterioration of sensitivity or increase of residual potential. When the undercoat layer includes an inorganic pigment having a particle diameter of from ½ to ⅕ that of the titanyl phthalocyanine pigment, it means that small particles of the inorganic pigment are present in the interface between the undercoat layer and the charge generation layer. Thus, contact condition between the titanyl phthalocyanine pigment and the inorganic pigment is improved so that sensitivity improves and residual potential reduces. When D(F2)/D(G) is less than 0.2, it means that D(F2) is too small. Such small inorganic pigments are difficult to disperse finely and/or too smaller than the titanyl phthalocyanine pigment to improve sensitivity, both of which are disadvantageous.

Further, the photoreceptor of the present invention preferably satisfies the following equation:

$$0.2 \leqq T2/(T1+T2) \leqq 0.8$$

wherein T1 and T2 represent amounts of the inorganic pigments having the average primary particle diameters of D(F1) and D(F2), respectively. When T2/(T1+T2) is too small, the occurrence of background fouling cannot be sufficiently prevented. When T2/(T1+T2) is too large, the occurrence of moiré cannot be sufficiently prevented.

Charge injection property from the charge generation layer to the undercoat layer depends on the amounts of inorganic pigments in the undercoat layer and titanyl phthalocyanine pigments in the charge generation layer, as well as the particle diameters of inorganic pigments and titanyl phthalocyanine pigments, as described above.

The charge generation layer preferably includes a titanyl phthalocyanine pigment in an amount of from 70 to 85% by weight so that charges are easily injected from the charge generation layer to the undercoat layer, as described above. Besides, the undercoat layer preferably includes an inorganic pigment in an amount of from 75 to 86% by weight, and more preferably from 85 to 86% by weight, so that sensitivity is drastically improved.

Specific preferred examples of suitable binder resins for the undercoat layer include, but are not limited to, resins which are insoluble in solvents used for forming layers overlying thereon including water-soluble resins such as polyvinyl alcohol, casein, and sodium polyacrylate; alcohol-soluble resins such as polyamide, copolymerized nylon, and methoxymethylated nylon; and hardening resins which form three-dimensional network structures such as polyurethane, phenol resins, alkyd-melamine resins, and epoxy resins. Among these resins, hardening resins are preferable because they are highly resistant to organic solvents. More specifically, alkyd-melamine resins are preferable from the viewpoint of residual potential and environmental stability.

When using hardening resins, the ratio between main materials and hardening agents would be set appropriate so that contraction in volume is minimized. If the degree of volume contraction is large, layers may be unevenly formed and residual potential may increase. In particular, an uneven undercoat layer may cause leakage of charges, resulting in black spots and background fouling in the resultant images. Moreover, as the ratio of hardening agents increases, residual potential also increases. A suitable alkyd-melamine resin preferably includes an alkyd resin unit and a melamine resin unit at a weight ratio of from 1/1 to 4/1. In this case, layers may be evenly formed and increase of residual potential may be suppressed.

Inorganic pigments are dispersed in solvents together with binder resins using a known disperser such as a ball mill, a sand mill, and an attritor so that an undercoat layer coating liquid is prepared. Alternatively, binder resins may be added either before and after inorganic pigments are dispersed in solvents. In the latter case, binder resins may be added in form of solutions. Each of multiple inorganic pigments preferably has a dispersion diameter in a coating liquid approximately equal to their average primary diameter. The undercoat layer coating liquid may include other agents needed for hardening (cross-linking) such as solvents, additives, and hardening accelerators, if needed. The undercoat layer coating liquid is coated on the conductive substrate by a known coating method such as a spray coating method, a ring coating method, a bead coating method, and a nozzle coating method, followed by drying, heating, and optional exposure to light.

When titanium oxides are used as the inorganic pigments, the undercoat layer preferably has a thickness of from 1 to 10 μm, and more preferably from 2 to 6 μm, from the viewpoint of prevention of the occurrence of background fouling and increase of residual potential. When the thickness is too small, moiré may be not sufficiently prevented or chargeability may deteriorate with repeated use. When the thickness is too large, residual potential may increase. When metal oxides having conductivity are used as the inorganic pigments, the undercoat layer preferably has a thickness of from 3 to 20 μm, and more preferably from 5 to 15 μm. In this case, thicker layer do not have influence on residual potential very much.

In order to more effectively suppressing charge injection from the conductive substrate, the photoreceptor of the present invention may further include an intermediate layer containing binder resins as main components.

Specific examples of suitable binder resins for the intermediate layer include, but are not limited to, thermoplastic resins such as polyamide, polyester, and vinyl chloride-vinyl acetate copolymers; and thermosetting resins such as a resin formed by a thermal polymerization of a compound having multiple active hydrogens (such as hydrogens in —OH, —$NH_2$, and —NH) with a compound having multiple isocyanate groups and/or a compound having multiple epoxy groups. Specific examples of the compound having multiple active hydrogens include, but are not limited to, polyvinyl butyral, phenoxy resins, phenol resins, polyamide, polyester, polyethylene glycol, polypropylene glycol, polybutylene glycol, and acrylic resins having an active hydrogen such as hydroxyethyl methacrylate group. Specific examples of the compound having multiple isocyanate groups include, but are not limited to, tolylene diisocyanate, hexamethylene diisocyanate, diphenylmethane diisocyanate, and prepolymers thereof. Specific examples of the compound having multiple epoxy groups include, but are not limited to, bisphenol A-based epoxy resins. In addition, a thermosetting resin formed by a thermal polymerization of an oil-free alkyd resin with an amino resin such as a butylated melamine resin; and a light hardening resin formed from a resin having an unsaturated bond such as unsaturated polyurethane and unsaturated polyester and a photopolymerization initiator such as methyl benzyl formate are also usable as binder resins. Such alcohol-soluble resins and thermosetting resins have high insulation and resistant to solvents in coating liquids applied thereon such as ketone solvents. Accordingly, an even layer can be formed and the occurrence of background fouling can be prevented effectively and stably.

Among the above-described binder resins, polyamide is preferable, and N-methoxymethylated nylon is more preferable. Polyamide resins effectively prevent charge injection while having a small influence on residual potential. Polyamide resins are alcohol-soluble and are insoluble in ketone solvents. Therefore, an even and thin layer can be formed by a dip coating method. This is an advantageous point because the intermediate layer is preferably as thin as possible so as to minimize influence of residual potential increase.

Generally, alcohol-soluble resins have a large dependence on environmental conditions. For example, they have high resistance in low-humidity conditions and cause increase of residual potential. In contrast, they have low resistance in high-humidity conditions and cause charge decrease. Because of having high insulation, N-methoxymethylated nylon effectively blocks charges injected from the conductive substrate and has little influence on residual potential. In addition, N-methoxymethylated nylon has a less dependence on environmental conditions. Moreover, in the undercoat layer containing N-methoxymethylated nylon, residual potential level has a small dependence on the thickness of the layer. Accordingly, reduction of residual potential and prevention of background fouling can be achieved simultaneously.

Suitable N-methoxymethylated nylon is preferably substituted with 15% by mol or more of methoxymethyl groups. When the substituted amount of methoxymethyl groups is too small, such N-methoxymethylated nylon may be more dependent on temperature or alcohol solutions thereof tend to become whitish. As a result, coating liquids may be unstable.

N-methoxymethylated nylon can be used alone or in combination with a cross-linking agent and/or an acid catalyst. Specific examples of usable cross-linking agents include, but are not limited to, melamine resins and isocyanate resins. Specific examples of usable acid catalyst include, but are not limited to, tartaric acid. Since there is a possibility that acid catalysts reduce insulation of the intermediate layer and cause background fouling, the amount of acid catalysts may be as small as possible. Specifically, a suitable amount of N-methoxymethylated nylon is preferably 5% by weight or less based on binder resins. Of course, other binder resins can be used in combination, such as polyamide resins having alcohol-solubility. In this case, coating liquids have temporal stability.

The intermediate layer may further include conductive polymers, acceptor/donor resins (it depends on charge polarity), low-molecular-weight compounds, and other additives so that residual potential is more effectively reduced. The amount thereof may be as small as possible if overlying layers are formed thereon by a dip coating method so as to prevent elution thereof from the intermediate layer.

Since N-methoxymethylated nylon is alcohol-soluble, coating liquids thereof are prepared using alcohol solvents such as methanol, ethanol, propanol, butanol, and mixtures thereof. The intermediate layer may be formed by a known method such as a dip coating method, a spray coating method, a ring coating method, a bead coating method, and a nozzle coating method, followed by drying by application of heat, and optional heating or light exposure when hardening is needed.

The intermediate layer that does not include any inorganic pigment preferably has a thickness of not less than 0.1 μm and less than 2.0 μm, and more preferably from 0.3 to 1.0 μm. When the intermediate layer is too thick, residual potential may easily increase by repeated charging and light exposure. When the intermediate layer is too thin, the occurrence of background fouling cannot be prevented.

The undercoat layer that includes inorganic pigments may be formed either above or below the intermediate layer that includes binder resins but no inorganic pigment.

In a case in which the undercoat layer that includes inorganic pigments is formed between the intermediate layer which is directly formed on the conductive substrate and includes no inorganic pigment and a photosensitive layer, the occurrence of background fouling and increase of residual potential are effectively suppressed and reliable electrostatic properties are provided. Further, such an undercoat layer may intimately adhere to the photosensitive layer, resulting in high durability of the resultant photoreceptor. In this case, there is no need to use highly conductive metal oxides, and therefore titanium oxides are preferably used as the inorganic pigments. Accordingly, the occurrence of background fouling is effectively prevented while decreasing an influence on residual potential.

In a case in which the undercoat layer which includes inorganic pigments is formed between the conductive substrate and the intermediate layer which includes no inorganic pigment, background fouling is effectively prevented but residual potential increases and chargeability deteriorates. In order to prevent such deterioration of chargeability, the ratio of inorganic pigments to binder resins may increase or inorganic pigments with low resistance may be added so that conductivity is increased. Specific preferred examples of such conductive inorganic pigments include tin oxides, but are not limited thereto.

The former configuration is preferable in the present invention because the occurrence of background fouling can be more effectively prevented, residual potential and chargeability can be stabilized, defects of conductive substrates can be covered, and photosensitive layers can be more intimately adhered thereto.

In order to improve environmental resistance, in particular, to prevent deterioration of sensitivity and increase of residual potential, at least one of the charge generation layer, charge transport layer, undercoat layer, protective layer, and intermediate layer may include any one of antioxidants, plasticizers, lubricants, ultraviolet absorbers, low-molecular-weight charge transport materials, and leveling agents.

Specific examples of usable antioxidants include the following compounds, but are not limited thereto.

1) Phenol compounds such as 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylydenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.
2) p-Phenylenediamines such as N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.
3) Hydroquinones such as 2,5-di-t-octyl hydroquinone, 2,6-didodecyl hydroquinone, 2-dodecyl hydroquinone, 2-dodecyl-5-chlorohydroquinone, 2-t-octyl-5-methyl hydroquinone, and 2-(2-octadecenyl)-5-methyl hydroquinone.
4) Organic sulfur compounds such as dilauryl-3,3'-thiodipropionate, distearyl-3,3'-thiodipropionate, and ditetradecyl-3,3'-thiodipropionate.
5) Organic phosphorus compounds such as triphenyl phosphine, tri(nonylphenyl) phosphine, tri(dinonylphenyl) phosphine, tricresyl phosphine, and tri(2,4-dibutylphenoxy)phosphine.

These compounds are known as antioxidants used for rubbers, plastics, and oils and fats and are commercially available.

A layer preferably includes an antioxidant in an amount of from 0.1 to 10% by weight based on total weight of the layer.

(Protective Layer)

The photoreceptor of the present invention may include a protective layer on an outermost surface for the purpose of improving abrasion resistance. One preferred embodiment includes a charge transport polymer-based layer formed by polymerizing charge transport components and binder resin components. Another preferred embodiment includes a filler-based layer in which a filler is dispersed. Yet another preferred embodiment includes a cross-linked layer. From the viewpoint of durability, cross-linked protective layers are preferable. An exemplary embodiment of suitable cross-linked protective layers is described below.

A cross-linked charge transport layer is required to have a function of transporting charges while maintaining abrasion resistance. Such a cross-linked charge transport layer is formed from a hardening reaction between a radical-polymerizable monomer having no charge transport structure and a radical-polymerizable compound having a charge transport structure. The hardening reaction is here defined as a reaction in which a low-molecular-weight compound having multiple functional groups or a high-molecular-weight compound forms intermolecular bonds (such as covalent bonds) upon application of heat, light, and/or electron beam, resulting in formation of a three-dimensional network structure.

Hardened resins are classified into heat-hardening resins that are polymerized upon application of heat, light-hardening resins that are polymerized upon exposure of lights such as ultraviolet light and visible light, and electron-beam-hardening resins that are polymerized upon exposure of an electron beam. A hardener, a catalyst, a polymerization initiator, and the like, may be used in combination with the hardening resins.

In order to harden such a hardening resin, a reactive compound (such as a monomer and an oligomer) needs a functional group which is polymerizable. Specific examples of suitable functional groups which are polymerizable include, but are not limited to, acryloyl group and methacryloyl group. As the number of functional groups per molecule of the reactive compound increases, particularly exceeds 3, the resultant three-dimensional network structure becomes stiffer. As a consequence, the resultant layer has high hardness, high elasticity, and improved smoothness, thereby providing a high-durable photoreceptor which produces high quality images.

As described above, a radical-polymerizable monomer having no charge transport structure and a radical-polymerizable compound having a charge transport structure are subjected to a hardening reaction so that a three-dimensional network structure is formed thereon. It is effective to previously add a hardener, a catalyst, a polymerization initiator, and the like, to accelerate the hardening reaction. In this case, the resultant cross-linked charge transport layer may have an improved abrasion resistance, and electric properties thereof hardly deteriorate because unreacted functional groups remain only slightly. Further, crack and deformation hardly occur therein because the hardening reaction is evenly performed, providing good cleaning performance.

First, the radical-polymerizable monomer having no charge transport structure is explained in detail below. Here, the radical-polymerizable monomer having no charge transport structure is defined as a monomer which has neither hole transport structure such as triarylamine, hydrazone, pyrazoline, and carbazole nor electron transport structure such as condensed polycyclic quinone, diphenoquinone, an electron acceptable aromatic ring having cyano group or nitro group, and further has a radical-polymerizable functional group which has a carbon-carbon double bond. For example, 1-substituted ethylene functional groups and 1,1-substituted ethylene functional groups are preferable for the radical-polymerizable functional group.

The 1-substituted ethylene functional group is represented by the following formula (7):

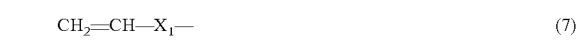

$$CH_2{=}CH{-}X_1{-} \quad (7)$$

wherein $X_1$ represents an arylene group such as phenylene group and naphthylene group which may have a substituent, and alkenylene group which may have a substituent, —CO—, —COO—, —$CONR_{10}$ ($R_{10}$ represents a hydrogen atom, an alkyl group such as methyl group and ethyl group, an aralkyl group such as benzyl group, naphthylmethyl group, and phenethyl group, or an aryl group such as phenyl group and naphthyl group), or —S—.

Specific examples of the 1-substituted ethylene functional groups having the formula (7) include, but are not limited to, vinyl group, styryl group, 2-methyl-1,3-butadienyl group, vinyl carbonyl group, acryloyloxy group, acryloyl amide group, and vinyl thioether group.

The 1,1-substituted ethylene functional group is represented by the following formula (8):

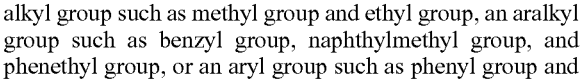

$$CH_2{=}CY{-}X_2{-} \quad (8)$$

wherein Y represents an alkyl group which may have a substituent, an aralkyl group which may have a substituent, an aryl group such as phenyl group and naphthyl group which may have a substituent, a halogen atom, cyano group, nitro group, an alkoxyl group such as methoxy group and ethoxyl group, —$COOR_{11}$ ($R_{11}$ represents a hydrogen atom, an alkyl group such as methyl group and ethyl group which may have a substituent, an aralkyl group such as benzyl group and naphthylmethyl group which may have a substituent, an aryl group such as phenyl group and naphthyl group which may have a substituent, or $CONR_{12}R_{13}$ (each of $R_{12}$ and $R_{13}$ independently represents a hydrogen atom, an alkyl group such as methyl group and ethyl group which may have a substituent, an aralkyl group such as benzyl group, naphthylmethyl group, and phenethyl group which may have a substituent, or an aryl group such as phenyl group and naphthyl group which may have a substituent)), $X_2$ represents $X_1$ in the formula (7), a single bond, or an alkylene group, wherein at least one of Y and $X_2$ is oxycarbonyl group, cyano group, an alkenylene group, or an aromatic group.

Specific examples of the 1,1-substituted ethylene functional groups having the formula (8) include, but are not limited to, α-chlorinated acryloyloxy group, methacryloyloxy group, α-cyanoethylene group, α-cyanoacryloyloxy group, α-cyanophenylene group, and methacryloylamino group.

The above $X_1$, $X_2$, and Y may be further substituted with a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, or an aralkyl group such as benzyl group and phenethyl group. Among these radical-polymerizable functional groups, acryloyloxy group and methacryloyloxy group are preferable. The radical-polymerizable monomer having no charge transport structure preferably has 3 or more functional groups so that the resultant three-dimensional network structure has a high cross-linking density, which provides high stiffness and elasticity and an improved smoothness. Such a resultant layer has a high resistance to abrasion and scratching. In some cases, volume contraction occurs depending on hardening conditions or used materials, because multiple bonds are formed quickly. Consequently, internal stress is generated in the resultant layer, possibly causing crack and peeling. This problem may be solved by using a monofunctional or difunctional radical-polymerizable monomer in combination.

An exemplary embodiment of radical-polymerizable monomers having no charge transport structure and 3 or more functional groups, which provides an improved abrasion resistance, is described in detail below.

For example, a compound having 3 or more acryloyloxy groups can be produced by an esterification reaction or a transesterification reaction of a compound having 3 or more hydroxyl groups with an acrylic acid, an acrylic halide, or an acrylate. A compound having 3 or more methacryloyloxy groups can be produced in a similar way. Multiple radical-polymerizable functional groups included in such a compound may be, but need not necessarily be, the same.

Specific examples of suitable radical-polymerizable monomers having no charge transport structure include, but are not limited to, trimethylolpropane triacrylate (TMPTA), trimethylolpropane trimethacrylate, alkylene-modified (hereinafter "HPA-modified") trimethylolpropane triacrylate, ethyleneoxy-modified (hereinafter "EO-modified") trimethylolpropane triacrylate, propyleneoxy-modified (hereinafter "PO-modified") trimethylolpropane triacrylate, caprolactone-modified trimethylolpropane triacrylate, epichlorohydrin-modified (hereinafter "ECH-modified") trimethylolpropane triacrylate, HPA-modified trimethylolpropane trimethacrylate, pentaerythritol triacrylate, pentaerythrtol tetraacrylate (PETTA), glycerol triacrylate, ECH-modified glycerol triacrylate, EO-modified glycerol triacrylate, PO-modified glycerol triacrylate, tris(acryloxyethyl) isocyanurate, alkyl-modified dipentaerythritol tetraacrylate, alkyl-modified dipentaerythritol triacrylate, dimethylolpropane tetraacrylate (DTMPTA), pentaerythritol ethoxy tetraacrylate, EO-modified phosphate triacrylate, 2,2,5,5-tetrahydroxymethyl cyclopentanone tetraacrylate, 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, styrene monomer, 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, EO-modified bisphenol A diacrylate, EO-modified bisphenol F diacrylate, and neopentyl glycol diacrylate. Among these compounds, trimethylolpropane triacrylate (TMPTA), HPA-modified trimethylolpropane triacrylate, EO-modified trimethylolpropane triacrylate, PO-modified trimethylolpropane triacrylate, and ECH-modified trimethylolpropane triacrylate are preferable.

Specific examples of suitable radical-polymerizable oligomers having no charge transport structure include, but are not limited to, epoxy acrylate oligomers, urethane acrylate oligomers, and polyester acrylate oligomers.

These compounds can be used alone or in combination.

With regard to the radical-polymerizable monomer having no charge transport structure and 3 or more functional groups, the ratio of the molecular weight to the number of the functional groups is preferably 250 or less so that cross-linking bonds are densely formed in the resultant cross-linked charge transport layer. When the ratio is greater than 250, the resultant cross-linked charge transport layer may be too soft, degrading abrasion resistance. In such a case, a modified monomer having too long a modified group is not preferably used alone.

The cross-linked charge transport layer typically includes the radical polymerizable monomer having no charge transport structure and 3 or more functional groups in an amount of from 20 to 80% by weight, and preferably from 30 to 70% by weight. When the amount is too small, the three-dimensional cross-linking density in the resultant layer is too small, providing a similar abrasion resistance to a typical layer including a thermoplastic binder resin. When the amount is too large, the amount of a charge transport compound may be reduced, degrading electric properties of the resultant layer. Accordingly, an optimum amount of the radical polymerizable monomer having no charge transport structure is from 30 to 70% by weight Next, the radical-polymerizable compound having a charge transport structure is explained in detail below. Here, the radical-polymerizable compound having a charge transport structure is defined as a monomer which has either hole transport structure such as triarylamine, hydrazone, pyrazoline, and carbazole or electron transport structure such as condensed polycyclic quinone, diphenoquinone, an electron acceptable aromatic ring having cyano group or nitro group, and further has a radical-polymerizable functional group which has a carbon-carbon double bond.

Although the number of functional groups in the radical-polymerizable compound having a charge transport structure is not limited, a monofunctional compound is preferable from the viewpoint of electrostatic properties and quality of the resultant layer. A difunctional compound may increase the cross-linking density, however, a charge transport structure therein may be very bulky. As a consequence, a large distortion may be generated in the resultant layer, possibly increasing internal stress therein. In addition, such a difunctional compound cannot reliably retain an intermediate (such as cation radical) during charge transportation, possibly causing charge trapping, which degrades sensitivity and increases residual potential. In particular, a compound having 3 or more functional groups considerably causes such a phenomenon.

A radical-polymerizable compound having a triarylamine structure as a charge transport structure is preferable because of its high charge transport ability. The reason for this is considered that the triarylamine includes a lot of hopping sites and π conjugation is spread thereover. In addition, the triarylamine is easily conjugated when being in a state of radical cation. Specifically, compounds having the following formulae (9) and (10) provide high sensitivity and good electric properties:

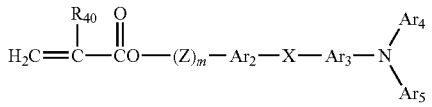

(9)

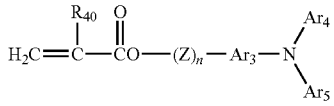

(10)

wherein $R_{40}$ represents a hydrogen atom, a halogen atom, an alkyl group which may have a substituent, an aralkyl group which may have a substituent, an aryl group which may have a substituent cyano group, nitro group, an alkoxy group, —$COOR_5$ (wherein $R_5$ represents a hydrogen atom, an alkyl group which may have a substituent, an aralkyl group which may have a substituent, or an aryl group which may have a substituent), a halogenated carbonyl group, or —$CONR_6R_7$ (wherein each of $R_6$ and $R_7$ independently represents a hydrogen atom, a halogen atom, an alkyl group which may have a substituent, an aralkyl group which may have a substituent, or an aryl group which may have a substituent); each of $Ar_2$ and $Ar_3$ independently represents a substituted or unsubstituted arylene group; each of $Ar_4$ and $Ar_5$ independently represents a substituted or unsubstituted aryl group; X represents a single bond, a substituted or unsubstituted alkylene group, a substituted or unsubstituted cycloalkylene group, a substituted or unsubstituted alkylene ether group, an oxygen atom, a sulfur atom, or a vinylene group; Z represents a substituted or unsubstituted alkylene group, a substituted or unsubstituted alkylene ether group, or an alkylene oxycarbonyl group; and each of m and n independently represents an integer of 0 to 3.

Specific examples of suitable alkyl groups for $R_{40}$ in the formulae (9) and (10) include, but are not limited to, methyl group, ethyl group, propyl group, and butyl group. Specific examples of suitable aryl groups for $R_{40}$ in the formulae (9) and (10) include, but are not limited to, phenyl group and naphthyl group. Specific examples of suitable aralkyl groups for $R_{40}$ in the formulae (9) and (10) include, but are not limited to, benzyl group, phenethyl group, and naphthylmethyl group. Specific examples of suitable alkoxy groups for $R_{40}$ in the formulae (9) and (10) include, but are not limited to, methoxy group, ethoxy group, and propoxy group. These groups may be further substituted with a halogen atom, nitro group, cyano group, an alkyl group such as methyl group and ethyl group, an alkoxy groups such as methoxy group and ethoxy group, an aryloxy group such as phenoxy group, an aryl group such as phenyl group and naphthyl group, an aralkyl group such as benzyl group and phenethyl group. Among these functional groups, a hydrogen atom and methyl group are preferable for $R_{40}$ in the formulae (9) and (10).

Specific examples of suitable aryl groups for $Ar_4$ and $Ar_5$ in the formulae (9) and (10) include, but are not limited to, a condensed polycyclic hydrocarbon group, a non-condensed cyclic hydrocarbon group, and a heterocyclic group.

A suitable condensed polycyclic hydrocarbon group may include a ring consisting of 18 or less carbon atoms. Specific examples of such condensed polycyclic hydrocarbon groups include, but are not limited to, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluoranthenyl group, acephenanthrylenyl group, aceanthrylenyl group, triphenylel group, pyrenyl group, chrysenyl group, and naphthacenyl group.

Specific examples of suitable non-condensed cyclic hydrocarbon groups include, but are not limited to, monovalent groups of monocyclic hydrocarbon compounds such as benzene, diphenyl ether, polyethylene diphenyl ether, diphenyl thioether, and diphenyl sulfone; monovalent groups of non-condensed polycyclic hydrocarbon compounds such as biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene; and monovalent groups of ring assembly hydrocarbon compounds such as 9,9-diphenylfluorene.

Specific examples of suitable heterocyclic groups include, but are not limited to, monovalent groups of carbazole, dibenzofuran, dibenzothiophene, oxadiazole, and thiadiazole.

Aryl groups represented by $Ar_4$ and $Ar_5$ may have the following substituents (1) to (8).

(1) Halogen atoms, cyano group, and nitro group.

(2) Alkyl groups, preferably straight-chain or branched-chain alkyl groups having 1 to 12 carbon atoms, preferably 1 to 8 carbon atoms, and more preferably 1 to 4 carbon atoms. The alkyl groups may be substituted with a fluorine atom, hydroxyl group, cyano group, an alkoxy group having 1 to 4 carbon atoms, phenyl group, or a phenyl group substituted with a halogen atom, an alkyl group having 1 to 4 carbon atoms, or an alkoxy group having 1 to 4 carbon atoms. Specific examples of suitable alkyl groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group.

(3) Alkoxy groups (—$OR_{30}$ wherein $R_{30}$ represents an alkyl group described in the above paragraph (2)). Specific examples of suitable alkoxy groups include, but are not limited to, methoxy group, ethoxy group, n-propoxy group, i-propoxy group, t-butoxy group, n-butoxy group, s-butoxy group, 1-butoxy group, 2-hydroxyethoxy group, benzyloxy group, and trifluoromethoxy group.

(4) Aryloxy groups derived from aryl groups such as phenyl group and naphthyl group. The aryl groups may have a substituent such as an alkoxy group having 1 to 4 carbon atoms, an alkyl group having 1 to 4 carbon atoms, or a halogen atom. Specific examples of suitable aryloxy groups include, but are not limited to, phenoxy group, 1-naphthyloxy group, 2-naphthyloxy group, 4-methoxyphenoxy group, and 4-methylphenoxy group.

(5) Alkyl mercapto groups and aryl mercapto groups. Specific examples of suitable alkyl or aryl mercapto groups include, but are not limited to, methylthio group, ethylthio group, phenylthio group, and p-methyl phenylthio group.

(6) Substituents having the following formula:

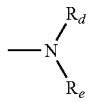

wherein each of $R_d$ and $R_e$ independently represents a hydrogen atom, an alkyl group described in the above paragraph (2), or an aryl group such as phenyl group, biphenyl group, and naphthyl group, which may have a substituent such as an alkoxy group having 1 to 4 carbon atoms, an alkyl group having 1 to 4 carbon atoms, or a halogen atom, and $R_d$ and $R_e$ may share bond connectivity. Specific examples of suitable substituents having the above formula include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) Alkylenedioxy groups and alkylenedithio groups such as methylenedioxy group and methylenedithio group.

(8) Substituted or unsubstituted styryl group, substituted or unsubstituted β-phenyl styryl group, diphenyl aminophenyl group, and ditolyl aminophenyl group.

Specific examples of suitable arylene groups represented by $Ar_2$ and $Ar_3$ include, but are not limited to, divalent groups derived from the aryl groups represented by $Ar_4$ and $Ar_5$.

As described above, X in the formulae (9) and (10) represents a single bond, a substituted or unsubstituted alkylene group, a substituted or unsubstituted cycloalkylene group, a substituted or unsubstituted alkylene ether group, an oxygen atom, a sulfur atom, or a vinylene group.

Specific examples of suitable substituted or unsubstituted alkylene groups include, but are not limited to, straight-chain or branched-chain alkylene groups having 1 to 12 carbon atoms, preferably 1 to 8 carbon atoms, and more preferably 1 to 4 carbon atoms, which may further have a fluorine atom, hydroxyl group, cyano group, an alkoxy group having 1 to 4 carbon atoms, phenyl group, or a phenyl group substituted with a halogen atom, an alkyl group having 1 to 4 carbon atom, or an alkoxy group having 1 to 4 carbon atoms. Specific preferred examples of such alkylene groups include, but are not limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group.

Specific examples of suitable substituted or unsubstituted cycloalkylene groups include, but are not limited to, cyclic alkylene groups having 5 to 7 carbon atoms, which may have a fluorine atom, hydroxyl group, an alkyl group having 1 to 4 carbon atoms, or an alkoxy group having 1 to 4 carbon atoms. Specific preferred examples of such cyclic alkylene groups include, but are not limited to, cyclohexylidene group, cyclohexylene group, and 3,3-dimethylcyclohexylidene group.

Specific examples of suitable substituted or unsubstituted alkylene ether groups include, but are not limited to, alkyleneoxy groups such as ethyleneoxy group and propyleneoxy group, alkylenedioxy groups derived from ethylene glycol and propylene glycol, and di- or poly-(oxyalkylene)oxy groups derived from diethylene glycol, tetraethylene glycol, and tripropylene glycol. The alkylene groups in the alkylene ether groups may have a substituent such as hydroxyl group, methyl group, and ethyl group.

Specific examples of suitable vinylene groups include, but are not limited to, substituents having the following formula:

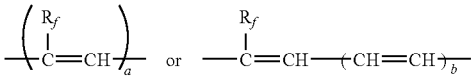

wherein $R_f$ represents a hydrogen atom, an alkyl group described in the above paragraph (2), or an aryl group represented by $Ar_4$ and $Ar_5$ described above; a represents an integer of 1 or 2; and b represents an integer of 1 to 3.

As described above, Z in the formulae (9) and (10) represents a substituted or unsubstituted alkylene group, a substituted or unsubstituted alkylene ether group, or an alkylene oxycarbonyl group.

Specific examples of suitable substituted or unsubstituted alkylene groups include, but are not limited to, alkylene groups represented by X described above.

Specific examples of suitable substituted or unsubstituted alkylene ether groups include, but are not limited to, alkylene ether groups represented by X described above.

Specific examples of suitable alkylene oxycarbonyl groups include, but are not limited to, caprolactone-modified groups.

Specific preferred examples of suitable monofunctional radical-polymerizable compounds having a charge transport structure include, but are not limited to, compounds having the following formula (11):

When the above described radical-polymerizable compounds having a charge transport structure represented by the formula (9), (10), or (11) are polymerized, carbon-carbon double bonds therein are opened. Accordingly, these compounds may be incorporated into the resultant polymer chain, not forming a terminal structure. When being polymerized with a radical-polymerizable monomer having no charge transport structure, such a radical-polymerizable compound having a charge transport structure is present in both a main chain of the resultant cross-linked polymer and a cross-linking chain formed between main chains. (The cross-linking chain includes both an intermolecular cross-linking chain that cross-links a polymer with another polymer, and an intramolecular cross-linking chain that cross-links a specific site in a folded main chain of a polymer with another site distant therefrom, which is originated from the monomer polymerized thereto.) In either cases in which the compound is present in a main chain or a cross-linking chain, a triarylamine structure, in which at least 3 aryl groups are radiated from a nitrogen atom, is pendant from the chain. Although such a triarylamine structure is bulky, the configuration thereof has flexibility because of being suspended from the chain via a carbonyl group, etc., not directly bonded to the chain. Accordingly, the triarylamine structures may be properly arranged in the polymer so as to be adjacent to one another, reducing intramolecular structural distortion. It is believed that a charge transport path is hardly broken in the resultant cross-linked charge transport layer including the above-described intramolecular structure.

(11)

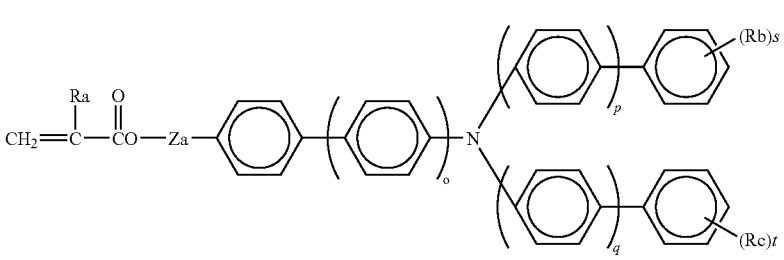

wherein each of o, p, and q independently represents an integer of 0 or 1; each of s and t independently represents an integer of 0 to 3; $R_a$ represents a hydrogen atom or methyl group; each of $R_b$ and $R_c$ independently represents an alkyl group having 1 to 6 carbon atoms, wherein multiple $R_b$ and/or $R_c$ may be, but need not necessarily be, the same; and Za represents a single bond, methylene group, ethylene group, or the following groups:

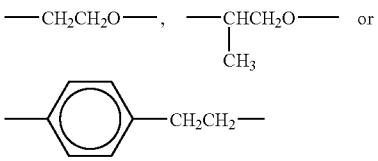

In the formula (11), $R_b$ and $R_c$ are preferably methyl group or ethyl group.

Specific preferred examples of suitable monofunctional radical-polymerizable compounds having a charge transport structure include, but are not limited to, the following compounds Nos. 1 to 20.

No.1

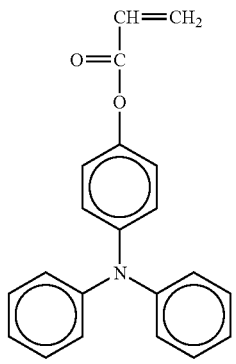

-continued
No.2
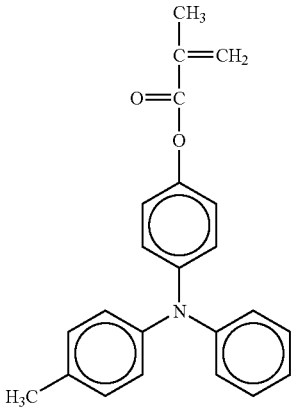
No.3
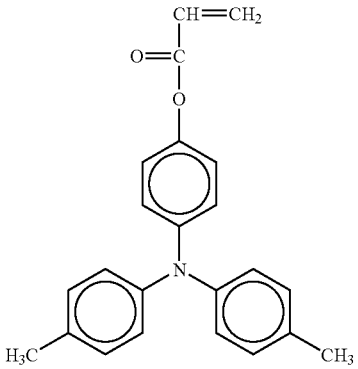
No.4
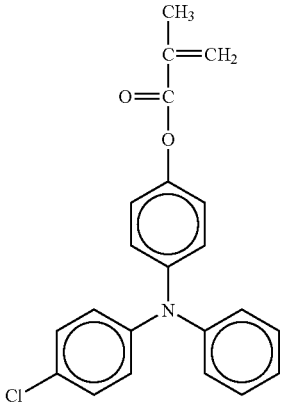
No.5
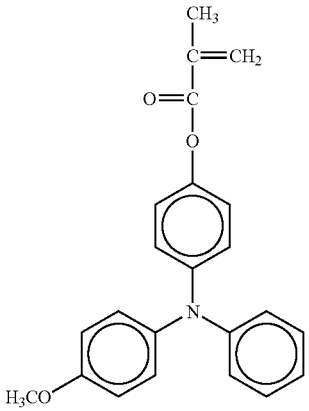
-continued
No.6
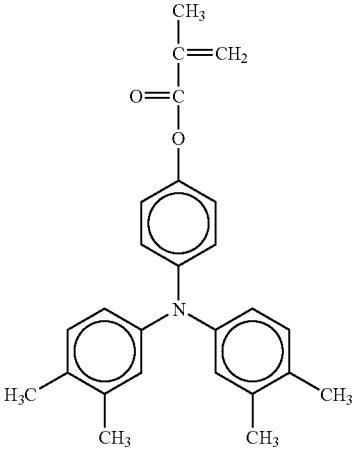
No.7
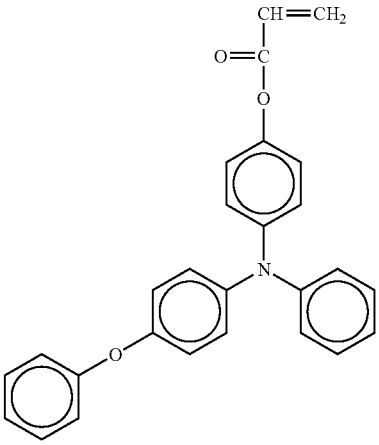
No.8
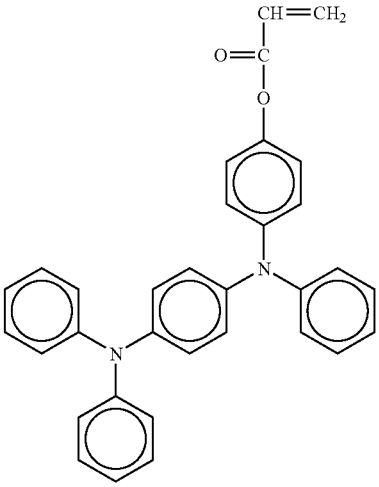

-continued
No.9
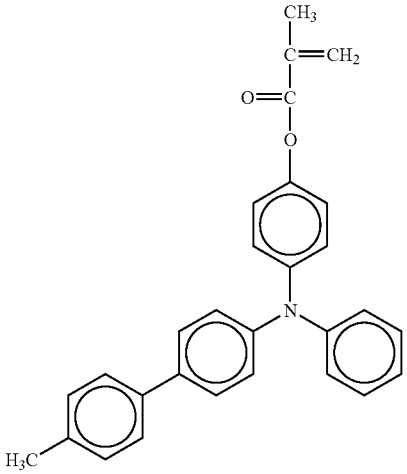
No.10
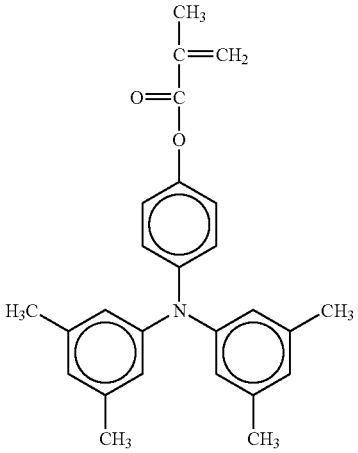
No.11
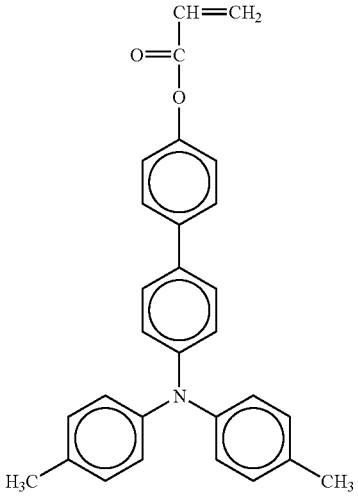
-continued
No.12
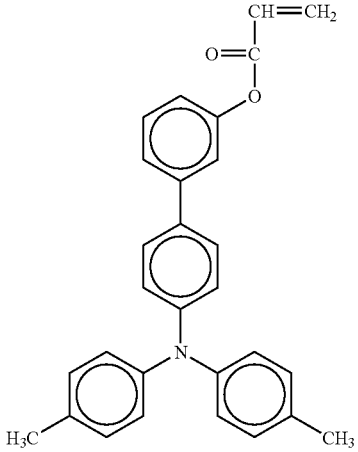
No.13
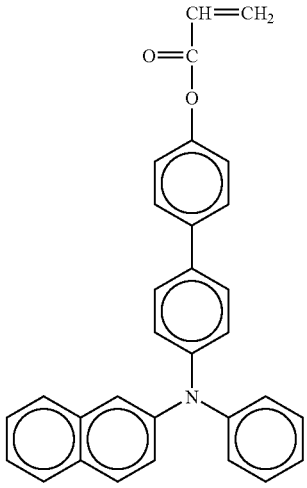
No.14
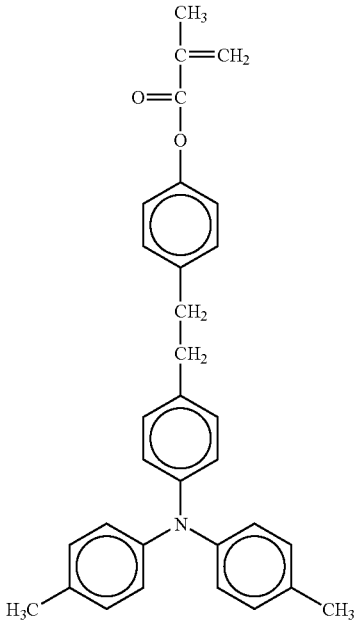

-continued

No.15

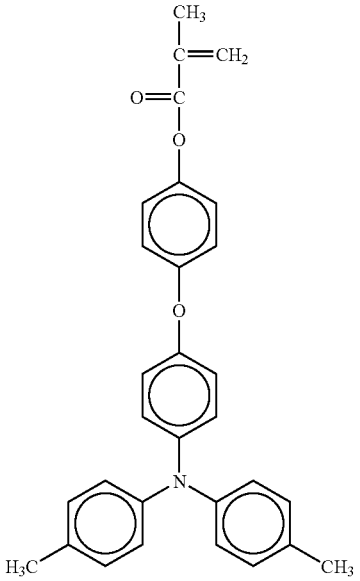

No.16

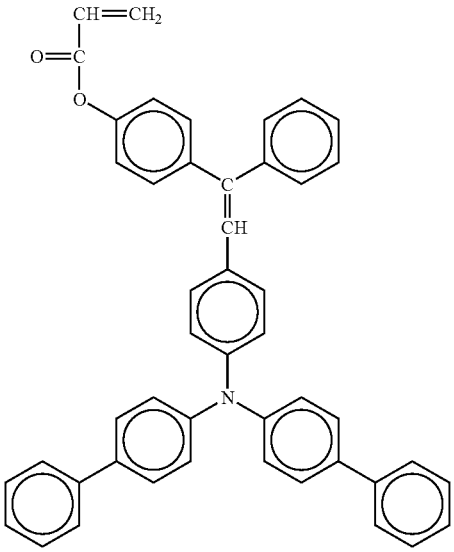

No.17

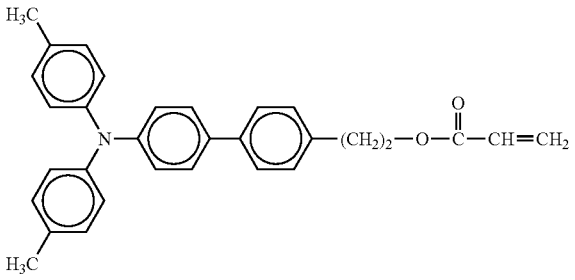

-continued

No.18

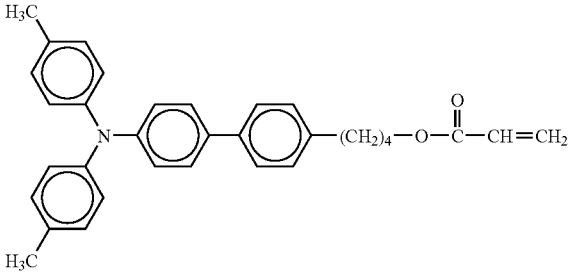

No.19

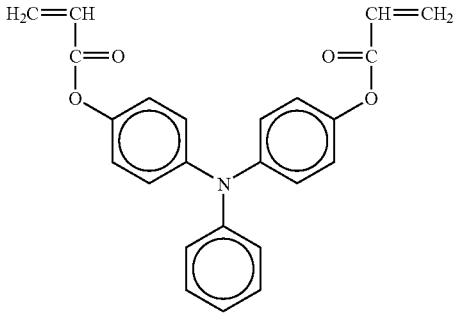

No.20

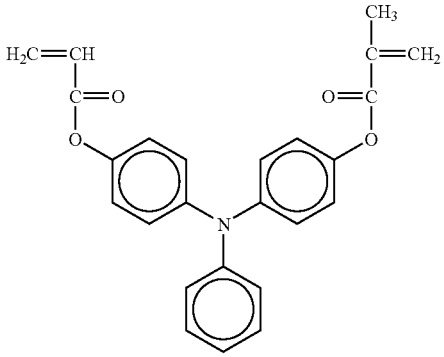

The cross-linked charge transport layer includes the radical-polymerizable compound having a charge transport structure components in an amount of from 20 to 80% by weight, and preferably from 30 to 70% by weight. When the amount is too small, the resultant cross-linked charge transport layer has poor charge transport ability, thereby degrading sensitivity and electric properties in repeated use. When the amount is too large, the resultant cross-linked charge transport layer includes too small an amount of the radical-polymerizable monomer having no charge transport structure, thereby reducing cross-linking density, that is, abrasion resistance. It is most preferable that the amount of the radical-polymerizable compound having a charge transport structure components is from 30 to 70% by weight in perspective.

As described above, it is most preferable to harden a trifunctional or more functional radical-polymerizable monomer having no charge transport structure and a monofunctional radical-polymerizable compound having a charge transport structure. In addition, monofunctional or difunctional radical-polymerizable monomers and oligomers can also be used.

Specific examples of suitable monofunctional radical-polymerizable monomers include, but are not limited to, 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxytriethylene glycol acrylate, phenoxytetraethylene glycol acrylate, cetyl acrylate, isostearyl acrylate, stearyl acrylate, and styrene monomer.

Specific examples of suitable difunctional radical-polymerizable monomers include, but are not limited to, 1,3-butanediol diacrylate, 1,4-butabediol diacrylate, 1,4-butanediol dimethacrylate, 1,6-hexanediol diacrylate, 1,6-hexanediol dimethacrylate, diethylene glycol diacrylate, neopentyl glycol diacrylate, bisphenol A EO-modified diacrylate, and bisphenol F EO-modified diacrylate.

Specific examples of suitable radical-polymerizable monomers further include, but are not limited to, fluorine-substituted monomers such as octafluoropentyl acrylate, 2-perfluorooctylethyl acrylate, 2-perfluorooctylethyl methacrylate, and 2-perfluoroisononylethyl acrylate; and vinyl monomers, acrylates, and methacrylates having polysiloxane groups such as acryloyl polydimethyl siloxane ethyl, methacryloyl polydimethyl siloxane ethyl, acryloyl polydimethyl siloxane propyl, acryloyl polydimethyl siloxane butyl, diacryloyl polydimethyl siloxane diethyl, which have siloxane repeating units of from 20 to 70, disclosed in JP-B 05-60503 and JP-B 06-45770.

Specific examples of suitable radical-polymerizable oligomers include, but are not limited to, epoxy acrylate oligomers, urethane acrylate oligomers, and polyester acrylate oligomers.

Description is now given of polymerization initiators. As described above, the cross-linked charge transport layer is formed by hardening a radical-polymerizable monomer having no charge transport structure, which is preferably trifunctional or more functional, and a radical-polymerizable compound having a charge transport structure, which is preferably monofunctional, upon application of at least one of heat, light, and ionizing radiation. At the time of hardening, a polymerization initiator may be optionally used to perform the hardening reaction effectively. In a case in which an ionizing radiation is applied, a cross-linking reaction can be generally performed without a polymerization initiator, and heat and/or light may be further applied to harden residual unhardened compositions. Even in this case, the following polymerization initiators can be used to perform the reaction effectively.

Specific examples of suitable thermal polymerization initiators include, but are not limited to, peroxide initiators such as 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3-di-t-butyl peroxide, t-butyl hydroperoxide, cumene hydroperoxide, and lauroyl peroxide; and azo initiators such as azobis isobutyronitrile, azobis cyclohexane carbonitrile, azobis methyl isobutyrate, azobis isobutylamidine hydrochloride, and 4,4'-azobis-4-cyano valeric acid.

Specific examples of suitable photopolymerization initiators include, but are not limited to, acetophenone and ketal initiators such as diethoxy acetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoine ether initiators such as benzoine, benzoine methyl ether, benzoine ethyl ether, benzoine isobutyl ether, and benzoine isopropyl ether; benzophenone initiators such as benzophenone, 4-hydroxy benzophenone, methyl o-benzoyl benzoate, 2-benzoyl naphthalene, 4-benzoyl biphenyl, 4-benzoyl phenyl ether, acrylic benzophenone, and 1,4-benzoyl benzene; thioxanthone initiators such as 2-isopropyl thioxanthone, 2-chloro thioxanthone, 2,4-dimethyl thioxanthone, 2,4-diethyl thioxanthone, and 2,4-dichloro thioxanthone; titanocene initiators such as bis(cyclopentadienyl)-dichloro-titanium, bis(cyclopentadienyl)-di-phenyl-titanium, bis(cyclopentadienyl)-bis(2,3,4,5,6-pentafluorophenyl)titanium, and bis(cyclopentadienyl)-bis(2,6-difluoro-3-(pyrrol-1-yl)phenyl)titanium; and other initiators such as ethyl anthraquinone, 2,4,6-trimethylbenzoyl diphenylphosphine oxide, 2,4,6-trimethylbenzoyl phenyl ethoxy phosphine oxide, bis(2,4,6-trimethylbenzoyl)phenylphosphine oxide, bis(2,4-dimethoxybenzoyl)-2,4,4-trimethylpentylphosphine oxide, methylphenyl glyoxylate, 9,10-phenanthrene, acridine compounds, triazine compounds, and imidazole compounds.

Compounds that accelerate the photopolymerization can be used in combination with the above-described photopolymerization initiators. Specific examples of such compounds include, but are not limited to, triethanolamine, methyl diethanolamine, ethyl 4-dimethylaminobenzoate, isoamyl 4-dimethylaminobenzoate, (2-dimethylamino)ethyl benzoate, and 4,4'-dimethylamino benzophenone.

These polymerization initiators can be used alone or in combination. The useful amount of the polymerization initiator is from 0.5 to 40 parts by weight, preferably from 1 to 20 parts by weight, based on 100 parts by weight of the radical-polymerizable compounds.

Description is now given of fillers. The cross-linked charge transport layer may include fine particles of filler (hereinafter "filler particles") for the purpose of improving abrasion resistance.

The filler particles preferably have an average primary particle diameter of from 0.1 to 0.5 μm, from the viewpoint of light transmittance and abrasion resistance of the resultant cross-linked charge transport layer. When the average primary particle diameter is too small, the filler particles may not finely dispersed in the resultant cross-linked charge transport layer, possibly degrading abrasion resistance. When the average primary particle diameter is too large, precipitation of the filler particles in a coating liquid may be aggravated, and toner particles may undesirably adhered to the resultant layer.

From the viewpoint of abrasion resistance, the amount of the filler in the cross-linked charge transport layer is as large as possible. However, too large an amount of filler may cause side effects such as increase of residual potential and decrease of light transmittance. A useful amount of the filler is preferably 50% or less by weight, and more preferably 30% or less by weight, based on total weight of solid components.

Further, the filler can be surface-treated with a surface treatment agent so as to improve dispersibility thereof. If the filler is not finely dispersed, significant problems such as increase of residual potential, decrease of transparency, film defect, and deterioration of abrasion resistance may be caused. A surface treatment agent that can maintain insulation of the filler is preferable.

A useful amount of the surface treatment depends on the average primary particle diameter of the filler, however, it is preferably from 5 to 20% by weight. When the amount is too small, the filler may not be finely dispersed. When the amount is too large, residual potential may considerably increase. The filler materials can be used alone or in combination.

Description is now given of other additives. A coating liquid for forming the cross-linked charge transport layer may optionally include additives such as a plasticizer (for the purpose of stress relaxation and increase of adhesion), a leveling agent, and a non-radical-polymerizable low-molecular-weight charge transport material. Specific examples of usable plasticizers include, but are not limited to, dibutyltin phthalate and dioctyl phthalate, which are typically used for resins. The amount of the plasticizer is preferably 20 parts or less by weight, and more preferably 10 parts or less by weight, based on 1 part by weight of solid components in the coating liquid. Specific examples of usable leveling agents include, but are not limited to, silicone oils such as dimethyl silicone oil and methylphenyl silicone oil, and polymers and oligomers having a perfluoroalkyl chain on a side chain thereof. The amount of the leveling agent is preferably 3 parts or less by weight based on total weight of solid components in the coating liquid.

Description is now given of method of preparing the cross-linked charge transport layer. The cross-linked charge transport layer is generally formed by applying a coating liquid containing a radical-polymerizable monomer having no charge transport structure, which is preferably trifunctional or more functional, and a radical-polymerizable compound having a charge transport structure, which is preferably monofunctional, on the photosensitive layer, followed by hardening. In a case in which the radical-polymerizable monomer is liquid, the coating liquid can be prepared by dissolving other components therein, optionally in combination with a solvent for diluting. Specific examples of usable solvents include, but are not limited to, alcohols such as methanol, ethanol, propanol, and butanol; ketones such as acetone, methyl ethyl ketone, methyl isobutyl ketone, and cyclohexanone; esters such as ethyl acetate and butyl acetate; ethers such as tetrahydrofuran, dioxane, and propyl ether; halogen solvents such as dichloromethane, dichloroethane, trichloroethane, and chlorobenzene; aromatic solvents such as benzene, toluene, and xylene; and cellosolves such as methyl cellosolve, ethyl cellosolve, and cellosolve acetate. These solvents can be used alone or in combination.

A suitable coating method may be selected considering the viscosity of the coating liquid and a desired thickness of the resultant cross-linked charge transport layer. For example, a dip coating method, a spray coating method, a bead coating method, and a ring coating method are preferable.

The coating liquid applied is then hardened upon application of energy such as heat energy, light energy, and ionizing radiation. There is a possibility that ionizing radiation degrades materials composing a photoreceptor because of its deep energy immersion and energy strength, resulting in deterioration of electrophotographic properties. Accordingly, heat energy and light energy are preferable. Light energy is more preferable because the amount of the solvent can be reduced and the strength of the cross-linked layer can be increased. Alternatively, 2 or more kinds of energies can be applied in combination.

Specific examples of the heat energies include, but are not limited to, gases such as air and nitrogen, vapors, heat media, infrared rays, and electromagnetic waves. The layer may be heated from either an application side or a substrate side. The heating temperature is preferably from 100 to 170° C. When the heating temperature is too low, the reaction speed may be too low, resulting in decrease of productivity. Moreover, unreacted materials may remain in the resultant layer. When the heating temperature is too high, the resultant layer may considerably contracts by cross-linking, resulting in formation of an orange-peel-like uneven surface and cracks. Further, the resultant layer may peels off from an adjacent layer. Moreover, volatile components in the photosensitive layer may dissipate in the air, thereby degrading electrophotographic properties. In a case in which the layer is considerably contracts by cross-linking, such a layer may be preliminarily cross-linked at a low temperature of less than 100° C. and subsequently at a high temperature of 100° C. or more to complete cross-linking.

Suitable light energies are emitted from light sources such as ultrahigh pressure mercury lamps, high pressure mercury lamps, low pressure mercury lamps, carbon-arc lamps, and xenon-arc metal halide lamps. A suitable light sources is selected considering absorption properties of the radical-polymerizable monomer having no charge transport structure, the radical-polymerizable compound having a charge transport structure, and the photopolymerization initiator, etc. The light source preferably emits a light having a wavelength of 365 nm at an illumination intensity of from 5 to 2000 $mW/cm^2$. More preferably, the light source emits a light having a maximum wavelength at the above-described illumination intensity. When the illumination intensity is too small, it takes a long time to complete hardening, decreasing productivity. When the illumination intensity is too large, the resultant layer may considerably contracts by cross-linking, resulting in formation of an orange-peel-like uneven surface and cracks. Further, the resultant layer may peels off from an adjacent layer.

Ionizing radiation has an ionization effect on a substance. Specific examples of the ionization radiations include, but are not limited to, direct ionization radiations such as alpha rays and electron beams and indirect ionization radiations such as X rays and neutron rays. Considering effects of radioactivity on the human body, electron beams are preferably used. Specific examples of usable electron beam irradiators include, but are not limited to, Cockcroft-Walton accelerator, van de Graaff accelerator, resonance transformer accelerator, insulated core transformer accelerator, linear accelerator, Dynamitron accelerator, and high-frequency accelerator. A suitable irradiance level may be determined depending on the thickness of the cross-linked charge transport layer. Preferably, the layer is irradiated with an electron having an energy of from 100 to 1000 keV, preferably from 100 to 3000 keV, at from 0.1 to 30 Mrad. When the irradiance level is too small, the electron beam may not reach inside of the cross-linked charge transport layer, resulting in insufficient hardening in deep portions of the layer. When the irradiance level is too large, the electron beam may reach the charge transport layer or the charge generation layer, possibly adversely affecting materials therein.

When the cross-linked charge transport layer is irradiated with UV or ionization radiation, the temperature thereof generally increases. If the temperature increases too much, problems may arise such that the cross-linked charge transport layer considerably contracts by hardening, and low-molecular-weight components in adjacent layers migrate to the cross-linked charge transport layer to inhibit hardening. As a result, electric properties of the photoreceptor deteriorate. Accordingly, the temperature of the cross-linked charge transport layer is preferably 100° C. or less, and more preferably 80° C. or less, when irradiated with UV etc. One possible method of cooling the layer involves enclosing an auxiliary cooling agent inside the photoreceptor. Another possible method involves cooling gases and liquids inside the photoreceptor.

After completion of hardening, the cross-linked charge transport layer may be further heated, as needed. For example, in a case in which a large amount of solvents remain in the layer, it is preferable to volatize the remaining solvents by heating so as to prevent deterioration of electric properties and time degradation.

The cross-linked charge transport layer preferably has a thickness of 1 to 15 μm, and more preferably 3 to 10 μm, from the viewpoint of protection of photoreceptor.

(Conductive Substrate)

Suitable materials for the conductive substrate include material having a volume resistivity not greater than $10^{10}$ Ω·cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, and endless nickel belt described in Examined Japanese Application Publication No. (hereinafter JP-B) 52-36016, the contents of which are incorporated herein by reference, and an endless stainless belt can be also used as the conductive substrate.

Furthermore, substrates, in which a conductive layer is formed on the above-described conductive substrates by applying a coating liquid including a binder resin and a conductive powder thereto, can be used as the conductive substrate. Specific examples of such conductive powders include, but are not limited to, carbon black, acetylene black, powders of metals such as aluminum, nickel, iron, nichrome, copper, zinc, and silver, and metal oxides such as conductive tin oxides and ITO.

Specific examples of the binder resins include known thermoplastic, thermal-cross-linking, and photo-cross-linking resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethylcellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins. Such a conductive layer can be formed by coating a coating liquid in which a conductive powder and a binder resin are dispersed or dissolved in a proper solvent such as tetrahydrofuran, dichloromethane, methyl ethyl ketone, toluene, and the like solvent, and then drying the coated liquid.

In addition, substrates, in which a conductive layer is formed on a surface of a cylindrical substrate using a heat-shrinkable tube which is made of a combination of a resin such as polyvinyl chloride, polypropylene, polyester, polystyrene, polyvinylidene chloride, polyethylene, chlorinated rubber, and polytetrafluoroethylene-based fluorocarbon resins, with a conductive powder, can also be used as the conductive substrate.

(Image Forming Apparatus)

Next, image forming apparatuses of the present invention will be explained in detail referring to drawings.

Figure 4:
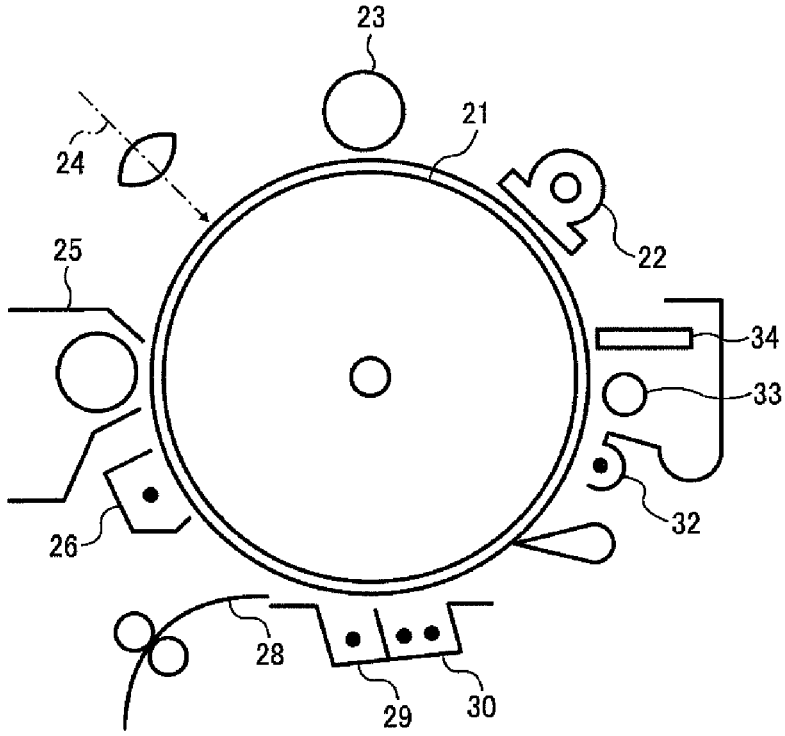
FIG. 4 is a schematic view illustrating an embodiment of an image forming apparatus of the present invention.

FIG. 4 is a schematic view illustrating an embodiment of an image forming apparatus of the present invention. A photoreceptor 21 illustrated in FIG. 4 has a drum-like shape, or alternatively that may have sheet-like or endless belt-like shapes. A charger 23, a pre-transfer charger 26, a transfer charger 29, a separation charger 30, and a pre-cleaning charger 32 each are one of known chargers such as a corotron charger, a scorotron charger, a solid state charger, a charging member having a roller shape, or a charging member having a brush shape.

Both non-contact charging methods such as corona discharge and contact charging methods using a roller or a brush are preferable. Because of producing much less ozone than corotron and scorotron chargers, charging rollers have advantages in reliable image formation and prevention of image deterioration. However, charging rollers are easily contaminated by a photoreceptor in repeated use, which results in abnormal images and deterioration of abrasion resistance. In particular, when a photoreceptor has high abrasion resistance, the surface thereof is difficult to reface by abrasion. Therefore, contamination of charging rollers should be much more decreased.

Figure 5:
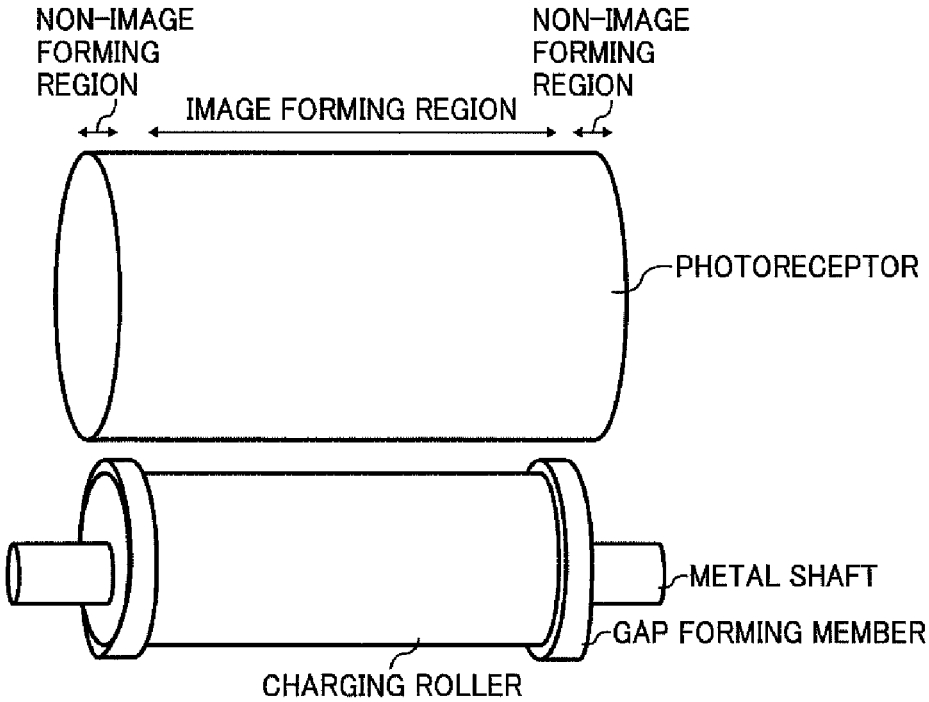
FIG. 5 is a schematic view illustrating an embodiment of a charging roller which forms a gap between a photoreceptor.

To solve such a problem, a gap may be formed between a charging roller and a photoreceptor as illustrated in FIG. 5. This configuration suppresses contamination of charging roller and facilitates removal of contaminants. The gap between the photoreceptor and the charging roller is preferably as small as possible such as 100 μm or less, and more preferably 50 μm or less. However, there is a possibility that the photoreceptor is charged unevenly and unreliably because the charging roller is not in contact with the photoreceptor. To solve this problem, direct current and alternate current may be overlapped so that chargeability may be kept stable regardless of influence of ozone and contamination of the charging roller.

An image irradiator 24 and a decharge lamp 22 each include a light source such as a fluorescent lamp, a tungsten lamp, a halogen lamp, a mercury lamp, a sodium lamp, a light emitting diode (LED), a laser diode (LD), and an electro luminescence (EL). Among these light sources, a laser diode (LD) and a light emitting diode (LED) are preferable. In order to obtain lights having a desired wavelength, filters such as sharp-cut filters, band pass filters, near-infrared filters, dichroic filters, interference filters, and color temperature converting filters can be used.

In addition to lights from the image irradiator 24 and the decharge lamp 22, the photoreceptor 21 may be exposed to lights in transfer, decharge, cleaning processes as appropriate. There is a possibility that light exposure in the decharge process may significantly fatigue the photoreceptor and cause decrease of charge or increase of residual potential. Therefore, the photoreceptor may be decharged by application of a reverse bias in the charging or cleaning processes, not by light exposure.

When the photoreceptor is positively (negatively) charged and exposed to light containing image information, a positive (negative) electrostatic latent image is formed on the photoreceptor. When the positive (negative) electrostatic latent image is developed with a negative (positive) toner, a positive toner image is formed. In contrast, when the positive (negative) electrostatic latent image is developed with a positive (negative) toner, a negative toner image is formed.

As illustrated in FIG. 4, a suitable transfer device includes a combination of the transfer charger 29 and the separation charger 30. In the present embodiment, the transfer device directly transfers a toner image from the photoreceptor 21 onto paper. Alternatively, a toner may be firstly transferred from a photoreceptor onto an intermediate transfer member and subsequently transferred from the intermediate transfer member onto paper. This process is so-called an intermediate transfer method which has advantages in durability of photoreceptors and image quality.

When contaminants such as discharge products, external additives of toner, and paper powder adhere to the photoreceptor, abnormal images are produced and abrasion resistance is decreased. Accordingly, the above-described configuration in which the photoreceptor is not in contact with paper is preferable for improving image quality.

Intermediate transfer methods are suitable for image forming apparatus for full-color printing. In intermediate transfer methods, multiple toner images are superimposed on an intermediate transfer member to form a composite toner image and the composite toner image is then transferred onto paper. Therefore, intermediate transfer methods have advantage in ease of color registration and formation of high quality images. However, since intermediate transfer methods require photoreceptors to be scanned for four times, photoreceptors are preferably have much higher durability. The photoreceptor of the present invention is unlikely to produce image blurring even without a drum heater. Accordingly, the photoreceptor of the present invention is suitable for intermediate transfer methods. A suitable intermediate transfer member may have any shape such as a drum shape or a belt shape and may be made of any material.

A toner image formed on the photoreceptor 21 by a developing unit 25 is transferred on a transfer paper 28. However, some toner particles may not be transferred and remain on the photoreceptor 21. Such residual toner particles are removed by a fur brush 33 and/or a blade 34 in a so-called cleaning process. In place of the far brush, any known brush such as a magnetic fur brush can also be used.

Since the photoreceptor 21 is repeatedly scratched by the fur brush 33 and/or the blade 34 in the cleaning process, abrasion of the photoreceptor 21 may be accelerated or scratches may be made thereon, resulting in abnormal images. In addition, when removal of residual toner particles is insufficient, not only abnormal images are produced but also the life span of the photoreceptor is shortened. It is much harder to remove residual toner particles when a photoreceptor having an outermost layer containing fillers for improving abrasion resistance, thereby accelerating formation of toner film and production of abnormal images. Accordingly, it is effective to sufficiently clean photoreceptors to improve durability and produce high quality images.

In order to more sufficiently clean a photoreceptor, the friction coefficient of the surface of the photoreceptor may be decreased. To decrease the friction coefficient of the surface of a photoreceptor, one possible method involves including a lubricant in the surface of the photoreceptor and another possible methods involves supplying a lubricant to the surface of the photoreceptor externally. The former method is suitable for small-diameter photoreceptors because being more flexible in layout around the photoreceptor. However, the former method has a problem in stability. In contrast, the latter method requires a component for supplying a lubricant but has high stability. In view of this fact, a lubricant is preferably included in a developer so that the lubricant is adhered to a photoreceptor when a latent image is developed with the developer. In this case, the friction coefficient of the photoreceptor is stably decreased without limitation in layout. Accordingly, high durability and high quality image can be provided.

Specific examples of usable lubricants include, but are not limited to, lubricant liquids such as silicone oils and fluorine oils; and lubricant solids and powders such as fluorocarbon resins such as PTFE, PFA, and PVDF, silicone resins, polyolefin resins, silicone greases, fluorine greases, paraffin waxes, fatty acid esters, metal salts of fatty acids (e.g., zinc stearate), graphite, and molybdenum disulfide. To be mixed with developers, lubricants in the form of powder are preferable, and zinc stearate is more preferable. A toner preferably includes zinc stearate in an amount of from 0.01 to 0.5% by weight, and more preferably from 0.1 to 0.3% by weight.

The photoreceptor of the present invention can be applied to small-diameter photoreceptors because of having high sensitivity, reliable chargeability, and reliable optical attenuation properties. Accordingly, the photoreceptor of the present invention is preferably applied to a tandem image forming apparatus that includes multiple developing units and corresponding multiple photoreceptors each of which proceeds in parallel. A typical tandem image forming apparatus contains four developing units each respectively contains yellow, magenta, cyan, and black toners and four photoreceptors corresponding to them, and provides high-speed full-color image formation.

Figure 6:
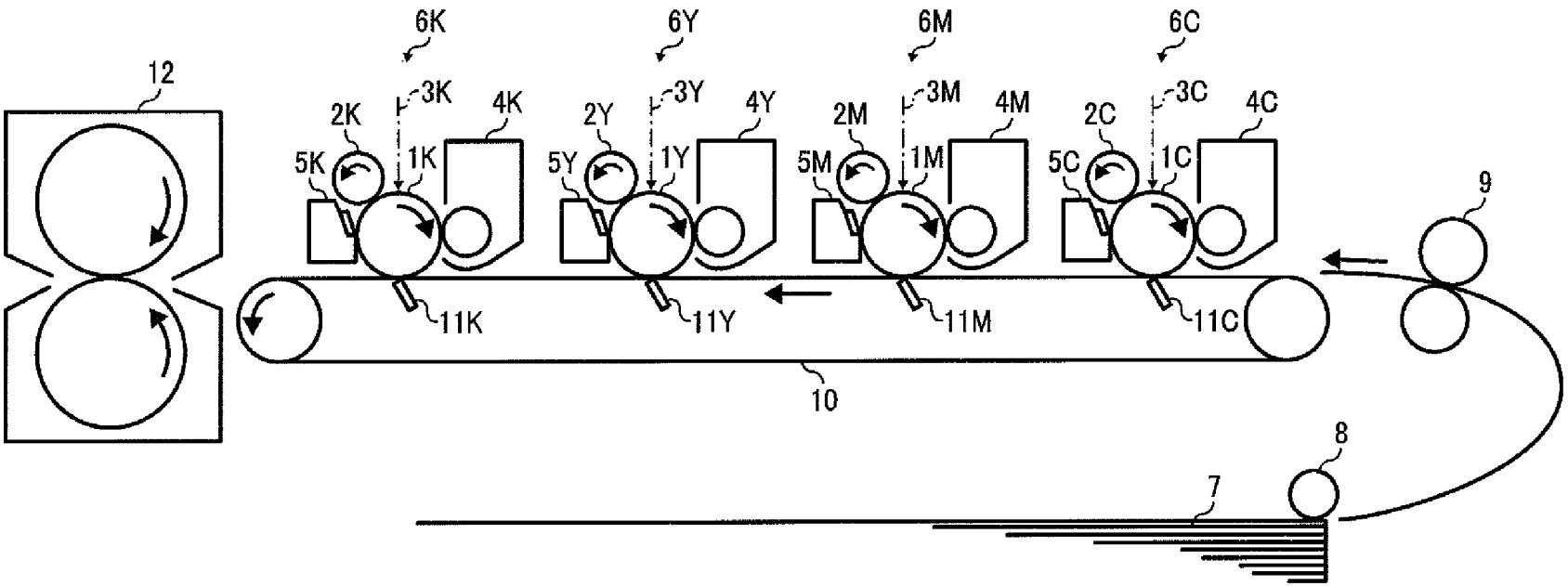
FIG. 6 is a schematic view illustrating a tandem full-color image forming apparatus according to the present invention.

FIG. 6 is a schematic view illustrating a tandem full-color image forming apparatus according to the present invention. Photoreceptors 1C, 1M, 1Y, and 1K are the photoreceptors of the present invention and each rotate clockwise in FIG. 6. Around the photoreceptors 1C, 1M, 1Y, and 1K, charging members 2C, 2M, 2Y, and 2K, developing members 4C, 4M, 4Y, and 4K, and cleaning members 5C, 5M, 5Y, and 5K are disposed, respectively. The charging members 2C, 2M, 2Y, and 2K are configured to evenly charge the photoreceptors 1C, 1M, 1Y, and 1K, respectively.

Surfaces of the photoreceptors 1C, 1M, 1Y, and 1K which are on downstream sides from the charging members 2C, 2M, 2Y, and 2K and upstream sides from the developing members 4C, 4M, 4Y, and 4K, respectively, relative to a direction of rotation of the photoreceptors are exposed to laser light beams 3C, 3M, 3Y, and 3K so that electrostatic latent images are formed thereon, respectively. Four images forming units 6C, 6M, 6Y, and 6K each including the photoreceptors 1C, 1M, 1Y, and 1K, the charging members 2C, 2M, 2Y, and 2K, the developing members 4C, 4M, 4Y, and 4K, and the cleaning members 5C, 5M, 5Y, and 5K, respectively, are arranged along a transfer conveyance belt 10. The transfer conveyance belt 10 is in contact with the photoreceptors 1C, 1M, 1Y, and 1K at portions on downstream sides of the developing members 4C, 4M, 4Y, and 4K and upstream sides of the cleaning members 5C, 5M, 5Y, and 5K, respectively, relative to a direction of rotation of the photoreceptors. Transfer brushes 11C, 11M, 11Y, and 11K configured to apply transfer biases are disposed on opposite sides of the photoreceptors 1C, 1M, 1Y, and 1K, respectively, relative to the transfer conveyance belt 10. The image forming units 6C, 6M, 6Y, and 6K have the same configuration except for containing different color toners.

In the full-color image forming apparatus illustrated in FIG. 6, an image forming operation is performed as follows. First, the photoreceptors 1C, 1M, 1Y, and 1K are respectively charged by the charging members 2C, 2M, 2Y, and 2K that are rotating counterclockwise, in other words, so as to follow the rotations of the photoreceptors. The photoreceptors 1C, 1M, 1Y, and 1K thus charged are then exposed to the laser light beams 3C, 3M, 3Y, and 3K, respectively, so that electrostatic latent images corresponding to each colors are formed thereon.

The electrostatic latent images are developed with cyan, magenta, yellow, and black toners in the developing members 4C, 4M, 4Y, and 4K, respectively, so that cyan, magenta, yellow, and black toner images are formed on the photoreceptors 1C, 1M, 1Y, and 1K, respectively. The cyan, magenta, yellow, and black toner images are then superimposed on a transfer paper 7. The transfer paper 7 is fed from a tray by a paper feeding roller 8 and is stopped at a pair of registration rollers 9. The transfer paper 7 is then fed onto the transfer conveyance belt 10 in synchronization with formation of toner images on the photoreceptors 1C, 1M, 1Y, and 1K so that the toner images are transferred onto the transfer paper 7 at their contact points.

At the time the toner images are transferred onto the transfer paper 7, transfer biases are applied to the transfer brushes 11C, 11M, 11Y, and 11K so that electric fields are formed between the photoreceptors 1C, 1M, 1Y, and 1K, respectively. The transfer paper 7 having four toner images superimposed thereon is then conveyed to a fixing device 12 so that the toner images are fixed, and discharged to a discharge part, not shown. Residual toner particles remaining on the photoreceptors 1C, 1M, 1Y, and 1K without being transferred are collected by the cleaning devices 5C, 5M, 5Y, and 5K.

The image forming units 6C, 6M, 6Y, and 6K are arranged in order of cyan, magenta, yellow, and black relative to a direction of conveyance of the transfer paper in FIG. 6, but the arrangement order is not limited thereto. A mechanism for stopping operations of the image forming units 6C, 6M, and 6Y when a black-and-white image is produced can be optionally provided. Although the charging members 2C, 2M, 2Y, and 2K are respectively in contact with the photoreceptors 1C, 1M, 1Y, and 1K in FIG. 6, a gap of about 10 to 200 μm may be formed therebetween as illustrated in FIG. 5 so that abrasion of the charging members and photoreceptors and formation of toner films on the charging members are suppressed.

The image forming member described above may be integrated into a process cartridge as well as a copier, a facsimile, and a printer. A suitable process cartridge contains a photoreceptor and at least one of a charger, an irradiator, a developing device, a transfer device, a cleaning device, and a decharge device.

Since tandem image forming apparatuses realize high-speed full-color image formation because of being capable of transferring multiple toner images at one time. On the other hand, tandem image forming apparatuses cannot help upsizing because at least four photoreceptors are mounted. Further, each of the photoreceptors may be abraded in a different level, resulting in poor color reproduction and abnormal images. The photoreceptor of the present invention has a small diameter which prevents upsizing, and high sensitivity which does not influenced by increase of residual potential. Accordingly, tandem image forming apparatuses using the photoreceptors of the present invention provide high quality full-color images even when the photoreceptors are abraded in different levels.

Figure 7:
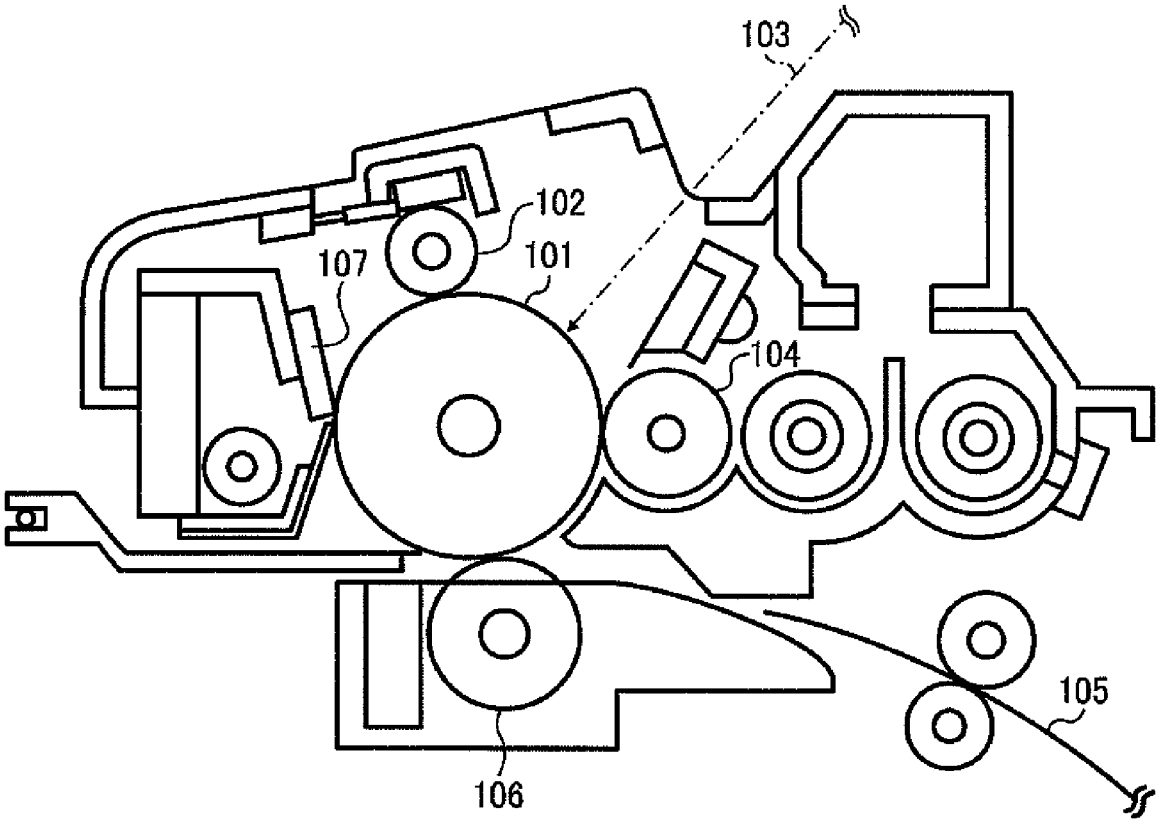
FIG. 7 is a schematic view illustrating an embodiment of a process cartridge of the present invention.

FIG. 7 is a schematic view illustrating an embodiment of a process cartridge of the present invention. This process cartridge includes a photoreceptor 101 according to the present invention, a charger 102, a developing device 104, a transfer device 106, and a cleaning device 107. A numeral 103 denotes a light beam containing image information and a numeral 105 denotes a transfer paper.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1 of Titanyl Phthalocyanine Pigment

A titanyl phthalocyanine pigment is prepared according to Example 1 of JP-A 2004-83859, the contents of which are herein incorporated by reference. Specifically, 292 parts of 1,3-diimonoisoindoline and 1,800 parts of sulfolane are mixed and 204 parts of titanium tetrabutoxide are added thereto under nitrogen gas flow. The mixture is heated to 180° C. and subjected to reaction for 5 hours at from 170 to 180° C. while being agitated. After the termination of the reaction, the mixture stands to cool. The deposited products are washed with chloroform until expressing blue color. The deposited products are further washed with methanol for several times and with hot water of 80° C. for several times, followed by drying. Thus, a crude titanyl phthalocyanine pigment is prepared.

Next, 60 parts of the crude titanyl phthalocyanine pigment is dissolved in 1,000 parts of a 96% sulfuric acid at from 3 to 5° C. under agitation, followed by filtration. The resultant sulfuric acid solution is added to 35,000 parts of ice water under agitation and the mixture is subjected to filtration so that the deposited crystal is separated. The deposited crystal is washed with water until washing liquid becomes neutral. Thus, an aqueous paste of a titanyl phthalocyanine pigment is prepared.

The aqueous paste is then strongly agitated with 1,500 parts of tetrahydrofuran using a HOMOMIXER (MARK f model from Kenis, Ltd.) at a revolution of 2,000 rpm at room temperature until the color of the paste changes from navy blue to pale blue, which takes about 20 minutes. After the termination of the agitation, the mixture is immediately subjected to filtration under a reduced pressure and the separated crystal is washed with tetrahydrofuran. Thus, 98 parts of a wet cake of a titanyl phthalocyanine pigment is prepared. The wet cake is dried at 70° C. for 2 days. Thus, 78 parts of a titanyl phthalocyanine pigment (1) is prepared.

Figure 8:
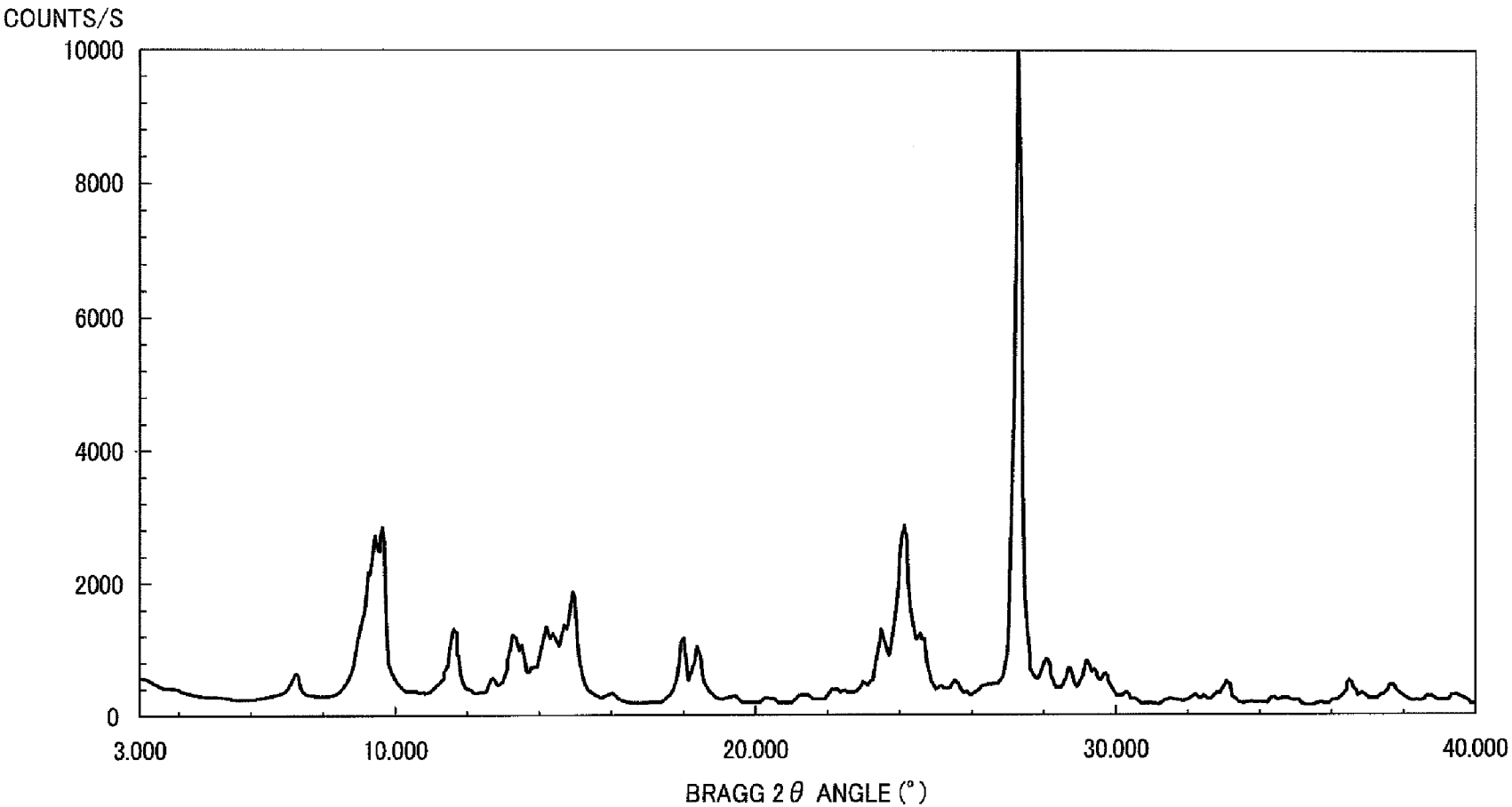
FIG. 8 is an X-ray diffraction spectrum of a titanyl phthalocyanine pigment for use in the present invention obtained using a characteristic X-ray specific to CuKα having a wavelength of 1.542 Å.

The titanyl phthalocyanine pigment (1) is subjected to a measurement of an X-ray diffraction spectrum using a characteristic X-ray specific to CuKα having a wavelength of 1.542 Å. As a result, the titanyl phthalocyanine pigment (1) has a maximum diffraction peak at 27.2±0.2°, a lowest-side-angle diffraction peak at 7.3±0.2°, main peaks at 9.4±0.2°, 9.6±0.2°, and 24.0±0.2°, and no diffraction peak within a range between 7.3° and 9.4° and at 26.3°, as diffraction peaks of Bragg angle 2θ. This result is shown in FIG. 8.

The X-ray diffraction spectrum is obtained under the following conditions:

X-ray tube: Cu
Voltage: 50 kV
Current: 30 mA
Scanning velocity: 2°/min
Scanning range: 3° to 40°
Time constant: 2 seconds

Comparative Synthesis Example 1 of Titanyl Phthalocyanine Pigment

An aqueous paste of a titanyl phthalocyanine pigment is prepared according to Synthesis Example 1. To perform crystal conversion, 40 parts of the aqueous paste is poured into 200 parts of tetrahydrofuran and the mixture is agitated for 4 hours, followed by filtration and drying. Thus, a titanyl phthalocyanine pigment (2) which has a larger primary particle diameter than the titanyl phthalocyanine pigment (1) is prepared. The wet cake includes 15% by weight of solid components, and solvents in an amount of 33 times the wet cake are used for crystal conversion. It should be noted that any raw material used for the synthesis includes no halogen compounds.

The titanyl phthalocyanine pigment (2) is subjected to a measurement of an X-ray diffraction spectrum in the same manner as Synthesis Example 1. As a result, the same spectrum as Synthesis Example 1 is obtained.

Measurement of Particle Diameter of Pigments

A part of the aqueous paste of the titanyl phthalocyanine pigment (1) prepared in Synthesis Example 1 is diluted with ion-exchange water so that the concentration of the pigment becomes 1% by weight. The pigment is scooped by a copper net, the surface of which is treated to have conductivity, and is observed with a transmission electron microscope (TEM H-9000NAR from Hitachi, Ltd.) at a magnification of 75,000 times. The average diameter is measured as follows.

The phthalocyanine pigment thus observed is photographed, and 30 particles of phthalocyanine pigments (which has a needle-like shape) are randomly selected from the photograph to be subjected to a measurement of a major diameter. The arithmetic average of the randomly-selected 30 major diameters is defined as an average primary particle diameter. The aqueous paste prepared in Synthesis Example 1 has an average particle diameter of 0.06 μm.

In addition, the titanyl phthalocyanine pigments which have been subjected to crystal conversion but is immediately before being subjected to filtration in Comparative Synthesis Example 1 and Synthesis Example 1 are diluted with tetrahydrofuran so that the concentration of the pigment becomes 1% by weight. The pigments are observed with a TEM in the same manner. The results are shown in Table 3. Not all the crystals in both phthalocyanine pigments prepared in Comparative Synthesis Example 1 and Synthesis Example 1 have the same shape. They have substantially triangular or tetragonal shapes. For convenience, a longest diagonal of such a crystal is regarded as a major axis.

TABLE 3

| | Average Particle Diameter (μm) | Remarks |
|---|---|---|
| Comparative Synthesis Example 1 (Pigment (2)) | 0.31 | Coarse particles having a diameter of from 0.3 to 0.4 μm are included. |
| Synthesis Example 1 (Pigment (1)) | 0.15 | Crystal particles have approximately the same size. |

Preparation of Charge Generation Layer Coating Liquid 1

The following components are subjected to a dispersion treatment using a bead mill disperser (VMA-GETZMANN from GmbH with DISPERMAT SL-C-Ex 5-200).

| | |
|---|---|
| Titanyl phthalocyanine pigment (1) | 55 parts |
| Polyvinyl butyral (BX-1 from Sekisui Chemical Co., Ltd.) | 10 parts |
| 2-Butanone | 500 parts |

More specifically, a solution in which the polyvinyl butyral is dissolved in the 2-butanone and the titanyl phthalocyanine pigment (1) are poured in the bead mill disperser, and subjected to a dispersion treatment at a revolution of 3,000 rpm using zirconia beads with a diameter of 0.5 mm. The volume average particle diameter of the pigment is measured using a particle diameter analyzer using gravitational and centrifugal acceleration CAPA-700 from Horiba, Ltd. Further, 1,250 parts of 2-butanone are poured into the bead mill disperser. Thus, a charge generation layer coating liquid (1) is prepared.

Preparation of Charge Generation Layer Coating Liquid 2

The procedure for preparation of the charge generation layer coating liquid (1) is repeated except that the components are changed as follows. Thus, a charge generation layer coating liquid (2) is prepared.

| | |
|---|---|
| Titanyl phthalocyanine pigment (1) | 40 parts |
| Polyvinyl butyral (BX-1 from Sekisui Chemical Co., Ltd.) | 10 parts |
| 2-Butanone | 500 parts |

Preparation of Charge Generation Layer Coating Liquid 3

The procedure for preparation of the charge generation layer coating liquid (1) is repeated except that the components are changed as follows. Thus, a charge generation layer coating liquid (3) is prepared.

| | |
|---|---|
| Titanyl phthalocyanine pigment (1) | 30 parts |
| Polyvinyl butyral (BX-1 from Sekisui Chemical Co., Ltd.) | 10 parts |
| 2-Butanone | 500 parts |

Preparation of Charge Generation Layer Coating Liquid 4

The procedure for preparation of the charge generation layer coating liquid (1) is repeated except that the components are changed as follows. Thus, a charge generation layer coating liquid (4) is prepared.

| | |
|---|---|
| Titanyl phthalocyanine pigment (1) | 25 parts |
| Polyvinyl butyral (BX-1 from Sekisui Chemical Co., Ltd.) | 10 parts |
| 2-Butanone | 500 parts |

Preparation of Charge Generation Layer Coating Liquid 5

The procedure for preparation of the charge generation layer coating liquid (1) is repeated except that the components are changed as follows. Thus, a charge generation layer coating liquid (5) is prepared.

| | |
|---|---|
| Titanyl phthalocyanine pigment (1) | 40 parts |
| Polyvinyl butyral (BH-3 from Sekisui Chemical Co., Ltd.) | 10 parts |
| 2-Butanone | 500 parts |

Preparation of Charge Generation Layer Coating Liquid 6

The procedure for preparation of the charge generation layer coating liquid (1) is repeated except that the components are changed as follows. Thus, a charge generation layer coating liquid (6) is prepared.

| | |
|---|---|
| Titanyl phthalocyanine pigment (1) | 40 parts |
| Polyvinyl butyral (BH-S from Sekisui Chemical Co., Ltd.) | 10 parts |
| 2-Butanone | 500 parts |

Preparation of Charge Generation Layer Coating Liquid 7

The procedure for preparation of the charge generation layer coating liquid (1) is repeated except that the components are changed as follows. Thus, a charge generation layer coating liquid (7) is prepared.

| | |
|---|---|
| Titanyl phthalocyanine pigment (1) | 40 parts |
| Polyvinyl butyral (BL-1 from Sekisui Chemical Co., Ltd.) | 10 parts |
| 2-Butanone | 500 parts |

Preparation of Charge Generation Layer Coating Liquid 8

The procedure for preparation of the charge generation layer coating liquid (1) is repeated except that the components are changed as follows. Thus, a charge generation layer coating liquid (8) is prepared.

| | |
|---|---|
| Titanyl phthalocyanine pigment (1) | 40 parts |
| Polyvinyl butyral (BM-1 from Sekisui Chemical Co., Ltd.) | 10 parts |
| 2-Butanone | 500 parts |

Preparation of Charge Generation Layer Coating Liquid 9

The procedure for preparation of the charge generation layer coating liquid (1) is repeated except that the components are changed as follows. Thus, a charge generation layer coating liquid (9) is prepared.

| | |
|---|---|
| Titanyl phthalocyanine pigment (1) | 10 parts |
| Polyvinyl butyral (BX-1 from Sekisui Chemical Co., Ltd.) | 10 parts |
| 2-Butanone | 500 parts |

Preparation of Charge Generation Layer Coating Liquid 10

The procedure for preparation of the charge generation layer coating liquid (1) is repeated except that the components are changed as follows. Thus, a charge generation layer coating liquid (10) is prepared.

| | |
|---|---|
| Titanyl phthalocyanine pigment (1) | 15 parts |
| Polyvinyl butyral (BX-1 from Sekisui Chemical Co., Ltd.) | 10 parts |
| 2-Butanone | 500 parts |

Preparation of Charge Generation Layer Coating Liquid 11

The procedure for preparation of the charge generation layer coating liquid (1) is repeated except that the components are changed as follows. Thus, a charge generation layer coating liquid (11) is prepared.

| | |
|---|---|
| Titanyl phthalocyanine pigment (1) | 20 parts |
| Polyvinyl butyral (BX-1 from Sekisui Chemical Co., Ltd.) | 10 parts |
| 2-Butanone | 500 parts |

Preparation of Charge Generation Layer Coating Liquid 12

The procedure for preparation of the charge generation layer coating liquid (1) is repeated except that the components are changed as follows. Thus, a charge generation layer coating liquid (12) is prepared.

| | |
|---|---|
| Titanyl phthalocyanine pigment (1) | 60 parts |
| Polyvinyl butyral (BX-1 from Sekisui Chemical Co., Ltd.) | 10 parts |
| 2-Butanone | 500 parts |

Preparation of Charge Generation Layer Coating Liquid 13

The procedure for preparation of the charge generation layer coating liquid (2) is repeated except that the components are changed as follows. Thus, a charge generation layer coating liquid (13) is prepared.

| | |
|---|---|
| Titanyl phthalocyanine pigment (2) | 40 parts |
| Polyvinyl butyral (BX-1 from Sekisui Chemical Co., Ltd.) | 10 parts |
| 2-Butanone | 500 parts |

Properties of the binder resins used for the above-prepared charge generation coating liquids are shown in Table 4.

TABLE 4

| | | In Formula (3) | | |
|---|---|---|---|---|
| | Average Molecular Weight | a + b | c | d |
| BX-1 | 100,000 | 0.66 | 0.03 | 0.33 |
| BH-3 | 110,000 | 0.65 | 0.03 | 0.34 |
| BH-S | 66,000 | 0.73 | 0.06 | 0.22 |
| BL-1 | 19,000 | 0.63 | 0.03 | 0.36 |
| BM-1 | 40,000 | 0.65 | 0.03 | 0.34 |

The average particle diameters of the titanyl phthalocyanine pigments in the above-prepared charge generation coating liquids are shown in Table 5.

TABLE 5

| Charge Generation Layer Coating Liquid No. | Pigment No. | Average Particle Diameter (μm) |
|---|---|---|
| 1 | 1 | 0.22 |
| 2 | 1 | 0.21 |
| 3 | 1 | 0.23 |
| 4 | 1 | 0.24 |
| 5 | 1 | 0.23 |
| 6 | 1 | 0.31 |
| 7 | 1 | 0.33 |
| 8 | 1 | 0.28 |
| 9 | 1 | 0.26 |
| 10 | 1 | 0.19 |
| 11 | 1 | 0.22 |
| 12 | 1 | 0.35 |
| 13 | 2 | 0.36 |

Photoreceptor Example 1

An intermediate layer coating liquid including 5 parts of N-methoxymethylated nylon (FR101 from Namariichi Co., Ltd,), 70 parts of methanol, and 30 parts of n-butanol is applied on an aluminum cylinder having a diameter of 30 mm, serving as a conductive substrate, and dried for 20 minutes at 130° C. Thus, an intermediate layer having a thickness of about 0.8 μm is formed.

An undercoat layer coating liquid including 55 parts of a titanium oxide (CR-EL from Ishihara Sangyo Kaisha Ltd., having an average primary diameter of about 0.25 μm), 35 parts of another titanium oxide (PT-401M from Ishihara Sangyo Kaisha Ltd., having an average primary diameter of about 0.07 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone is applied on the intermediate layer and dried for 20 minutes at 130° C. Thus, an undercoat layer having a thickness of about 3.5 μm is formed.

The charge generation layer coating liquid (1) prepared above is applied on the undercoat layer and dried for 20 minutes at 95° C. Thus, a charge generation layer is formed.

The thickness of the charge generation layer is controlled so that the transmittance at 780 nm is 20%. Specifically, the charge generation layer coating liquid is applied on an aluminum cylinder covered with a polyethylene terephthalate film in the same manner as above, and the resultant film is subjected to a measurement of transmittance at 780 nm using a commercially available spectrophotometer (UV-3100 from Shimadzu Corporation) with a blank polyethylene terephthalate film as a reference.

A charge transport layer coating liquid including 10 parts of a bisphenol Z polycarbonate (PANLITE TS-2050 from Teijin Chemicals Ltd.), 10 parts of a charge transport material having the following formula (CTL-1), 1 part of a charge transport material having the following formula (CTL-2), 0.5 parts of an antioxidant having the following formula (AO), 80 parts of tetrahydrofuran, and 0.2 parts of a 1% tetrahydrofuran solution of a silicone oil (KF-50-1CS from Shin-Etsu Chemical Co., Ltd.) is applied on the charge generation layer and dried for 20 minutes at 120° C. Thus, a charge transport layer having a thickness of about 23 μm is formed.

(CTL-1)

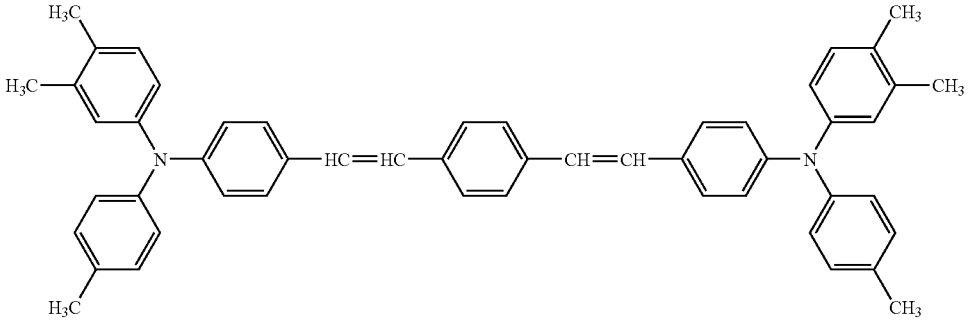

(CTL-2)

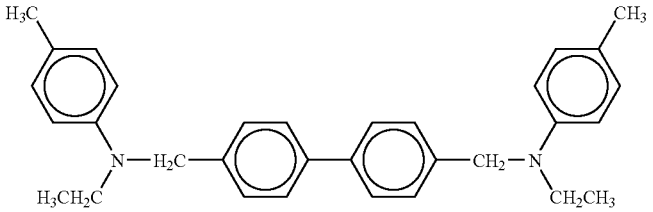

(AO)

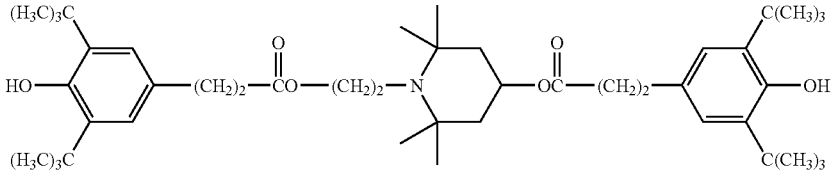

Photoreceptor Example 2

The procedure for preparation of the photoreceptor in Photoreceptor Example 1 is repeated except that the charge generation layer coating liquid (1) is replaced with the charge generation layer coating liquid (2).

Photoreceptor Example 3

The procedure for preparation of the photoreceptor in Photoreceptor Example 1 is repeated except that the charge generation layer coating liquid (1) is replaced with the charge generation layer coating liquid (3).

Photoreceptor Example 4

The procedure for preparation of the photoreceptor in Photoreceptor Example 1 is repeated except that the charge generation layer coating liquid (1) is replaced with the charge generation layer coating liquid (4).

Photoreceptor Example 5

The procedure for preparation of the photoreceptor in Photoreceptor Example 2 is repeated except that the charge transport material (CTL-1) is replaced with a charge transport material (CTL-3).

(CTL-3)

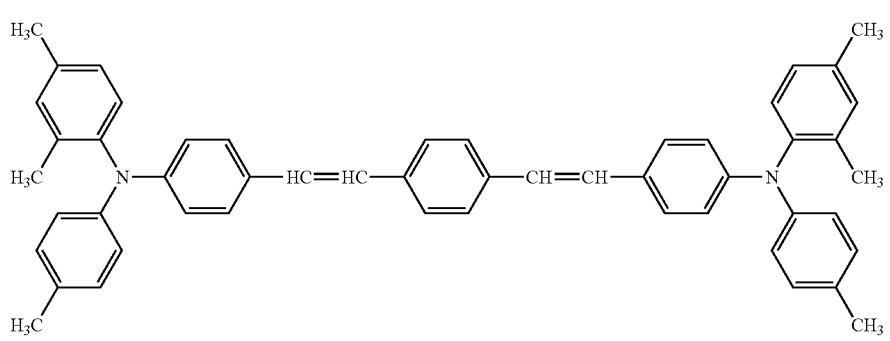

Photoreceptor Example 6

The procedure for preparation of the photoreceptor in Photoreceptor Example 2 is repeated except that the charge transport material (CTL-1) is replaced with a charge transport material (CTL-4).

(CTL-4)

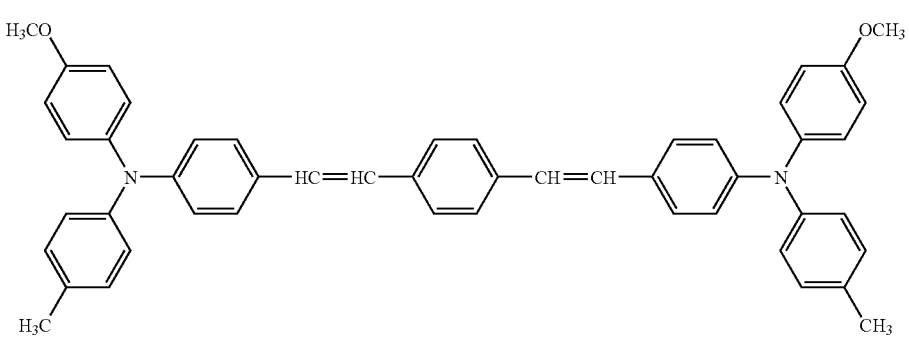

Photoreceptor Example 7

The procedure for preparation of the photoreceptor in Photoreceptor Example 2 is repeated except that the charge transport material (CTL-1) is replaced with a charge transport material (CTL-5).

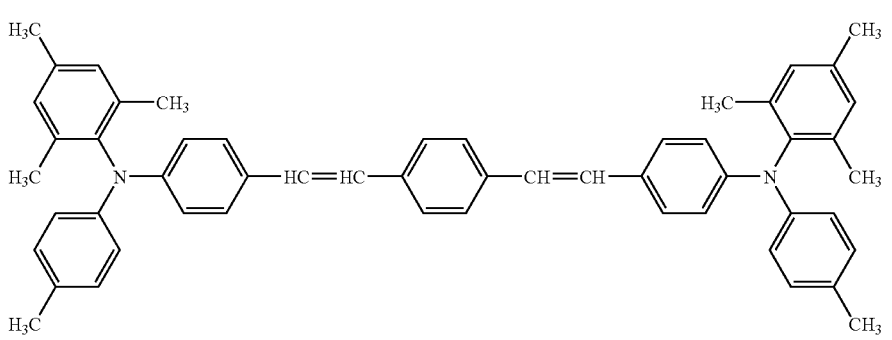

Photoreceptor Example 8

The procedure for preparation of the photoreceptor in Photoreceptor Example 2 is repeated except that the charge transport material (CTL-1) is replaced with a charge transport material (CTL-6).

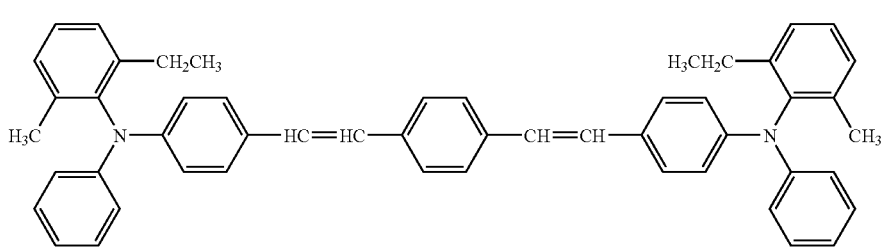

Photoreceptor Example 9

The procedure for preparation of the photoreceptor in Photoreceptor Example 1 is repeated except that the charge generation layer coating liquid (1) is replaced with the charge generation layer coating liquid (5).

Photoreceptor Example 10

The procedure for preparation of the photoreceptor in Photoreceptor Example 1 is repeated except that the charge generation layer coating liquid (1) is replaced with the charge generation layer coating liquid (6).

Photoreceptor Example 11

The procedure for preparation of the photoreceptor in Photoreceptor Example 1 is repeated except that the charge generation layer coating liquid (1) is replaced with the charge generation layer coating liquid (7).

Photoreceptor Example 12

The procedure for preparation of the photoreceptor in Photoreceptor Example 1 is repeated except that the charge generation layer coating liquid (1) is replaced with the charge generation layer coating liquid (8).

Photoreceptor Example 13

The procedure for preparation of the photoreceptor in Photoreceptor Example 2 is repeated except that the intermediate layer is not formed.

Photoreceptor Example 14

The procedure for preparation of the photoreceptor in Photoreceptor Example 2 is repeated except that the charge transport material (CTL-2) is not included in the charge transport layer coating liquid.

Photoreceptor Example 15

The procedure for preparation of the photoreceptor in Photoreceptor Example 2 is repeated except that the antioxidant (AO) is not included in the charge transport layer coating liquid.

Photoreceptor Example 16

The procedure for preparation of the photoreceptor in Photoreceptor Example 2 is repeated except that the undercoat layer coating liquid is replaced with another undercoat layer coating liquid including 50 parts of a titanium oxide (CR-EL from Ishihara Sangyo Kaisha Ltd., having an average primary diameter of about 0.25 μm), 30 parts of another titanium oxide (PT-401M from Ishihara Sangyo Kaisha Ltd., having an average primary diameter of about 0.07 μm), 30 parts of an alkyd resin (BECKOLITE M6401-50-S from DIC Corporation, containing 50% of solid components), 17 parts of a melamine resin (L-145-60 from DIC Corporation, containing 60% of solid components), and 80 parts of 2-butanone.

Photoreceptor Example 18

The procedure for preparation of the photoreceptor in Photoreceptor Example 2 is repeated except that the undercoat layer coating liquid is replaced with another undercoat layer coating liquid including 54 parts of a titanium oxide (CR-EL from Ishihara Sangyo Kaisha Ltd., having an average primary diameter of about 0.25 μm), 35 parts of another titanium oxide (PT-501A from Ishihara Sangyo Kaisha Ltd., having an average primary diameter of about 0.10 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Photoreceptor Example 19

The procedure for preparation of the photoreceptor in Photoreceptor Example 2 is repeated except that the charge transport material (CTL-1) is replaced with the following compound:

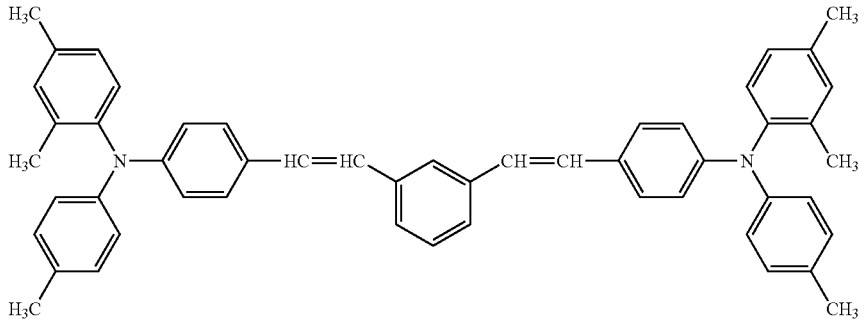

Photoreceptor Example 21

The procedure for preparation of the photoreceptor in Photoreceptor Example 5 is repeated except that the charge generation layer coating liquid (2) is replaced with a charge generation layer coating liquid (4).

Photoreceptor Example 22

The procedure for preparation of the photoreceptor in Photoreceptor Example 5 is repeated except that the charge generation layer coating liquid (2) is replaced with a charge generation layer coating liquid (1).

Photoreceptor Example 23

The procedure for preparation of the photoreceptor in Photoreceptor Example 14 is repeated except that the charge generation layer coating liquid (2) is replaced with a charge generation layer coating liquid (4).

Photoreceptor Example 24

The procedure for preparation of the photoreceptor in Photoreceptor Example 23 is repeated except that a cross-linked protective layer is further formed on the charge transport layer as follows.

A protective layer coating liquid including 10 parts of a radical-polymerizable monomer having no charge transport structure, which is a trimethylolpropane triacrylate (KAT-ARAD TMPTA from Nippon Kayaku Co., Ltd., wherein the molecular weight is 296, the number of functional groups is 3, and the ratio of the molecular weight to the number of functional groups is 99), 10 parts of a radical-polymerizable compound having a charge transport structure represented by the following formula, 1 parts if a photopolymerization initiator, which is 1-hydroxy-cyclohexyl-phenyl-ketone (IRGACURE 184 from Ciba Specialty Chemicals Inc.), and 100 parts of tetrahydrofuran is applied on the charge transport layer, and exposed to a light beam emitted from a UV lamp with H bulb (from Fusion UV Systems Japan KK) at a power of 200 W/cm and an intensity of 450 mW/cm$^2$ for 30 seconds, followed by drying for 20 minutes at 130° C.

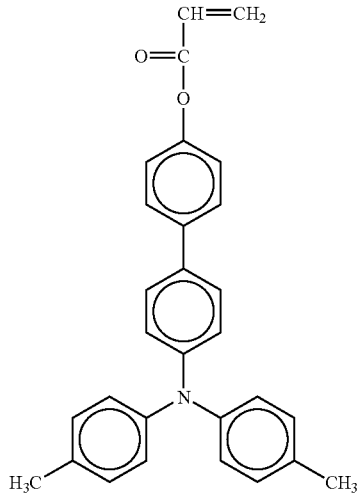

Photoreceptor Example 25

The procedure for preparation of the photoreceptor in Photoreceptor Example 24 is repeated except that radical-polymerizable compound having a charge transport structure is replaced with another compound having the following formula:

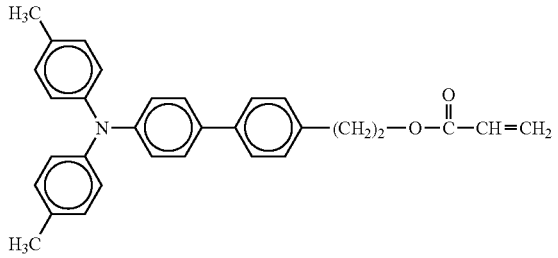

Photoreceptor Example 26

The procedure for preparation of the photoreceptor in Photoreceptor Example 23 is repeated except that a cross-linked protective layer is further formed on the charge transport layer as follows.

A protective layer coating liquid including 3 parts of an α-alumina (SUMICORUNDUM AA03 from Sumitomo Chemical Co., Ltd., having an average primary diameter of 0.3 μm and a specific resistance of $10^{10}$ Ω·cm or more), 0.03 parts of a humectant disperser BYK-P104 from BYK Chemie (an unsaturated polycarboxylic acid polymer solution having an acid value of 180 mgKOH/g and including solid components in an amount of 50% by weight), 7 parts of a charge transport material having the following formula, 10 parts of a polycarbonate (Z polycarbonate from Teijin Chemicals Ltd.), 370 parts of tetrahydrofuran, and 100 parts of cyclohexanone is spray-coated on the charge transport layer, followed by drying in an oven at 150° C. for 20 minutes. This operation is repeated 3 times so that a protective layer having a thickness of 5 μm is formed.

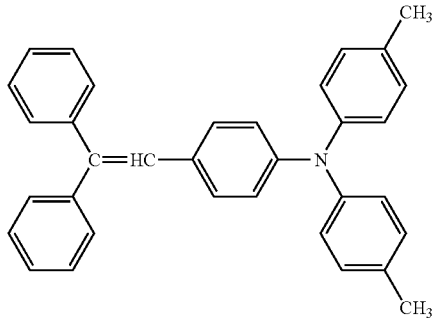

Comparative Photoreceptor Example 1

The procedure for preparation of the photoreceptor in Photoreceptor Example 1 is repeated except that the charge generation layer coating liquid (1) is replaced with the charge generation layer coating liquid (9).

Comparative Photoreceptor Example 2

The procedure for preparation of the photoreceptor in Photoreceptor Example 1 is repeated except that the charge generation layer coating liquid (1) is replaced with the charge generation layer coating liquid (10).

Comparative Photoreceptor Example 3

The procedure for preparation of the photoreceptor in Photoreceptor Example 1 is repeated except that the charge generation layer coating liquid (1) is replaced with the charge generation layer coating liquid (11).

Comparative Photoreceptor Example 4

The procedure for preparation of the photoreceptor in Photoreceptor Example 1 is repeated except that the charge generation layer coating liquid (1) is replaced with the charge generation layer coating liquid (12).

Comparative Photoreceptor Example 5

The procedure for preparation of the photoreceptor in Photoreceptor Example 2 is repeated except that the charge transport material (CTL-1) is replaced with a charge transport material (CTL-7).

(CTL-7)

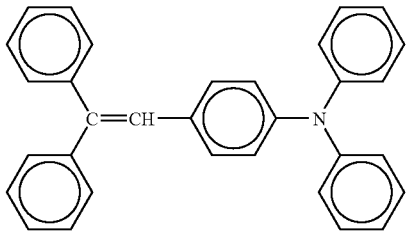

Comparative Photoreceptor Example 6

The procedure for preparation of the photoreceptor in Photoreceptor Example 2 is repeated except that the charge transport material (CTL-1) is replaced with a charge transport material (CTL-8).

(CTL8)

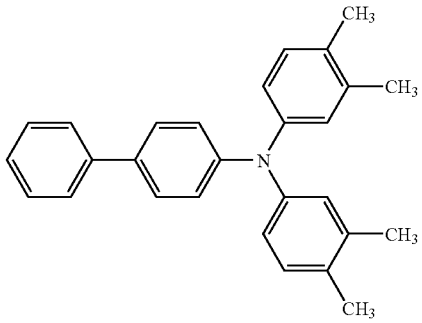

Comparative Photoreceptor Example 7

The procedure for preparation of the photoreceptor in Photoreceptor Example 2 is repeated except that the charge transport material (CTL-1) is replaced with a charge transport material (CTL-9).

(CTL-9)

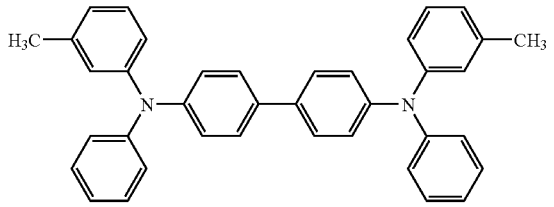

Comparative Photoreceptor Example 8

The procedure for preparation of the photoreceptor in Photoreceptor Example 2 is repeated except that the charge transport material (CTL-1) is replaced with a charge transport material (CTL-10).

(CTL-10)

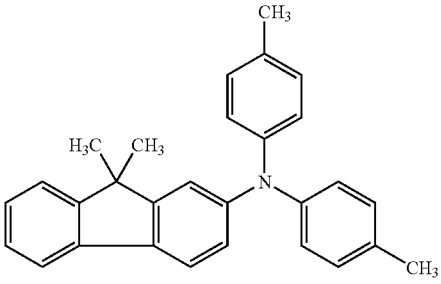

Comparative Photoreceptor Example 9

The procedure for preparation of the photoreceptor in Photoreceptor Example 1 is repeated except that the charge generation layer coating liquid (1) is replaced with the charge generation layer coating liquid (13).

Comparative Photoreceptor Example 10

The procedure for preparation of the photoreceptor in Photoreceptor Example 2 is repeated except that the undercoat layer coating liquid is replaced with another undercoat layer coating liquid including 55 parts of a titanium oxide (CR-EL from Ishihara Sangyo Kaisha Ltd., having an average primary diameter of about 0.25 μm), 40 parts of another titanium oxide (PT-401M from Ishihara Sangyo Kaisha Ltd., having an average primary diameter of about 0.07 μm), 12 parts of an alkyd resin (BECKOLITE M6401-50-S from DIC Corporation, containing 50% of solid components), 5 parts of a melamine resin (L-145-60 from DIC Corporation, containing 60% of solid components), and 80 parts of 2-butanone.

Comparative Photoreceptor Example 11

The procedure for preparation of the photoreceptor in Photoreceptor Example 2 is repeated except that the undercoat layer coating liquid is replaced with another undercoat layer coating liquid including 45 parts of a titanium oxide (CR-EL from Ishihara Sangyo Kaisha Ltd., having an average primary diameter of about 0.25 μm), 30 parts of another titanium oxide (PT-401M from Ishihara Sangyo Kaisha Ltd., having an average primary diameter of about 0.07 μm), 40 parts of an alkyd resin (BECKOLITE M6401-50-S from DIC Corporation, containing 50% of solid components), 17 parts of a melamine resin (L-145-60 from DIC Corporation, containing 60% of solid components), and 80 parts of 2-butanone.

Comparative Photoreceptor Example 12

The procedure for preparation of the photoreceptor in Photoreceptor Example 2 is repeated except that the undercoat layer coating liquid is replaced with another undercoat layer coating liquid including 55 parts of a titanium oxide (PT-501R from Ishihara Sangyo Kaisha Ltd., having an average primary diameter of about 0.18 μm), 35 parts of another titanium oxide (PT-401M from Ishihara Sangyo Kaisha Ltd., having an average primary diameter of about 0.07 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Comparative Photoreceptor Example 13

The procedure for preparation of the photoreceptor in Photoreceptor Example 2 is repeated except that the undercoat layer coating liquid is replaced with another undercoat layer coating liquid including 90 parts of a titanium oxide (PT-401M from Ishihara Sangyo Kaisha Ltd., having an average primary diameter of about 0.07 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Comparative Photoreceptor Example 14

The procedure for preparation of the photoreceptor in Photoreceptor Example 2 is repeated except that the undercoat layer coating liquid is replaced with another undercoat layer coating liquid including 55 parts of a titanium oxide (CR-EL from Ishihara Sangyo Kaisha Ltd., having an average primary diameter of about 0.25 μm), 35 parts of another titanium oxide (PT-501R from Ishihara Sangyo Kaisha Ltd., having an average primary diameter of about 0.18 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Comparative Photoreceptor Example 15

The procedure for preparation of the photoreceptor in Photoreceptor Example 25 is repeated except that the charge generation layer coating liquid (4) is replaced with a charge generation layer coating liquid (10).

Comparative Photoreceptor Example 16

The procedure for preparation of the photoreceptor in Photoreceptor Example 25 is repeated except that the undercoat layer coating liquid is replaced with another undercoat layer coating liquid including 45 parts of a titanium oxide (CR-EL from Ishihara Sangyo Kaisha Ltd., having an average primary diameter of about 0.25 μm), 30 parts of another titanium oxide (PT-401M from Ishihara Sangyo Kaisha Ltd., having an average primary diameter of about 0.07 μm), 40 parts of an alkyd resin (BECKOLITE M6401-50-S from DIC Corporation, containing 50% of solid components), 17 parts of a melamine resin (L-145-60 from DIC Corporation, containing 60% of solid components), and 80 parts of 2-butanone.

Comparative Photoreceptor Example 17

The procedure for preparation of the photoreceptor in Photoreceptor Example 25 is repeated except that the undercoat layer coating liquid is replaced with another undercoat layer coating liquid including 55 parts of a titanium oxide (PT-501R from Ishihara Sangyo Kaisha Ltd., having an average primary diameter of about 0.18 μm), 35 parts of another titanium oxide (PT-401M from Ishihara Sangyo Kaisha Ltd., having an average primary diameter of about 0.07 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Comparative Photoreceptor Example 18

The procedure for preparation of the photoreceptor in Photoreceptor Example 25 is repeated except that the undercoat layer coating liquid is replaced with another undercoat layer coating liquid including 55 parts of a titanium oxide (CR-EL from Ishihara Sangyo Kaisha Ltd., having an average primary diameter of about 0.25 μm), 35 parts of another titanium oxide (PT-501R from Ishihara Sangyo Kaisha Ltd., having an average primary diameter of about 0.18 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Comparative Photoreceptor Example 19

The procedure for preparation of the photoreceptor in Photoreceptor Example 25 is repeated except that the charge transport material (CTL-1) is replaced with the charge transport material (CTL-7) having the following formula:

(CTL-7)

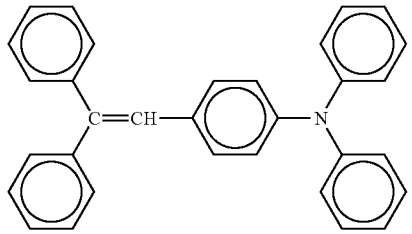

Comparative Photoreceptor Example 20

The procedure for preparation of the photoreceptor in Photoreceptor Example 13 is repeated except that the undercoat layer coating liquid is replaced with another undercoat layer coating liquid including 55 parts of a titanium oxide (PT-501R from Ishihara Sangyo Kaisha Ltd., having an average primary diameter of about 0.18 μm), 35 parts of another titanium oxide (PT-401M from Ishihara Sangyo Kaisha Ltd., having an average primary diameter of about 0.07 μm), 18 parts of an alkyd resin (BECKOLITE M6401-50-S from DIC Corporation, containing 50% of solid components), 10 parts of a melamine resin (L-145-60 from DIC Corporation, containing 60% of solid components), and 80 parts of 2-butanone.

Properties of the photoreceptors prepared above are shown in Table 6.

TABLE 6

| | Amount of Titanyl Phthalocyanine Pigment in CGL (% by weight) | Amount of Inorganic Pigments in UL (% by weight) | D(F1) (μM) | D(F2)/D(G) |
|---|---|---|---|---|
| Ex. 1 | 85 | 86 | 0.25 | 0.32 |
| Ex. 2 | 80 | 86 | 0.25 | 0.33 |
| Ex. 3 | 75 | 86 | 0.25 | 0.30 |
| Ex. 4 | 71 | 86 | 0.25 | 0.29 |
| Ex. 5 | 80 | 86 | 0.25 | 0.33 |
| Ex. 6 | 80 | 86 | 0.25 | 0.33 |
| Ex. 7 | 80 | 86 | 0.25 | 0.33 |
| Ex. 8 | 80 | 86 | 0.25 | 0.33 |
| Ex. 9 | 80 | 86 | 0.25 | 0.30 |
| Ex. 10 | 80 | 86 | 0.25 | 0.23 |
| Ex. 11 | 80 | 86 | 0.25 | 0.21 |
| Ex. 12 | 80 | 86 | 0.25 | 0.25 |
| Ex. 13 | 80 | 86 | 0.25 | 0.33 |
| Ex. 14 | 80 | 86 | 0.25 | 0.33 |
| Ex. 15 | 80 | 86 | 0.25 | 0.33 |
| Ex. 16 | 80 | 76 | 0.25 | 0.33 |
| Ex. 18 | 80 | 86 | 0.25 | 0.48 |
| Ex. 19 | 80 | 86 | 0.25 | 0.33 |
| Ex. 21 | 71 | 86 | 0.25 | 0.29 |
| Ex. 22 | 85 | 86 | 0.25 | 0.33 |
| Ex. 23 | 71 | 86 | 0.25 | 0.29 |
| Ex. 24 | 71 | 86 | 0.25 | 0.29 |
| Ex. 25 | 71 | 86 | 0.25 | 0.29 |
| Ex. 26 | 71 | 86 | 0.25 | 0.29 |
| Comp. Ex. 1 | 50 | 86 | 0.25 | 0.27 |
| Comp. Ex. 2 | 60 | 86 | 0.25 | 0.36 |
| Comp. Ex. 3 | 67 | 86 | 0.25 | 0.32 |
| Comp. Ex. 4 | 86 | 86 | 0.25 | 0.20 |
| Comp. Ex. 5 | 80 | 86 | 0.25 | 0.33 |
| Comp. Ex. 6 | 80 | 86 | 0.25 | 0.33 |
| Comp. Ex. 7 | 80 | 86 | 0.25 | 0.33 |
| Comp. Ex. 8 | 80 | 86 | 0.25 | 0.33 |
| Comp. Ex. 9 | 80 | 86 | 0.25 | 0.19 |
| Comp. Ex. 10 | 80 | 91 | 0.25 | 0.33 |
| Comp. Ex. 11 | 80 | 71 | 0.25 | 0.33 |
| Comp. Ex. 12 | 80 | 86 | 0.18 | 0.33 |
| Comp. Ex. 13 | 80 | 86 | — | 0.33 |
| Comp. Ex. 14 | 80 | 86 | 0.25 | 0.86 |
| Comp. Ex. 15 | 60 | 86 | 0.25 | 0.37 |
| Comp. Ex. 16 | 71 | 71 | 0.25 | 0.29 |
| Comp. Ex. 17 | 71 | 86 | 0.18 | 0.29 |
| Comp. Ex. 18 | 71 | 86 | 0.25 | 0.75 |
| Comp. Ex. 19 | 71 | 86 | 0.25 | 0.29 |
| Comp. Ex. 20 | 80 | 86 | 0.18 | 0.33 |

Evaluations

Each of the photoreceptors prepared above is mounted on an electrophotographic process cartridge. The process cartridge is attached to a modified image forming apparatus IMAGIO NEO 751 (from Ricoh Co., Ltd.) in which the linear speed (i.e., process speed) of photoreceptor is set to 350 mm/sec. A running test in which an image is continuously produced on 400,000 sheets of an A4-size paper MY PAPER (from NBS Ricoh) is performed. The initial potential is −800 V. The following evaluations are performed during the running test. All the results are shown in Table 7.

Measurement of Bright Section Potential

An electrometer probe connected to a surface electrometer (TREK MODEL 344) is attached to the developing unit, to which the photoreceptor is set. The grid bias is controlled so that the dark section potential is −800 V. After a black solid image is produced, the bright section potential is measured before starting the running test. Similarly, the bright section potential is also measured after 400,000$^{th}$ sheet is produced.

Evaluation of Image Density/Background Fouling/Moiré

A halftone image having an image density of 50% is produced before and after the running test, i.e., after the 400,000$^{th}$ sheet is produced, to evaluate change in image density.

An electrometer probe connected to a surface electrometer (TREK MODEL 344) is attached to the developing unit, to which the photoreceptor is set. The grid bias is controlled so that the dark section potential is −800 V. A white solid image is produced 5 minutes after the 400,000$^{th}$ sheet is produced, and a difference (ΔVd) in the bright section potential between the first and second rotations of the photoreceptor is measured. This evaluation is performed before in advance of the measurement of the bright section potential.

TABLE 7

| | CGL | Initial Stage | | | | After printing 400,000$^{th}$ image | | | | |
|---|---|---|---|---|---|---|---|---|---|---|
| | Coating Liquid No. | VL (−V) | ID | BF | Moiré | VL (−V) | ID | BF | Moiré | ΔVd (−V) |
| Ex. 1 | 1 | 70 | A | A | A | 75 | A | B | A | 0 |
| Ex. 2 | 2 | 70 | A | A | A | 75 | A | B | A | 5 |
| Ex. 3 | 3 | 75 | A | A | A | 75 | A | B | A | 5 |
| Ex. 4 | 4 | 80 | A | A | A | 85 | A | B | A | 10 |
| Ex. 5 | 2 | 75 | A | A | A | 80 | A | B | A | 10 |
| Ex. 6 | 2 | 65 | A | A | A | 70 | A | B | A | 5 |
| Ex. 7 | 2 | 70 | A | A | A | 75 | A | B | A | 10 |
| Ex. 8 | 2 | 85 | A | A | A | 95 | A | B | A | 5 |
| Ex. 9 | 5 | 65 | A | A | A | 70 | A | B | A | 10 |
| Ex. 10 | 6 | 80 | A | A | A | 90 | A | B | A | 5 |
| Ex. 11 | 7 | 90 | A | A | A | 100 | A | B | A | 15 |
| Ex. 12 | 8 | 80 | A | A | A | 85 | A | B | A | 5 |
| Ex. 13 | 2 | 65 | A | B | A | 70 | A | B | A | 5 |
| Ex. 14 | 2 | 60 | A | A | A | 60 | A | B | A | 0 |
| Ex. 15 | 2 | 70 | A | A | A | 70 | A | B | A | 0 |
| Ex. 16 | 2 | 85 | A | A | A | 100 | B | B | A | 10 |
| Ex. 18 | 2 | 90 | A | A | A | 110 | A | B | A | 10 |
| Ex. 19 | 2 | 90 | A | A | A | 100 | B | B | A | 5 |
| Ex. 21 | 4 | 80 | A | A | A | 90 | A | B | A | 10 |
| Ex. 22 | 1 | 80 | A | A | A | 80 | A | B | A | 0 |
| Ex. 23 | 4 | 70 | A | A | A | 70 | A | B | A | 10 |
| Ex. 24 | 4 | 100 | A | A | A | 110 | A | A | A | 10 |
| Ex. 25 | 4 | 100 | A | A | A | 105 | A | A | A | 10 |
| Ex. 26 | 4 | 85 | A | A | A | 90 | A | B | A | 10 |
| Comp. Ex. 1 | 9 | 105 | A | A | A | 115 | C | B | A | 40 |
| Comp. Ex. 2 | 10 | 105 | A | A | A | 120 | C | B | A | 40 |
| Comp. Ex. 3 | 11 | 100 | A | A | A | 120 | C | B | A | 35 |
| Comp. Ex. 4 | 12 | 120 | A | B | A | 140 | C | C | A | 5 |
| Comp. Ex. 5 | 2 | 120 | A | A | A | 190 | D | B | A | 5 |
| Comp. Ex. 6 | 2 | 110 | A | A | A | 170 | D | B | A | 10 |
| Comp. Ex. 7 | 2 | 115 | A | A | A | 140 | D | B | A | 10 |
| Comp. Ex. 8 | 2 | 130 | A | A | A | 185 | D | B | A | 5 |
| Comp. Ex. 9 | 13 | 95 | A | A | A | 115 | C | B | A | 5 |
| Comp. Ex. 10 | 2 | 60 | A | C | A | 70 | A | D | A | 5 |
| Comp. Ex. 11 | 2 | 95 | A | A | A | 125 | D | B | A | 20 |
| Comp. Ex. 12 | 2 | 75 | A | A | C | 90 | A | B | C | 5 |
| Comp. Ex. 13 | 2 | 80 | A | A | D | 100 | A | B | D | 0 |
| Comp. Ex. 14 | 2 | 115 | A | A | A | 155 | D | B | A | 25 |
| Comp. Ex. 15 | 10 | 120 | B | A | A | 150 | D | A | A | 40 |
| Comp. Ex. 16 | 4 | 125 | B | A | A | 160 | D | A | A | 25 |
| Comp. Ex. 17 | 4 | 115 | B | A | C | 145 | D | B | C | 15 |
| Comp. Ex. 18 | 4 | 125 | B | A | A | 160 | D | A | A | 25 |
| Comp. Ex. 19 | 4 | 150 | C | A | A | 195 | D | A | A | 5 |
| Comp. Ex. 20 | 2 | 100 | B | B | A | 135 | D | D | A | 5 |

A white solid image is produced before and after the running test, i.e., after the 400,000$^{th}$ sheet is produced, to visually observe the degree of background fouling.

A halftone image having an image density of 50% is produced before and after the running test, i.e., after the 400,000$^{th}$ sheet is produced, to evaluate the degree of moiré.

The evaluation results are graded as follows.

A: No problem in image quality.

B: Image quality is slightly decreased, but no problem in visual observation.

C: Image quality is decreased, which is recognized by visual observation.

D: Significant problems in image quality.

Evaluation of Charge Decrease in the First Rotation

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-168717, filed on Jun. 27, 2008, the entire contents of which are herein incorporated by reference.

What is claimed is:

1. An electrophotographic photoreceptor, comprising:

a conductive substrate;

an undercoat layer located overlying the conductive substrate;

a charge generation layer located overlying the undercoat layer; and a charge transport layer located overlying the charge generation layer, wherein the under coat layer comprises a binder resin and multiple inorganic pigments each having different average primary particle diameters in a total amount of from 75 to 86% by weight;

wherein the charge generation layer comprises a binder resin and a titanyl phthalocyanine pigment having a maximum diffraction peak at a Bragg angle 2θ (±0.2°) of 27.2° with respect to a characteristic X-ray specific to CuKα having a wavelength of 1.542 Å in an amount of from 70 to 85% by weight;

wherein the charge transport layer comprises a distyryl compound having the following formula (1):

(1)

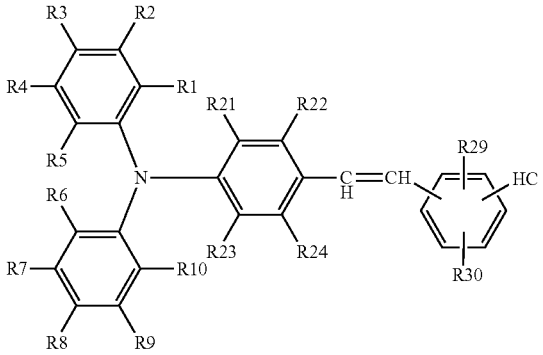

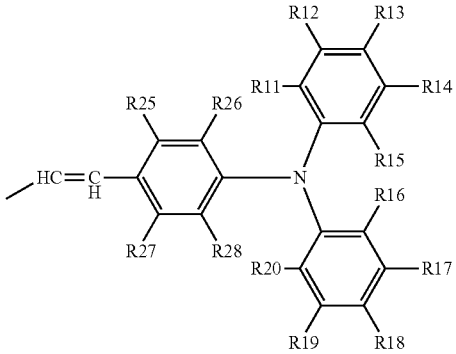

wherein each of R1 to R30 independently represents a hydrogen atom, an alkyl group having 1 to 3 carbon atoms, an alkoxyl group having 1 to 3 carbon atoms, an aryl group substituted with an alkyl group having 1 to 3 carbon atoms or an alkoxyl group having 1 to 3 carbon atoms, or an unsubstituted aryl group; and each of R1 and R30 may share bond connectivity with an adjacent group to form a ring;

the charge transport layer further comprises a compound having a substituted or unsubstituted alkylamino group in an amount of from 3 to 20 parts by weight based on 100 parts by weight of the distyryl compound; and wherein the following formulae (2-1) to (2-3) are satisfied:

$$0.2 \leqq (D(F2)/D(G)) \leqq 0.5 \quad (2\text{-}1)$$

$$0.2 \leqq D(F1) \quad (2\text{-}2)$$

$$D(F2) \leqq D(F1) \quad (2\text{-}3)$$

wherein D(F1) (μm) and D(F2) (μm) represent average primary particle diameters of the largest and smallest inorganic pigments, respectively, and D(G) (μm) represents an average primary particle diameter of the titanyl phthalocyanine pigment.

2. The electrophotographic photoreceptor according to claim 1, wherein the charge generation layer comprises the titanyl phthalocyanine pigment in an amount of from 80 to 85% by weight.

3. The electrophotographic photoreceptor according to claim 1, wherein D(G) (μm) is from 0.15 to 0.3.

4. The electrophotographic photoreceptor according to claim 1, wherein the following equation is satisfied:

$$0.2 \leqq T2/(T1+T2) \leqq 0.8$$

wherein T1 and T2 represent amounts of the inorganic pigments having the average primary particle diameters of D(F1) and D(F2), respectively.

5. The electrophotographic photoreceptor according to claim 1, wherein at least one of the inorganic pigments is a metal oxide.

6. The electrophotographic photoreceptor according to claim 5, wherein the metal oxide is a titanium oxide.

7. The electrophotographic photoreceptor according to claim 1, wherein the distyryl compound has the following formula (4):

(4)

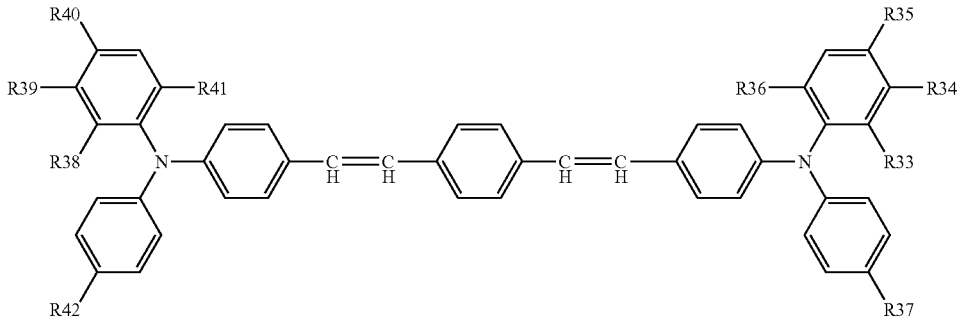

wherein each of R33 to R42 independently represents a hydrogen atom, an alkyl group having 1 to 3 carbon atoms, an alkoxyl group having 1 to 3 carbon atoms, or an aryl group which may be substituted with an alkyl group having 1 to 3 carbon atoms or an alkoxyl group having 1 to 3 carbon atoms.

8. The electrophotographic photoreceptor according to claim 1, wherein the charge transport layer further comprises an amine-based antioxidant in an amount of from 3 to 10 parts by weight based on 100 parts by weight of the distyryl compound.

9. The electrophotographic photoreceptor according to claim 8, wherein the amine-based antioxidant has the following formula (5):

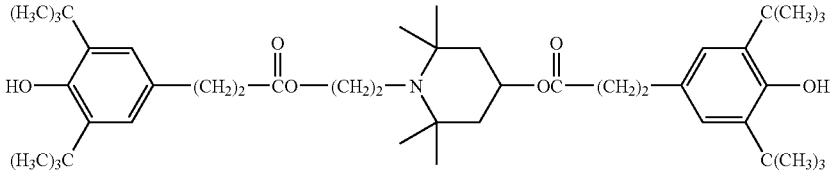

(5)

10. The electrophotographic photoreceptor according to claim 1, wherein the compound having a substituted or unsubstituted alkylamino group has the following formula (6):

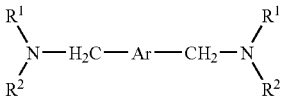

(6)

wherein each of $R^1$ and $R^2$ independently represents a substituted or unsubstituted alkyl or aromatic hydrocarbon group, wherein at least one of $R^1$ and $R^2$ represents a substituted or unsubstituted aromatic hydrocarbon group, and $R^1$ and $R^2$ may share bond connectivity to form a heterocyclic ring containing a nitrogen atom; and Ar represents a substituted or unsubstituted aromatic hydrocarbon group.

11. The electrophotographic photoreceptor according to claim 1, further comprising a protective layer located overlying the charge transport layer.

12. The electrophotographic photoreceptor according to claim 11, wherein the protective layer is a cross-linked charge transport layer.

13. An image forming apparatus, comprising:

the electrophotographic photoreceptor according to claim 1;

a charger configured to charge a surface of the electrophotographic photoreceptor;

an irradiator configured to irradiate the charged surface of the electrophotographic photoreceptor to form an electrostatic latent image;

a developing device configured to develop the electrostatic latent image with a toner to form a toner image; and a transfer device configured to transfer the toner image from electrophotographic photoreceptor onto a transfer member.

14. An image forming apparatus comprising a process cartridge containing the electrophotographic photoreceptor according to claim 1 and at least one of a charger, an irradiator, a developing device, a transfer device, and a cleaning device, wherein the process cartridge is detachably attached to the image forming apparatus.

15. An electrophotographic photoreceptor, comprising:

a conductive substrate;

an undercoat layer located overlying the conductive substrate;

a charge generation layer located overlying the undercoat layer; and a charge transport layer located overlying the charge generation layer, wherein the under coat layer comprises a binder resin and multiple inorganic pigments each having different average primary particle diameters in a total amount of from 75 to 86% by weight;

wherein the charge generation layer comprises a binder resin and a titanyl phthalocyanine pigment having a maximum diffraction peak at a Bragg angle 2θ (±0.2°) of 27.2° with respect to a characteristic X-ray specific to CuKα having a wavelength of 1.542 Å in an amount of from 70 to 85% by weight;

wherein the charge transport layer comprises a distyryl compound having the following formula (1):

(1)

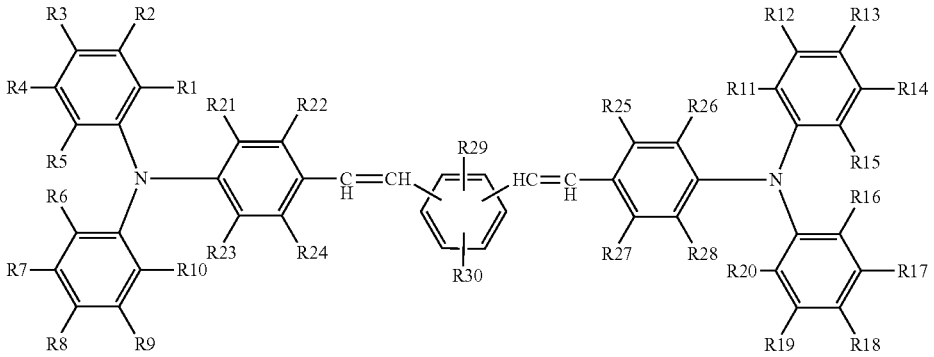

wherein each of R1 to R30 independently represents a hydrogen atom, an alkyl group having 1 to 3 carbon atoms, an alkoxyl group having 1 to 3 carbon atoms, an aryl group substituted with an alkyl group having 1 to 3 carbon atoms or an alkoxyl group having 1 to 3 carbon atoms, or an unsubstituted aryl group; and each of R1 and R30 may share bond connectivity with an adjacent group to form a ring; and wherein the following formulae (2-1) to (2-3) are satisfied:

$$0.2 \leqq (D(F2)/D(G)) \leqq 0.5 \quad (2\text{-}1)$$

$$0.2 \leqq D(F1) \quad (2\text{-}2)$$

$$D(F2) \leqq D(F1) \quad (2\text{-}3)$$

wherein D(F1) (μm) and D(F2) (μm) represent average primary particle diameters of the largest and smallest inorganic pigments, respectively, and D(G) (μm) represents an average primary particle diameter of the titanyl phthalocyanine pigment, wherein the binder resin in the charge generation layer is a polyvinyl acetal resin having the following formula (3):

(3)

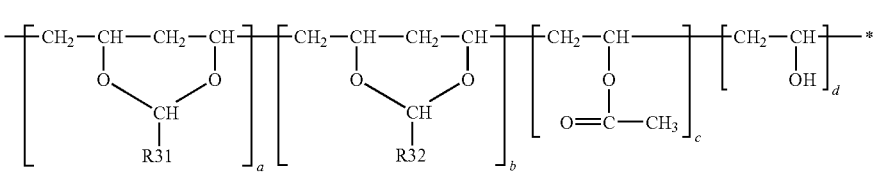

wherein each of R31 and R32 independently represents an alkyl group having 1 to 5 carbon atoms; and a, b, c, and d are numeric values satisfying the following equations: $0.06 \leqq a+b \leqq 0.80$, $0 \leqq c \leqq 0.06$, and $0.20 \leqq d \leqq 0.40$.

16. The electrophotographic photoreceptor according to claim 15, wherein the numeric value d satisfies the following equation: $0.30 \leqq d \leqq 0.40$.

17. The electrophotographic photoreceptor according to claim 16, wherein the polyvinyl acetal resin has a weight average molecular weight of from 60,000 to 130,000.

18. A method of producing electrophotographic photoreceptor, comprising:

forming an undercoat layer on a conductive substrate, the undercoat layer comprising a binder resin and multiple inorganic pigments each having different average primary particle diameters in a total amount of from 75 to 86% by weight;

forming a charge generation layer on the undercoat layer, the charge generation layer comprising a binder resin and a titanyl phthalocyanine pigment having a maximum diffraction peak at a Bragg angle 2θ (±0.2°) of 27.2° with respect to a characteristic X-ray specific to CuKα having a wavelength of 1.542 Å in an amount of from 70 to 85% by weight; and forming a charge transport layer on the charge generation layer, the charge transport layer comprising a distyryl compound having the following formula (1):

(1)

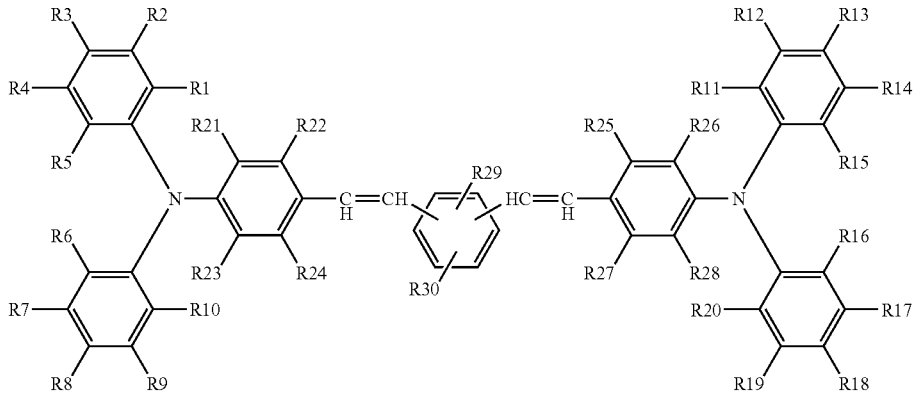

wherein each of R1 to R30 independently represents a hydrogen atom, an alkyl group having 1 to 3 carbon atoms, an alkoxyl group having 1 to 3 carbon atoms, an aryl group substituted with an alkyl group having 1 to 3 carbon atoms or an alkoxyl group having 1 to 3 carbon atoms, or an unsubstituted aryl group; and each of R1 and R30 may share bond connectivity with an adjacent group to form a ring, wherein the charge transport layer further comprises a compound having a substituted or unsubstituted alkylamino group in an amount of from 3 to 20 parts by weight based on 100 parts by weight of the distyryl compound; and wherein the following formulae (2-1) to (2-3) are satisfied:

$$0.2 \leqq (D(F2)/D(G)) \leqq 0.5 \quad (2\text{-}1)$$

$$0.2 \leqq D(F1) \quad (2\text{-}2)$$

$$D(F2) \leqq D(F1) \quad (2\text{-}3)$$

wherein D(F1) (μm) and D(F2) (μm) represent average primary particle diameters of the largest and smallest inorganic pigments, respectively, and D(G) (μm) represents an average primary particle diameter of the titanyl phthalocyanine pigment.

19. The method of producing electrophotographic photoreceptor according to claim 18, wherein D(G) (μm) is from 0.15 to 0.3.

* * * * *